US007931229B2

(12) United States Patent
Genta

(10) Patent No.: US 7,931,229 B2
(45) Date of Patent: Apr. 26, 2011

(54) ROLLED MEDIUM SUPPORTING MECHANISM FOR SUPPORTING BOTH ENDS OF ROLLED MEDIUM AND RECORDING APPARATUS HAVING THE ROLLED MEDIUM SUPPORTING MECHANISM

(75) Inventor: Shin Genta, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 597 days.

(21) Appl. No.: 11/692,053

(22) Filed: Mar. 27, 2007

(65) Prior Publication Data

US 2008/0018037 A1 Jan. 24, 2008

(30) Foreign Application Priority Data

Mar. 28, 2006 (JP) ..... 2006-089236
Mar. 28, 2006 (JP) ..... 2006-089237
Mar. 28, 2006 (JP) ..... 2006-089238

(51) Int. Cl.
*B65H 75/24* (2006.01)

(52) U.S. Cl. ..... 242/575.4; 279/2.19; 242/573.9

(58) Field of Classification Search ..... 242/571, 242/571.6, 575, 575.3, 575.4, 575.5; 279/2.19, 279/114
See application file for complete search history.

(56) References Cited

U.S. PATENT DOCUMENTS 2,198,276 A * 4/1940 Robinson ..... 242/575.4
7,506,834 B2 * 3/2009 Lenkl ..... 242/573.7
2007/0278342 A1 * 12/2007 Harkins ..... 242/571

FOREIGN PATENT DOCUMENTS

| | | |
|---|---|---|
| JP | 09-119442 | 5/1997 |
| JP | 11-322141 | 11/1999 |
| JP | 2000-289907 | 10/2000 |
| JP | 2001-080798 | 3/2001 |
| JP | 2001-199639 | 7/2001 |
| JP | 2003-276911 | 10/2003 |
| JP | 2004299862 | * 10/2004 |
| JP | 2004-358764 | 12/2004 |

* cited by examiner

*Primary Examiner* — Michael R Mansen
*Assistant Examiner* — Juan J Campos
(74) *Attorney, Agent, or Firm* — Workman Nydegger

(57) ABSTRACT

A rolled medium supporting mechanism includes a supporting member 210 that rotatably supports a rolled medium. The mechanism is provided with a plurality of abutting supporting members 230 arranged in the circumferential direction of the supporting member and supporting the rolled medium by making abutting contact with an inner peripheral face of a hollow shaft portion of the rolled medium when the mechanism is inserted into the hollow shaft portion of the rolled medium. The abutting supporting members are configured to be freely displaced in a roll-diameter direction in accordance with an inner diameter of the hollow shaft portion. With such a configuration, it is not necessary to have a separate component in order to adapt to core members having different diameters, but only displacement of the abutting supporting member is needed. Thus, it is possible to simplify the construction and provide easy handling properties.

1 Claim, 35 Drawing Sheets

(A)

(B)

(A)

(B)

(B)

(A)

(B)

(A)

(B)

(A)

(B)

(A)

(A)

(B)

(A)

(B)

(B)

(A)

ROLLED MEDIUM SUPPORTING MECHANISM FOR SUPPORTING BOTH ENDS OF ROLLED MEDIUM AND RECORDING APPARATUS HAVING THE ROLLED MEDIUM SUPPORTING MECHANISM

BACKGROUND OF THE INVENTION

The present invention relates to a rolled medium supporting mechanism for supporting both ends of a rolled medium and a recording apparatus having the rolled medium supporting mechanism. More specifically, the invention relates to a rolled medium supporting mechanism and a recording apparatus having the rolled medium supporting mechanism, in which the mechanism can support core members, having different diameters, of a rolled medium with a simple structure.

Generally, in a large-sized printer that is one of recording apparatuses, a paper feeding unit for feeding roll paper that is one of recording mediums, a recording unit for recording data on the roll paper fed thereto, and a paper discharging unit for discharging the roll paper having the data recorded thereon are arranged in this order from the upper portion thereof. The roll paper is inserted into the paper feeding unit in a state in which a holding member is inserted into both ends of a hollow paper tube serving as a shaft core. The roll paper holding member is formed in a shape such that a disk-shaped flange portion and a cylindrical boss portion are integrated as a single body, and the holding member supports the roll paper with the boss portion inserted into the paper tube. The boss portion is formed in a diameter suitable for a paper tube with a diameter of 2 inches. When a paper tube with a diameter of 3 inches is used, an adapter, which is a separate component, is fitted to the boss portion so as to be adaptable to the paper tube (see JP-A-2003-276911).

The above-described roll paper holding member requires an adapter in order to adapt to paper tubes having different diameters. The storage or maintenance of the adapter is troublesome. When the diameter of the paper tube used is irregular, the pulling-out and pushing-in operation of the boss portion into and from the paper tube may require a large force.

DISCLOSURE OF INVENTION

The invention has been made in view of the above-described problems, and an object thereof is to provide a rolled medium supporting mechanism and a recording apparatus having the rolled medium supporting mechanism, in which the mechanism can support core members, having different diameters, of a rolled medium with a simple structure while maintaining easy handling properties.

In order to accomplish the above-mentioned object, according to the invention, there is provided a rolled medium supporting mechanism having a supporting member for supporting a rolled medium to be rotatable around a roll shaft. The mechanism is provided with a plurality of abutting supporting members arranged in the circumferential direction of the supporting member and supporting the rolled medium by making abutting contact with an inner peripheral face of a hollow shaft portion of the rolled medium when the mechanism is inserted into the hollow shaft portion of the rolled medium. The abutting supporting members are configured to be freely displaced in a roll-diameter direction in accordance with an inner diameter of the hollow shaft portion of the rolled medium. With such a configuration, it is not necessary to have a separate component in order to adapt to core members having different diameters, but only displacement of the abutting supporting members is needed. Thus, it is possible to simplify the construction and provide easy handling properties.

The abutting supporting members may be displaced by the advancing and retracting operation of a lock member provided in the supporting member. With such a configuration, it is possible to simplify the displacement mechanism.

The lock member may advance and retract in cooperation with the pushing-in and drawing-out operation of a set lever member provided in an abutting member that is integrally formed with the supporting member so as to make abutting contact with an end face of the rolled medium. With such a configuration, the user can displace the abutting supporting member in a simple manner.

A wedge that is formed in the lock member may make abutting contact with the abutting supporting members so that the abutting supporting members are locked in a state in which they are brought into abutting contact with the inner peripheral face of the hollow portion of the rolled medium. With such a configuration, it is possible to bring the abutting supporting member into abutting contact with the inner peripheral face of the hollow shaft portion of the rolled medium in a secure manner.

The abutting supporting members may be formed in a substantially rectangular parallelepiped shape and may make contact with a large area of the inner peripheral face of the hollow portion of the rolled medium. The wedge of the lock member making abutting contact with the abutting supporting members may have slope faces for which a slope angle becomes smaller. With such a configuration, it is possible to increase the abutting force of the abutting supporting member with respect to the inner peripheral face of the hollow shaft portion of the rolled medium. Accordingly, it is possible to prevent the supporting member from dropping out from the hollow shaft portion of the rolled medium.

The abutting member integrally formed with the supporting member so as to make abutting contact with the end face of the rolled medium may have a polygon-shaped circumference. With such a configuration, it is possible to place the rolled medium on a horizontal plane in a stable state when the medium is fitted to the rolled medium supporting mechanism.

In order to accomplish the above-mentioned object, according to the invention, there is provided a recording apparatus which records data on a rolled recording medium while transporting the rolled recording medium, in which the apparatus is provided with the above-described rolled medium supporting mechanism. With such a configuration, it is possible to provide a recording apparatus having the above-described advantages.

In order to accomplish the above-mentioned object, according to the invention, there is provided a rolled medium supporting mechanism having a supporting member for supporting a rolled medium to be rotatable around a roll shaft. The supporting member is provided with a rib member that supports the rolled medium while making abutting contact with an inner peripheral face of a hollow shaft portion of the rolled medium when the mechanism is inserted into the hollow shaft portion of the rolled medium; and a wedge-shaped member that advances and retracts in an axial direction to allow the rib member to be displaced with respect to the inner peripheral face of the hollow shaft portion. The wedge-shaped member advances and retracts with a pushing-in operation of a button member provided in an abutting member that is integrally formed with the supporting member so as to make abutting contact with an end face of the rolled medium. With such a configuration, it is not necessary to have a separate component in order to adapt to core members having different diameters, but only displacement of the rib member by means of a simple displacement mechanism. Thus, it is possible to simplify the construction and provide easy handling properties. The user can displace the rib member in a simple manner.

The abutting member integrally formed with the supporting member so as to make abutting contact with the end face of the rolled medium may have a polygon-shaped circumference. With such a configuration, it is possible to place the rolled medium on a horizontal plane in a stable state when the medium is fitted to the rolled medium supporting mechanism.

In order to accomplish the above-mentioned object, according to the invention, there is provided a recording apparatus which records data on a rolled recording medium while transporting the rolled recording medium, in which the apparatus is provided with the above-described rolled medium supporting mechanism. With such a configuration, it is possible to provide a recording apparatus having the above-described advantages.

In order to accomplish the above-mentioned object, according to the invention, there is provided a rolled medium supporting mechanism having a supporting member for supporting a rolled medium to be rotatable around a roll shaft. The mechanism is provided with a plurality of expandable abutting members arranged in the circumferential direction of the supporting member, in which one end thereof is supported by the supporting member in a roll-shaft direction and the other end thereof makes abutting contact with an inner peripheral face of a hollow shaft portion of the rolled medium. The expandable abutting members are configured to freely expand in a roll-diameter direction about a shaft supporting portion of the supporting member in accordance with an inner diameter of the hollow shaft portion of the rolled medium. With such a configuration, it is not necessary to have a separate component in order to adapt to core members having different diameters, but only displacement of the expandable abutting members is needed. Thus, it is possible to simplify the construction and provide easy handling properties.

The expandable abutting members may be open and closed relative to the shaft supporting portion in cooperation with an opening/closing member provided in the supporting member. With such a configuration, it is possible to simplify the expansion mechanism.

The expandable abutting members may be expanded within a predetermined angle by means of a cam mechanism provided in the expandable abutting member and a cam mechanism provided in the opening/closing mechanism. With such a configuration, it is possible to prevent the expandable abutting members from interfering with each other.

The expandable abutting members may be expanded in a stepwise manner by means of a cam mechanism provided in the expandable abutting member and a cam mechanism provided in the opening/closing mechanism. With such a configuration, it is possible to support core members having different diameters in a suitable manner.

A lock member cooperating with a set lever member provided in the supporting member may lock the expandable abutting members in a state in which they are brought into abutting contact with the inner peripheral face of the hollow shaft portion of the rolled medium. A wedge formed in the lock member may make abutting contact with a protrusion provided in each of the expandable abutting members so as to be pressed toward the inner peripheral face of the hollow shaft portion of the rolled medium. With such a configuration, it is possible to bring the expandable abutting members into abutting contact with the inner peripheral face of the hollow shaft portion of the rolled medium in a secure manner.

The abutting member integrally formed with the supporting member so as to make abutting contact with the end face of the rolled medium may have a polygon-shaped circumference. With such a configuration, it is possible to place the rolled medium on a horizontal plane in a stable state when the medium is fitted to the rolled medium supporting mechanism.

In order to accomplish the above-mentioned object, according to the invention, there is provided a recording apparatus which records data on a rolled recording medium while transporting the rolled recording medium, in which the apparatus is provided with the above-described rolled medium supporting mechanism. With such a configuration, it is possible to provide a recording apparatus having the above-described advantages.

DESCRIPTION OF THE PREFERRED EMBODIMENTS

Hereinafter, the invention will be described with reference to the accompanying drawings, in which preferred embodiments of the invention are disclosed. However, the invention should not be construed as being limited to the embodiments set forth herein. Moreover, the entire combinations of the features disclosed in the embodiments should not be construed as being essential to the means for solving the invention.

Figure 1:
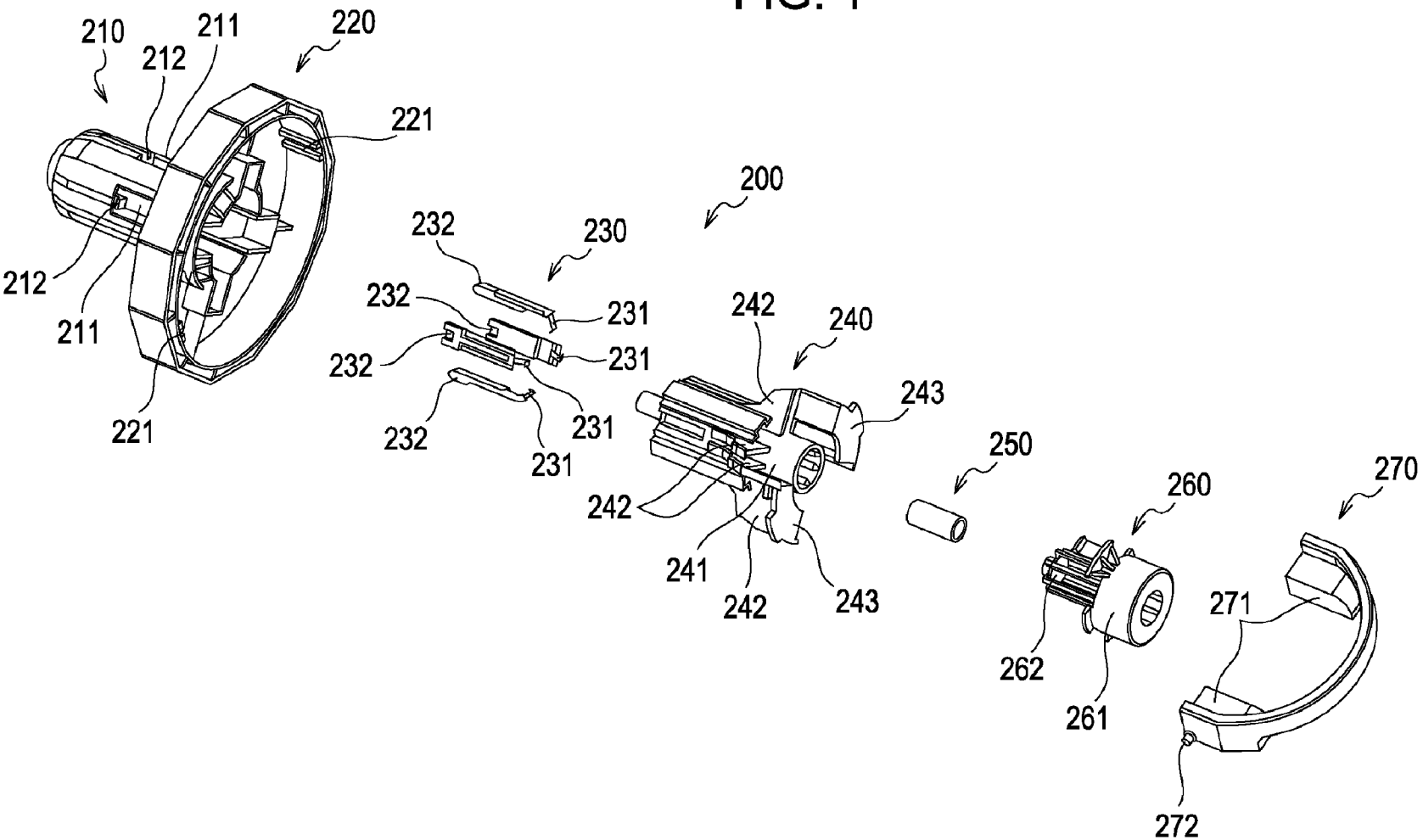
FIG. 1 is an exploded perspective view of a rolled medium supporting mechanism according to a first embodiment of the invention.

In the drawings, FIG. 1 is an exploded perspective view of a rolled medium supporting mechanism according to a first embodiment of the invention; FIGS. 2(A) and 2(B) are top views showing a main part of the mechanism in the exploded and assembled views; and FIGS. 3(A) and 3(B) and FIGS. 4(A) and 4(B) are diagrams showing the perspective and top views of the assembled state of the rolled medium supporting mechanism shown in FIG. 1. The rolled medium supporting mechanism 200 is configured as a paired set having two identically shaped components. The mechanism 200 is configured to support a roll paper (rolled medium) by being inserted into both ends of a hollow, 2- or 3-inch paper tube. As shown in FIG. 1, the rolled medium supporting mechanism 200 is provided with a boss member (supporting member) 210 made of plastic materials, a flange member (abutting member) 220, a rib member (abutting supporting member) 230, a wedge-shaped member (lock member) 240, a spring member (lock member) 250, a spring retainer member (lock member) 260, and a set lever member 270.

The boss member 210 is formed in a substantially hollow cylindrical shape having a diameter slightly smaller than that of a 2-inch paper tube. The boss member 210 supports an inner peripheral face of the paper tube by being inserted into the paper tube from its end portion. The flange member 220 is formed integrally and concentrically with the boss member 210 in a substantially circular dish-like shape. The flange member 220 makes abutting contact with end faces of the paper tube and the roll paper. The rib member 230 is formed in a substantially rod-like shape, and is provided with four ribs arranged at regular angles (90 degrees) around circumferential faces of the boss member 210 and the wedge-shaped member 240. The flange member 220 has a polygon-shaped circumference (which is dodecagonal-shaped in this embodiment). Thus, it is possible to prevent the roll paper from rolling on a floor or the like when the flange member 220 having the roll paper mounted thereon is placed on the floor.

The wedge-shaped member 240 is provided with a main body portion 241 having a substantially cylindrical shape; wedge portions (wedge) 242 having a substantially tapered shape and integrally formed at regular angles (90 degrees) on a circumferential face on the right side (in the drawing) of the main body portion 241 so as to extend in an axial direction; and an arm portion 243 having a substantially flange-like shape and integrally formed, separated by 180 degrees, in the main body portion 241 on the right side of the drawing so as to extend in a diameter direction. The wedge-shaped member 240 is disposed inside the boss member 210 by being inserted into the member 210 from the end face of the flange member 220. The wedge portions 242 of the wedge-shaped member 240 are formed in such a shape that the height of each portion 242 increases from the left side to the right side (in the drawing) of the main body portion 241.

Figure 2:
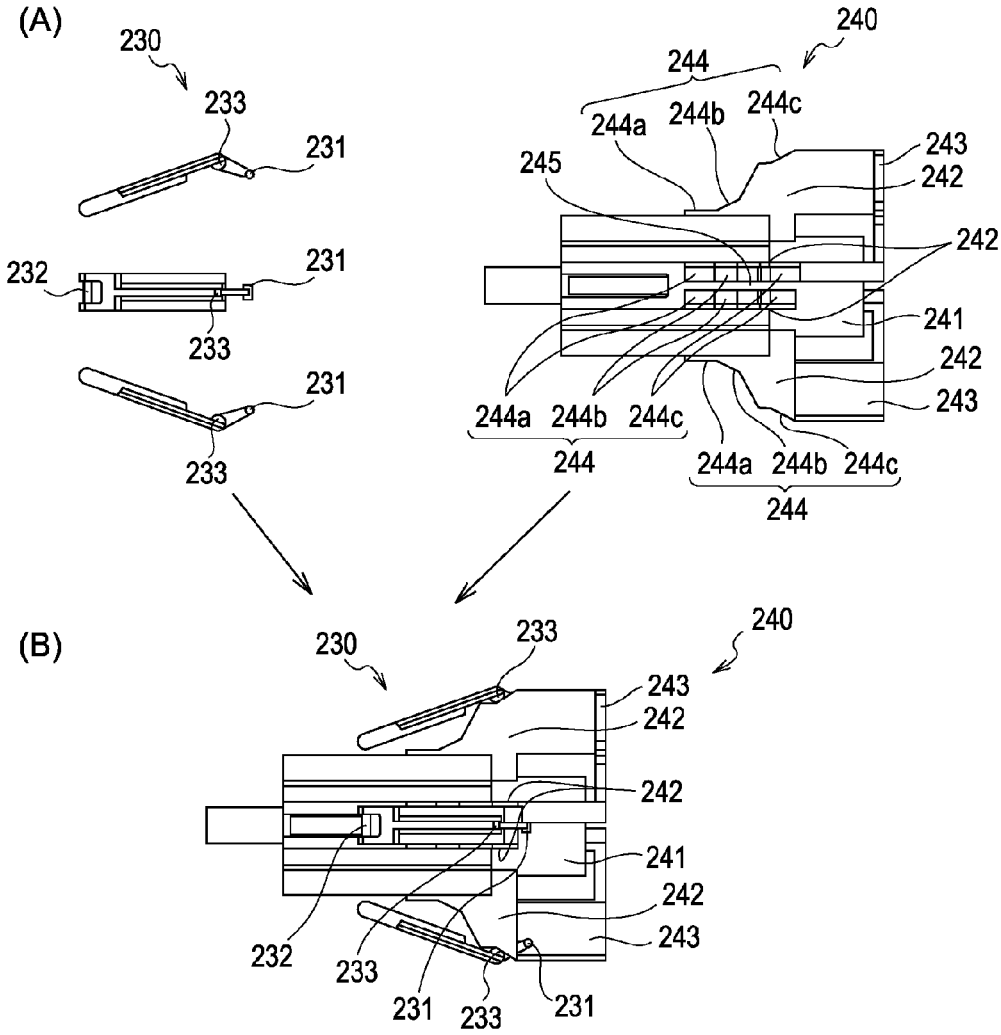
FIGS. 2(A) and 2(B) are top views of the rolled medium supporting mechanism shown in FIG. 1, showing a main part of the mechanism in the exploded and assembled views.

The rib member 230 and the wedge-shaped member 240 will be described in more detail. As shown in FIGS. 1 and 2, the rib member 230 is bent at a portion thereof on the right side (in the drawing). Dropout-preventing protruding portions 231 are integrally formed on a front end of the member 230, and pivot shaft portions 232 are integrally formed on the other end of the member 230. A top slope face 244 of each wedge portion 242 of the wedge-shaped member 240 is formed in such a shape that a portion thereof disposed on the other end side of the main body 241 is formed as a release area 244*a*, i.e., the lowest area; a slope face occurring first after the area 244*a* in the direction toward the right side (in the drawing) of the main body portion 241 is formed as a 2-inch-diameter area 244*b* configured to be adaptable to a 2-inch paper tube; and a slope face occurring second after the area 244*b* in that direction is formed as a 3-inch-diameter area 244*c* configured to be adaptable to a 3-inch paper tube.

In the top slope face 244 of each wedge portion 242, a guide slit 245 is formed through which portions of the rib member 230 disposed close to the Dropout-preventing protruding portions 231 are inserted, and which guides bent portions 233 of the rib member 230. On the circumferential face of the boss member 210, rectangular-shaped window portions 211 are formed through which portions of the rib member 230 disposed close to the Dropout-preventing protruding portions 231 and inserted into the guide slits 245 are exposed to the outside when the wedge-shaped member 240 is inserted into the window portions 211. In end portions of the window portions 211 disposed close to the boss member 210, bearing portions 212 are integrally formed, which pivotably support the pivot shaft portions 232 of the rib member 230.

The spring member 250 is a compression coil spring, and is disposed inside the main body portion 241 of the wedge-shaped member 240 by being inserted into the portion 241 from the right side thereof in the drawing. The spring retainer member 260 is provided with a main body portion 261 having a substantially cylindrical shape and open to the right side in the drawing, and a spring pressing portion 262 having a substantially rod-like shape and integrally formed with the main body portion 261 so as to extend in an axial direction from an inner end face on the right side (in the drawing) of the main body portion 261 while passing through an open end face thereof on the left side in the drawing. The spring retaining member 260 is disposed inside the main body portion 241 of the wedge-shaped member 240 by being inserted into the portion 241 from the right side thereof in the drawing. The set lever member 270 is formed in an arch shape, in which cam portions 271 are integrally formed opposite each other on inner sides of the arch's base portions, and pivot shaft portions 272 are integrally formed opposite each other on outer sides of the arch base portions. On an inner peripheral wall of the flange member 220, engagement grooves 221 are integrally formed, each of which engages with a corresponding one of the pivot shaft portions 272 of the set lever member 270.

Figure 3:
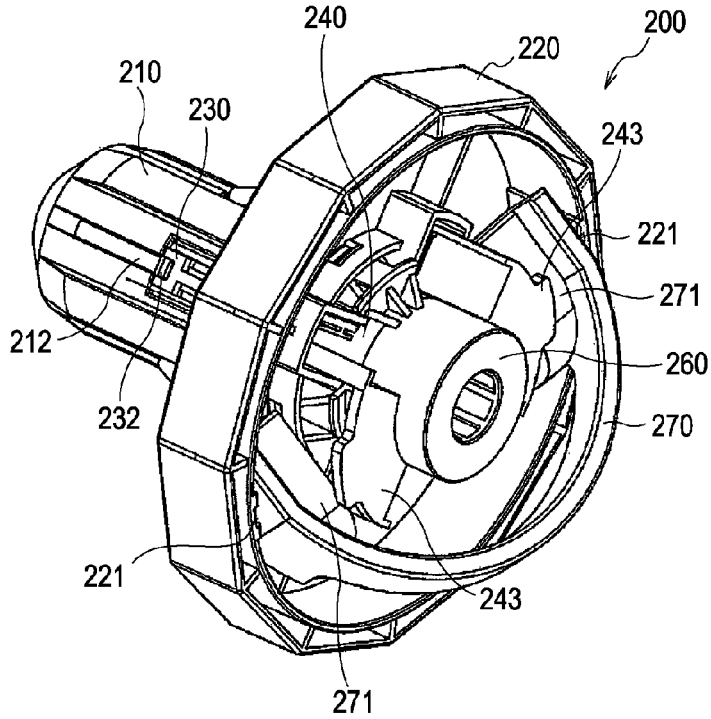
FIGS. 3(A) and 3(B) are first diagrams showing the perspective and top views of the assembled state of the rolled medium supporting mechanism shown in FIG. 1.
Figure 3:
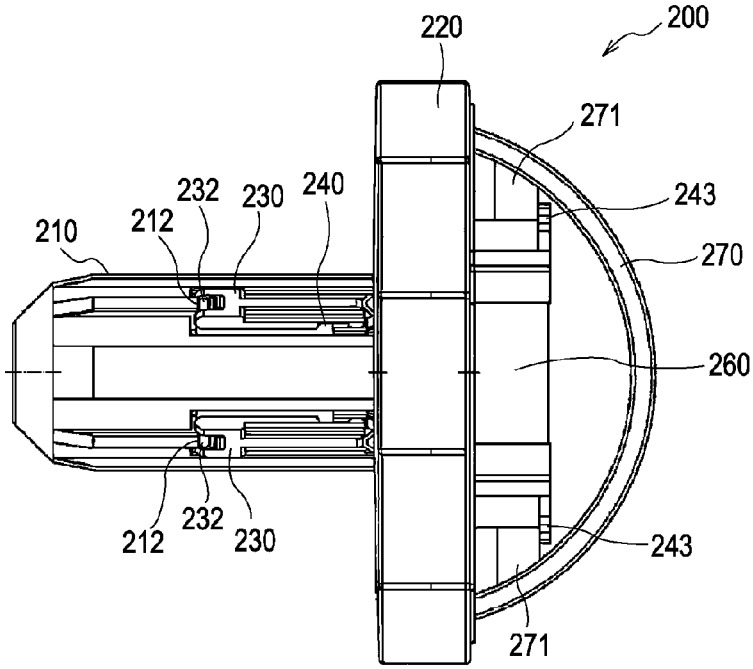
Figure 4:
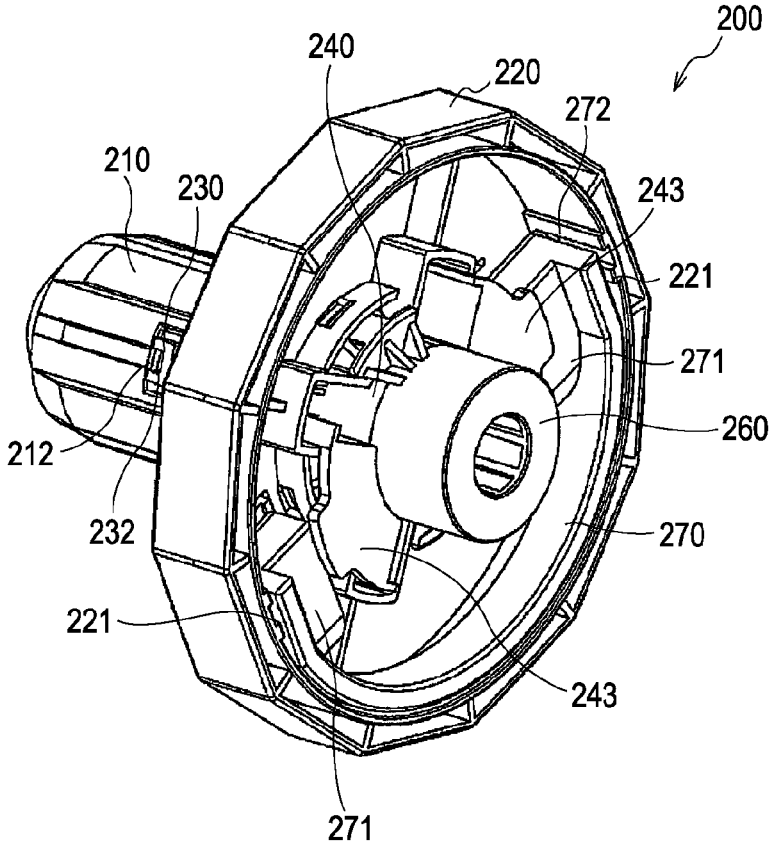
FIGS. 4(A) and 4(B) are second diagrams showing the perspective and top views of the assembled state of the rolled medium supporting mechanism shown in FIG. 1.
Figure 4:
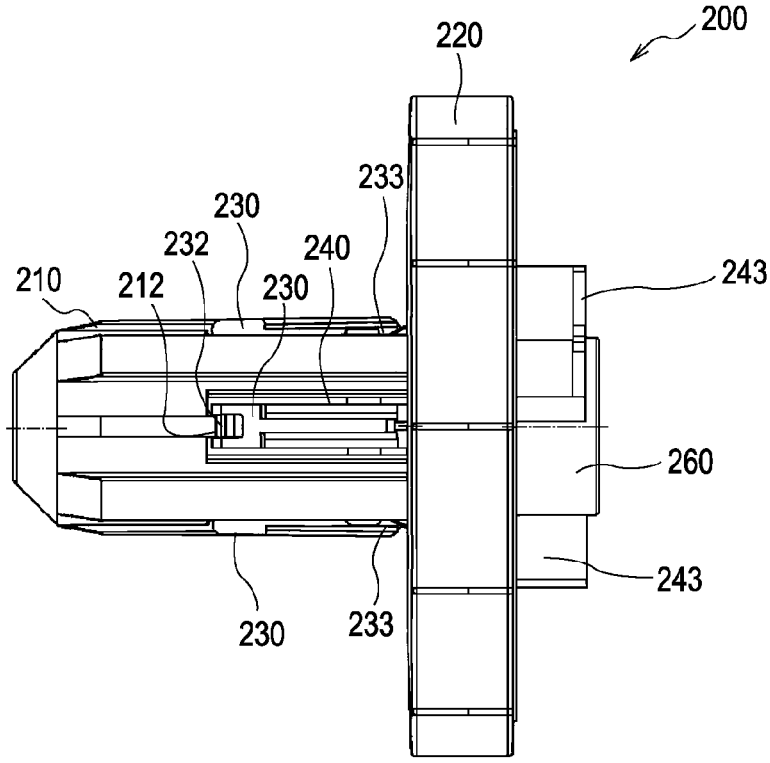

When the members having such a configuration are assembled, the wedge-shaped member 240 is first inserted into the boss member 210 from an end face on the right side (in the drawing) of the flange member 220. Next, the portions of the rib member 230 disposed close to the Dropout-preventing protruding portions 231 are inserted into the guide slits 245 of the wedge portions 242 of the wedge-shaped member 240 in a state in which the wedge portions 242 are exposed from the window portions 211 of the boss member 210. Accordingly, the pivot shaft portions 232 of the rib member 230 are fitted to the bearing portions 212 of the boss member 210. Next, the pivot shaft portions 272 of the set lever member 270 are inserted into the engagement grooves 221 of the flange member 220 so that they engage with each other. Then, the spring member 250 is inserted into the main body portion 241 of the wedge-shaped member 240, and the spring pressing portion 262 of the spring retainer member 260 is inserted into the main body portion 241 of the wedge-shaped member 240, whereby the main body portion 261 of the spring retainer member 260 is fixed to the flange member 220. In this manner, an assembled final product shown in FIGS. 3 and 4 is obtained.

In this embodiment, the set lever member 270 can freely swing about the pivot shafts 272 inserted into the engagement grooves 221 of the flange member 220. When the set lever member 270 is moved upward at 90 degrees with respect to the end face of the flange member 220 as shown in FIG. 3, the arm portions 243 of the wedge-shaped member 240 is pressed against the cam portions 271 of the set lever member 270, and the wedge-shaped member 240 compresses the spring member 250 and moves toward the flange member 220. When the set lever member 270 is laid down in parallel to the end face of the flange member 220 as shown in FIG. 4, the pressing of the cam portions 271 of the set lever member 270 against the arm portions 243 of the wedge-shaped member 240 is released, and the wedge-shaped member 240 is pressed against the spring member 250 and is moved toward the boss member 210. By increasing the diameter of the set lever member 270, the set lever member 270 can be operated with a small force.

In this case, the ribs of the rib member 230 can freely swing about the pivot shaft portions 232 fitted to the bearing portions 212 of the boss member 210. When the wedge-shaped member 240 moves toward the flange member 220 or the boss member 210, the bent portions 233 are slid upward or downward along the top slope face 244 while being guided by the guide slits 245 of the wedge portions 242. That is, the ribs of the rib member 230 can be freely operable between a state in which they are folded in parallel to the axis of the boss member 210 and a state in which they are unfolded in the radial direction by a predetermined angle. The operating method of the mechanism having such a configuration will be described with reference to the drawings.

Figure 5:
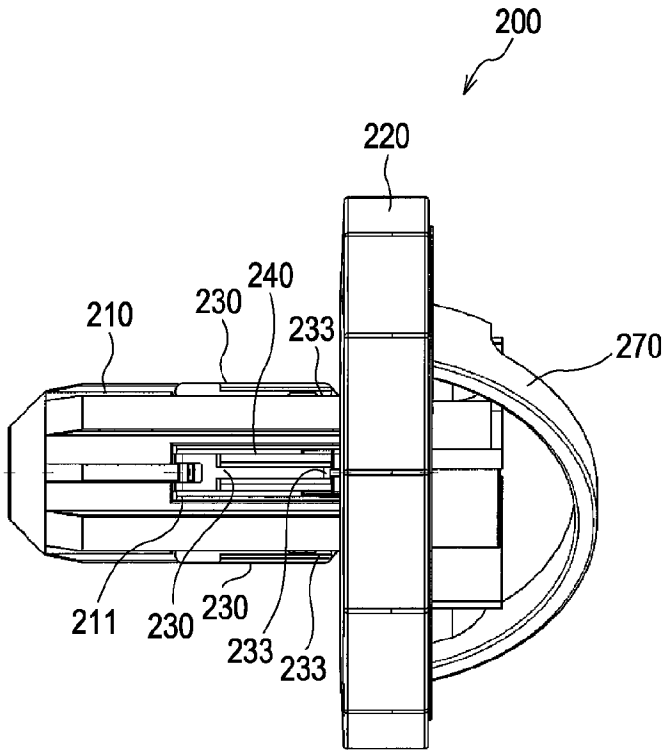
FIGS. 5(A) and 5(B) are first diagrams showing the sectional and side views for explaining a method of operating the rolled medium supporting mechanism shown in FIG. 1.
Figure 5:
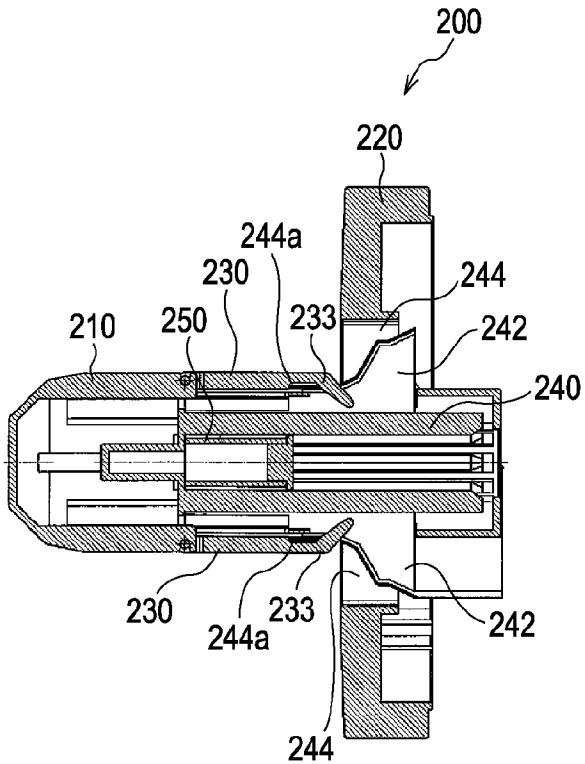
Figure 6:
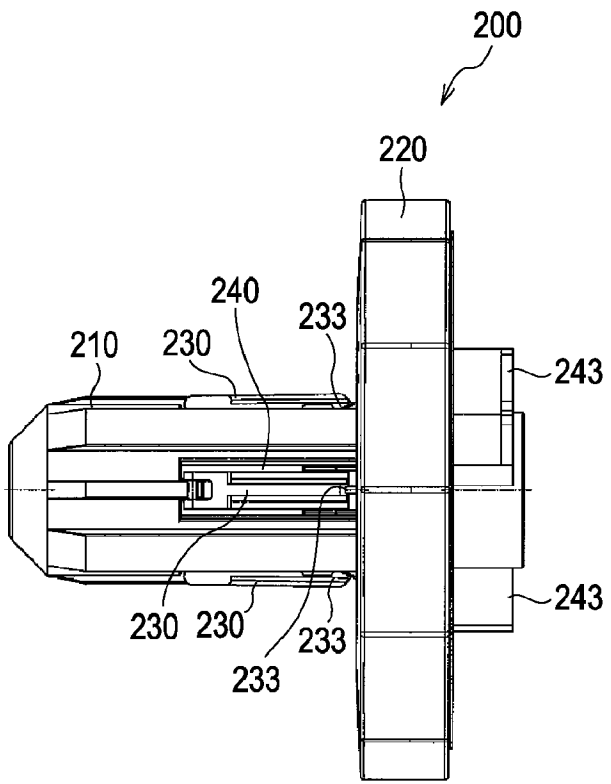
FIGS. 6(A) and 6(B) are second diagrams showing the sectional and side views for explaining the method of operating the rolled medium supporting mechanism shown in FIG. 1.
Figure 6:
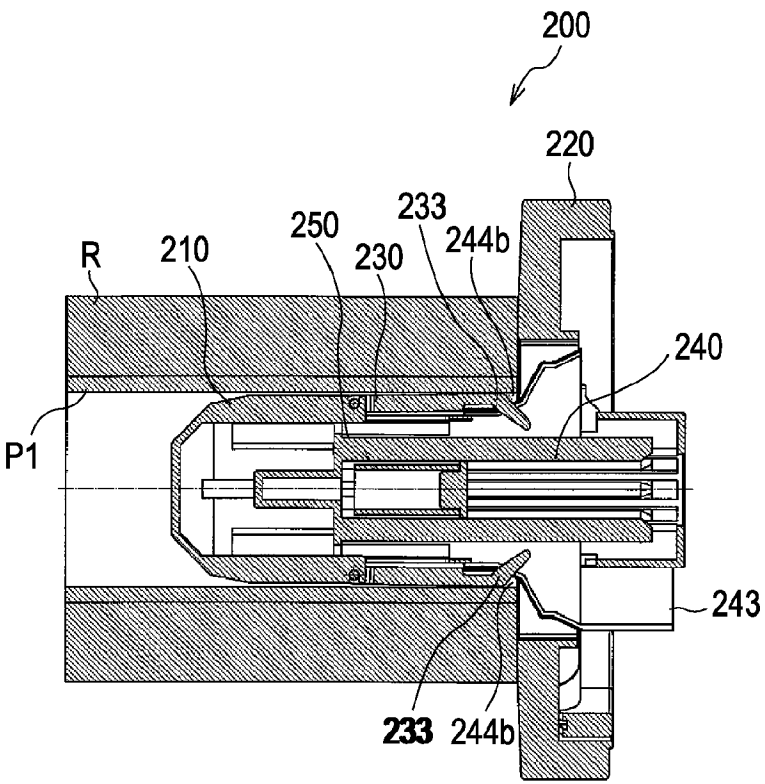
Figure 7:
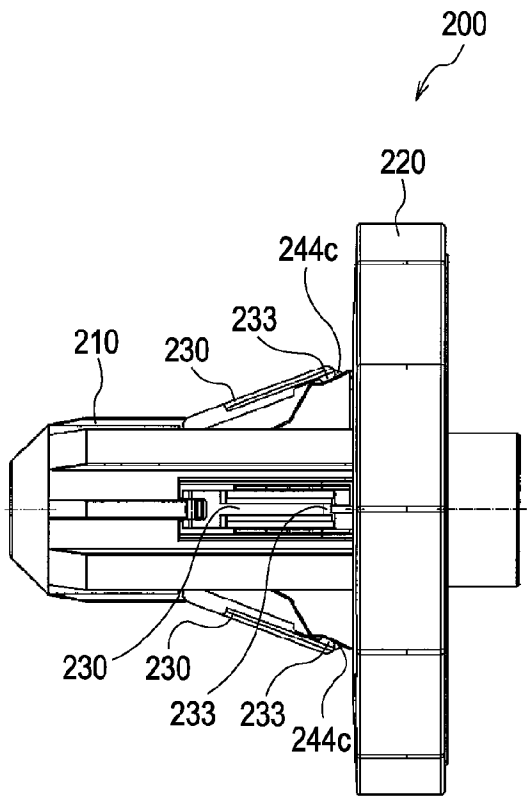
FIGS. 7(A) and 7(B) are third diagrams showing the sectional and side views for explaining the method of operating the rolled medium supporting mechanism shown in FIG. 1.
Figure 7:
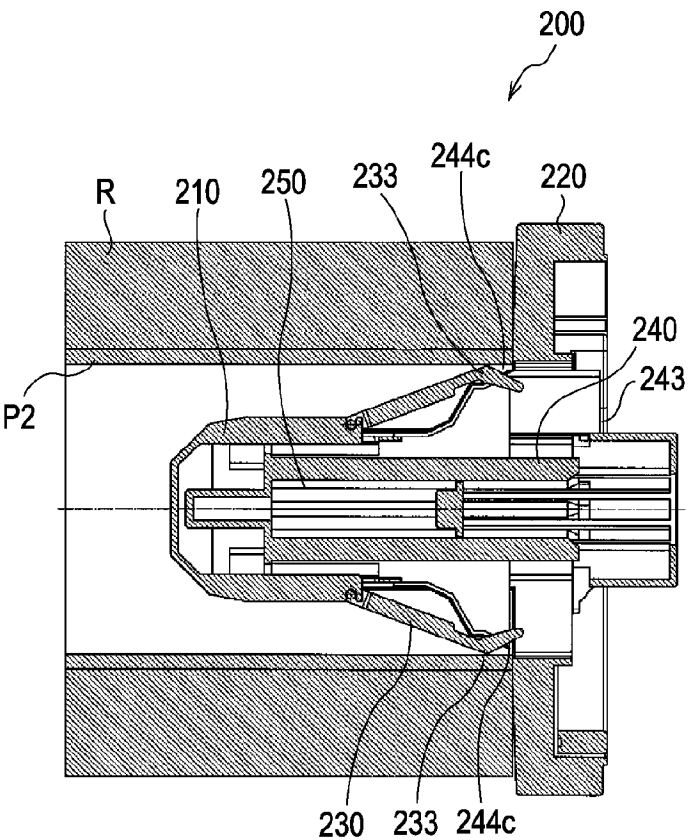

FIGS. 5 to 7 are diagrams showing the sectional and side views for explaining the method of operating the rolled medium supporting mechanism 200. As shown in FIG. 5, in a non-operating state, the set lever member 270 is moved upward at about 90 degrees with respect to the end face of the flange member 220. Since the arm portions 243 are pressed against the cam portions 271 of the set lever member 270, the wedge-shaped member 240 compresses the spring member 250 and moves toward the flange member 220. The bent portions 233 of the rib member 230 are therefore placed in the release areas 244*a* of the top slope faces 244 of the wedge portions 242. The ribs of the rib member 230 are in a state in which they are parallel to the axis of the boss member 210. The upper face of each rib of the rib member 230 is placed on the same face as the circumferential face of the boss member 210 when the ribs of the rib member 230 are exposed from the window portions 211. In this case, since the diameter of the boss member 210 including the ribs of the rib member 230 is slightly smaller than that of a 2-inch paper tube, the mechanism 200 can be inserted into a 2- or 3-inch paper tube in a simple manner.

As shown in FIG. 6, when the rolled medium supporting mechanism 200 is fitted to a 2-inch paper tube P1, the boss member 210 in the state shown in FIG. 5 is inserted into the paper tube P1 from its end portion. The flange member 220 is brought into abutting contact with the end faces of the paper tube P1 and the roll paper R so that the set lever member 270 is laid down to the end face of the flange member 220. Accordingly, the pressing of the cam portions 271 of the set lever member 270 against the arm portions 243 of the wedge-shaped member 240 is released. The wedge-shaped member 240 is pressed by the restoring force of the spring member 250 and is moved toward the boss member 210. Then, the bent portions 233 of the rib member 230 are slid upward along the top slope faces 244 while being guided by the guide slits 245 of the wedge portions 242. At this moment, the ribs of the rib member 230 are likely to be unfolded to the axis of the boss member 210. However, the unfolding can be prevented by the bent portions 233 of the rib member 230 making abutting contact with the inner peripheral face of the paper tube P1 before the bent portions 233 are slid further until reaching the 2-inch-diameter areas 244*b*.

The inner peripheral face of the paper tube P1 is therefore supported by the bent portions 233 of the rib member 230 by the compression force of the spring member 250. Accordingly, the rolled medium supporting mechanism 200 can support the roll paper R having the 2-inch paper tube P1. In this case, even when the diameter of the 2-inch paper tube P1 is irregular, the irregularity is absorbed by the spring member 250, and it is thus possible to support the roll paper R. When the set lever member 270 is laid down toward the end face of the flange member 220 until becoming parallel with the end face, the arm portions 243 of the wedge-shaped member 240 are locked by the member 270 by being brought into abutting contact with flat faces of the cam portions 271 of the member 270. Portions of the boss member 210 excluding the window portions 211 are integrally formed with the flange member 220. In particular, since the front end of the boss member 210 is formed in a closed pouch-like shape, it is possible to maintain a high degree of strength. Accordingly, it is possible to support a heavy roll paper R in a satisfactory manner.

As shown in FIG. 7, when the rolled medium supporting mechanism 200 is fitted to a 3-inch paper tube P2, the boss member 210 in the state shown in FIG. 5 is inserted into the paper tube P2 from its end portion. The flange member 220 is brought into abutting contact with the end faces of the paper tube P2 and the roll paper R so that the set lever member 270 is laid down to the end face of the flange member 220. Accordingly, the pressing of the cam portions 271 of the set lever member 270 against the arm portions 243 of the wedge-shaped member 240 is released. The wedge-shaped member 240 is pressed by the restoring force of the spring member 250 and is moved toward the boss member 210. Then, the bent portions 233 of the rib member 230 are slid upward along the top slope faces 244 while being guided by the guide slits 245 of the wedge portions 242. At this moment, the ribs of the rib member 230 are likely to be unfolded to the axis of the boss member 210. However, the unfolding can be prevented by the bent portions 233 of the rib member 230 making abutting contact with the inner peripheral face of the paper tube P2 before the bent portions 233 are slid further until the 3-inch-diameter areas 244*c*.

The inner peripheral face of the paper tube P2 is therefore supported by the bent portions 233 of the rib member 230 by the compression force of the spring member 250. Accordingly, the rolled medium supporting mechanism 200 can support the roll paper R having the 3-inch paper tube P2. In this case, even when the diameter of the 3-inch paper tube P2 is irregular, the irregularity is absorbed by the spring member 250, and it is thus possible to support the roll paper R. When the set lever member 270 is laid down toward the end face of the flange member 220 until becoming parallel with the end face, the arm portions 243 of the wedge-shaped member 240 are locked by the member 270 by being brought into abutting contact with flat faces of the cam portions 271 of the member 270. Portions of the boss member 210 excluding the window portions 211 are integrally formed with the flange member 220. Since the front end of the boss member 210 is formed in a closed pouch-like shape, it is possible to maintain a high degree of strength. Accordingly, it is possible to support a heavy roll paper R in a satisfactory manner.

When the rolled medium supporting mechanism 200 is detached from the 2- or 3-inch paper tube, the set lever member 270 is moved upward with respect to the end face of the flange member 220 so as to unlock the member 270, and the member 270 is further moved upward until oriented at about 90 degrees. Accordingly, the arm portions 243 of the wedge-shaped member 240 are pressed by the cam portions 271 of the set lever member 270. The wedge-shaped member 240 compresses the spring member 250 and moves toward the flange member 220. Then, the bent portions 233 of the rib member 230 are slid downward to the release areas 244*a* along the top slope faces 244 while being guided by the guide slits 245 of the wedge portions 242. The ribs of the rib member 230 become parallel to the axis of the boss member 210. At this moment, the upper face of each rib of the rib member 230 is placed on the same face as the circumferential face of the boss member 210 when the ribs of the rib member 230 are exposed from the window portions 211. In this case, since the diameter of the boss member 210 including the ribs of the rib member 230 is slightly smaller than that of a 2-inch paper tube, the mechanism 200 can be pulled out from a 2- or 3-inch paper tube in a simple manner.

The paired flange member 220 can determine the position of the 2- or 3-inch paper tube P1 or P2 by making abutting contact with both end faces of the paper tube P1 or P2. Moreover, the flange member 220 can prevent the oblique transportation of the roll paper R by guiding both edges of the roll paper R when it is unrolled from the 2- or 3-inch paper tube P1 or P2. Since the ribs of the rib member 230 are brought into abutting contact with the inner peripheral faces on the end portions of the 2- or 3-inch paper tube P1 or P2, both ends of the 2- or 3-inch paper tube P1 or P2 are held by the ribs of the rib member 230. Accordingly, it is possible to eliminate necessity of a conventional lengthy shaft and thus to improve the setting properties. In the above-described embodiment, the rib member 230 is partitioned into four ribs so that the paper tube is supported by the four ribs. However, the invention is not limited to this. The invention may be configured in such a manner that the rib member 230 is partitioned into an arbitrary (plural) number of ribs so that the paper tube is supported by the arbitrary number of ribs.

As described above, according to the rolled medium supporting mechanism 200 of the present embodiment, the boss member 210 is provided with the rib member 230 configured to be freely displaced in a diameter direction in accordance with the diameter of the paper tube. Accordingly, it is not necessary to have a separate component in order to adapt to paper tubes having different diameters, but only displacement of the rib member 230 is needed. Thus, it is possible to simplify the construction and provide easy handling properties. In addition, the rib member 230 is displaced by the advancing and retracting operation of the wedge-shaped member 240 provided in the boss member 210. Accordingly, it is possible to simplify the displacement mechanism. In addition, the wedge-shaped member 240 advances and retracts in cooperation with the pushing-in and drawing-out operation of the set lever member 270 provided in the flange member 220 that is integrally formed with the boss member 210 so as to make abutting contact with the end face of the roll paper. Accordingly, the user can displace the rib member 230 in a simple manner. In addition, the flange member 220 has a polygon-shaped circumference. Accordingly, it is possible to place the roll paper on a horizontal plane in a stable state when the roll paper is fitted to the rolled medium supporting mechanism 200.

Figure 8:
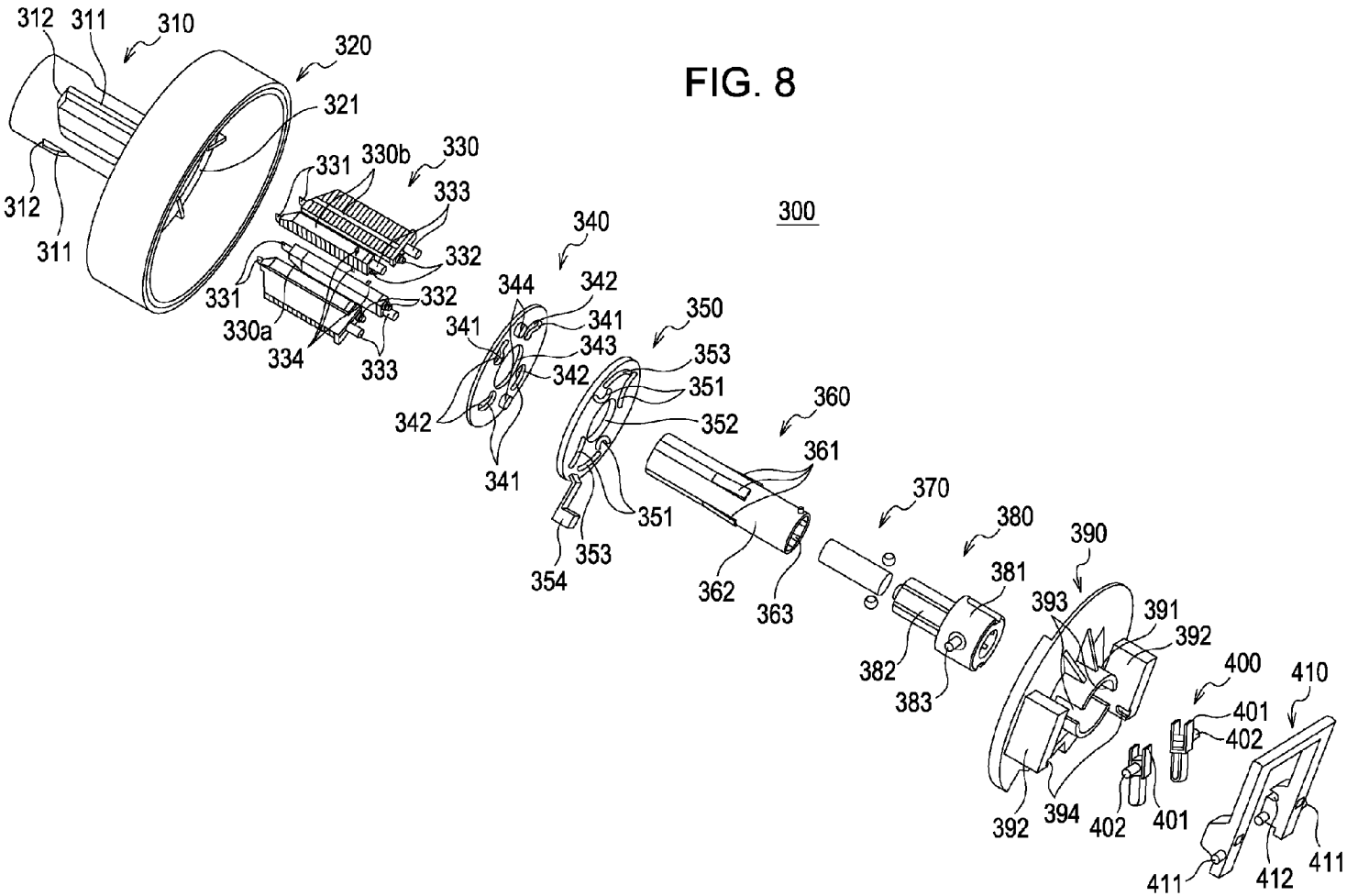
FIG. 8 is an exploded perspective view of a rolled medium supporting mechanism according to a second embodiment of the invention.
Figure 9:
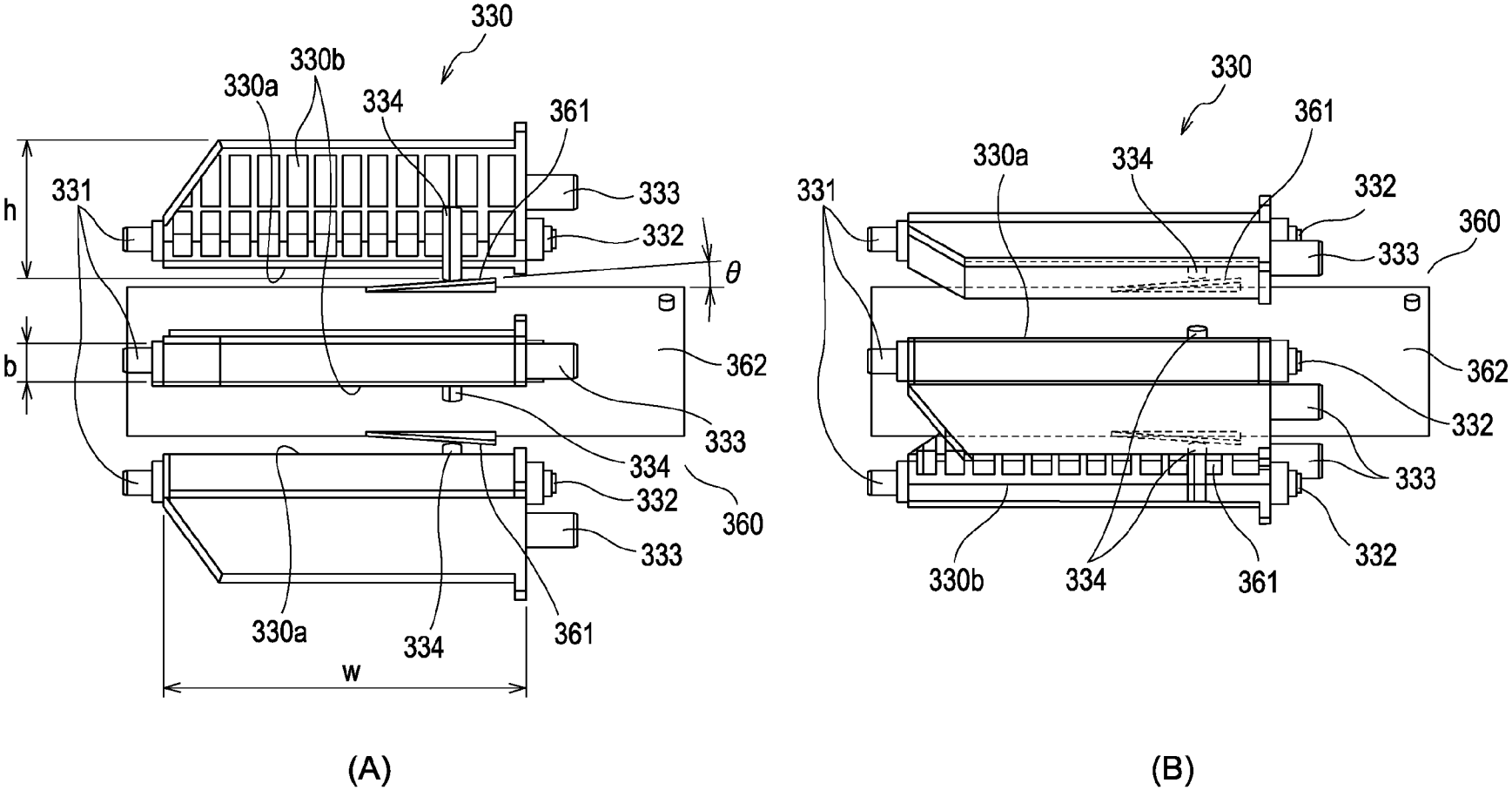
FIGS. 9(A) and 9(B) are top views of the rolled medium supporting mechanism shown in FIG. 8, showing a main part of the mechanism.
Figure 10:
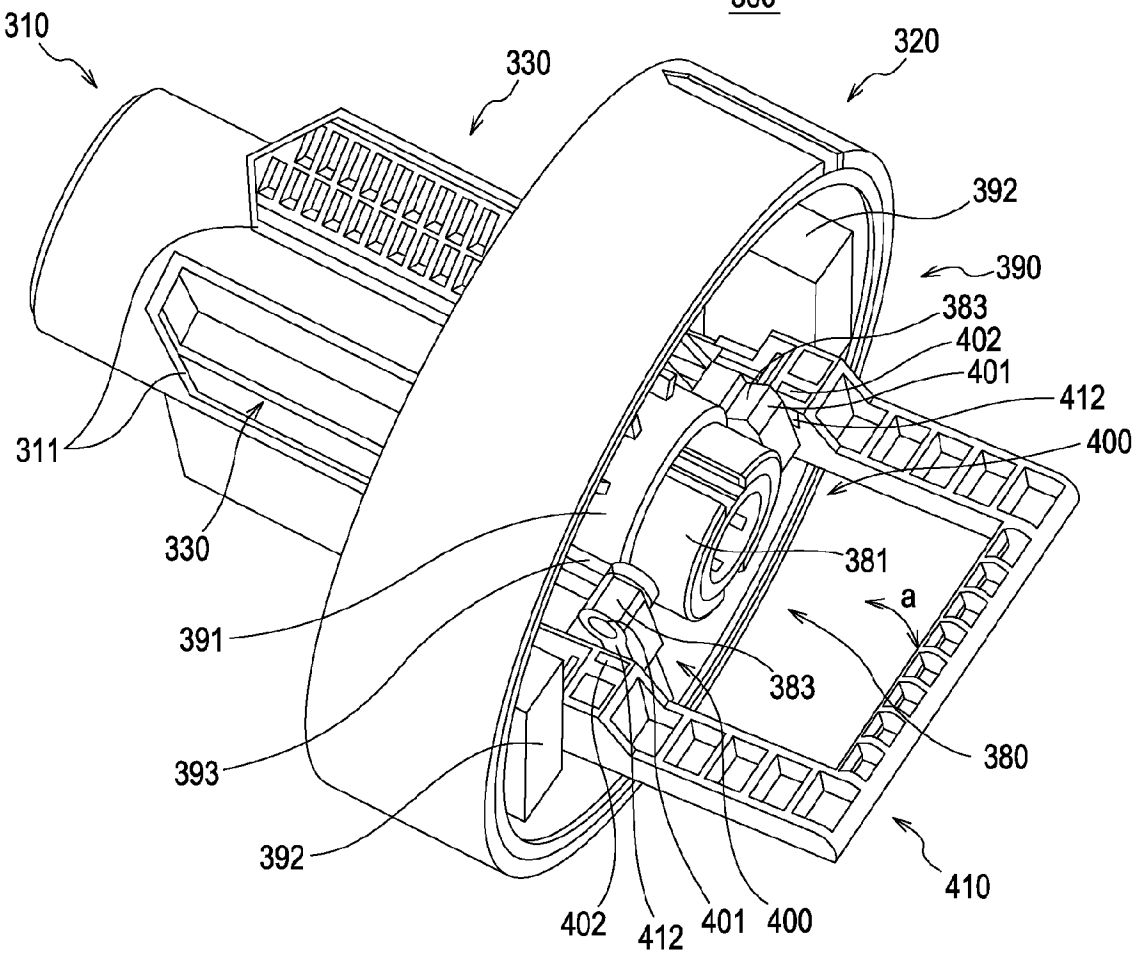
FIG. 10 is a perspective view of the assembled state of the rolled medium supporting mechanism shown in FIG. 8.

In the drawings, FIG. 8 is an exploded perspective view of a rolled medium supporting mechanism according to a second embodiment of the invention; FIGS. 9(A) and 9(B) are top views showing a main part of the mechanism; and FIG. 10 is a perspective view of the assembled state of the rolled medium supporting mechanism shown in FIG. 8. The rolled medium supporting mechanism 300 is also configured as a paired set having two identically shaped components. The mechanism 200 is configured to support a roll paper by being inserted into both ends of a hollow, 2- or 3-inch paper tube.

As shown in FIG. 8, the rolled medium supporting mechanism 300 is provided with a boss member (supporting member) 310 made of plastic materials, a flange member (abutting member) 320, a blade member (abutting supporting member or expandable abutting member) 330, a blade engagement member (opening/closing member) 340, a cam lever member (opening/closing member) 350, a wedge-shaped member (lock member) 360, a spring member (lock member) 370, a slide member (lock member) 380, a cover member 390, a cam member (set lever member) 400, and a set lever member 410.

The boss member 310 is formed in a substantially hollow cylindrical shape having a diameter slightly smaller than that of a 2-inch paper tube. The boss member 210 supports an inner peripheral face of the paper tube by being inserted into the paper tube from its end portion. On the circumferential face of the boss member 310, four rectangular-shaped window portions 311 are provided at regular angles (90 degrees) so that four blades of the blade member 330 are arranged at regular angles (90 degrees). In edge portions on the left side (in the drawing) of the window portions 311, pin holes 312 are formed in the axial direction of the boss member 310 so that support pins 331 on the left side (in the drawing) of the blade member 330 are axially supported by the pin holes 312. The flange member 320 is formed integrally and concentrically with the boss member 310 in a substantially circular dish-like shape. A central hole 321 connected to the boss member 310 is formed in the center of the dish-like shape. The end face on the boss member 310 side of the flange member 320 makes abutting contact with end faces of the paper tube and the roll paper.

The blade member 330 is formed in a substantially rectangular parallelepiped shape. The support pins 331 are formed to protrude out from the left ends (in the drawing) of the member 330, and the pins 331 are inserted into the pin holes 312 of the boss member 310. In addition, support pins 332 and guide pins (cam mechanism) 333 are formed to protrude out from the right ends (in the drawing) of the member 330. The support pins 332 are inserted into pin holes 341 of the blade engagement member 340, and the guide pins 333 are inserted into guide holes (cam mechanism) 342 of the blade engagement member 340 and in guide holes (cam mechanism) 351 of the cam lever member 350. In addition, substantially L-shaped protruding portions (protrusion) 334 making abutting contact with wedge portions (wedge) 361 of the wedge-shaped member 360 are protrudingly formed to extend from side faces 330*a* to side faces 330*b*. Both ends of each four blades of the blade member 330 are axially supported by the pin holes 312 of the boss member 310 and the pin holes 341 of the blade engagement member 340. The blades of the blade member 330 are arranged to be freely expandable within the window portions 311 of the boss member 310 when the guide pins 333 are guided by the guide holes 342 of the blade engagement member 340 and the guide holes 351 of the cam lever member 350.

The blade engagement member 340 is formed in a circular plate-like shape. A central hole 343 is bored in the center of the member 340 so that the wedge-shaped member 360 is inserted into the hole 343. Around the central hole 343, four pin holes 341 are bored at regular angles (90 degrees) so that the support pins 332 of the blade member 330 having four blades are inserted into the holes 341. In addition, four bead-shaped guide holes 342 are bored to surround the pin holes 341 so that the guide pins 333 of the blade member 330 having four blades are inserted into the holes 342. In addition, two guide pins 344 are formed at regular angles (180 degrees) to protrude from the vicinity of the peripheral edge so that the pins 344 are inserted into two guide holes 353 of the cam lever member 350.

The cam lever member 350 is formed in a circular plate-like shape. A central hole 352 is bored in the center of the member 350 so that the wedge-shaped member 360 is inserted into the hole 352. Around the central hole 352, four bead-shaped guide holes 351 are bored so that the guide pins 333 of the blade member 330 having four blades are inserted into the holes 351. In addition, two bead-shaped guide holes 353 are bored at regular angles (180 degrees) in the vicinity of the peripheral edge so that the two guide pins 344 of the blade engagement member 340 are inserted into the holes 353. In addition, a cam lever 354 having an L shape as seen from the side thereof is formed to protrude from a portion of the periphery to extend outward in the diameter direction.

The wedge-shaped member 360 is provided with a main body portion 362 having a substantially cylindrical shape; and wedge portions 361 having a substantially tapered shape and integrally formed at regular angles (90 degrees) on approximately central portions of the circumferential face of the main body portion 362 so as to extend in an axial direction. The wedge-shaped member 360 is disposed inside the boss member 310 by being inserted into the member 310 from the right end face (in the drawing) of the flange member 320. The wedge portions 361 of the wedge-shaped member 360 are formed in such a shape that the height of each portion 361 becomes greater as it goes from the left side to the right side (in the drawing) of the main body portion 362. The wedge portions 361 make abutting contact with the protruding portions 334 of the blade member 330. The protruding portions 334 of the blade member 330 are formed in a substantially L shape and extend from the side faces 330*a* to the side faces 330*b*. The protruding portions 334 can make abutting contact with the wedge portions 361 of the wedge-shaped member 360 before and after the expansion of the blade member 330.

The blade member 330 and the wedge-shaped member 360 will be described more in detail. As shown in FIGS. 9(A) and 9(B), a slope angle θ of a slope face 361*a* of each of the wedge portions 361 of the wedge-shaped member 360 is set as small as the construction of the rolled medium supporting mechanism 300 allows. Meanwhile, the length w and the thickness b of the blade member 330 and the height h from the protruding portions 334 are set as large as the construction of the rolled medium supporting mechanism 300 allows.

In this way, since the slope angle θ of the slope face 361*a* of each of the wedge portions 361 of the wedge-shaped member 360 is set small, the abutting force increases when the wedge portions 361 of the wedge-shaped member 360 is moved to make abutting contact with the protruding portions 334 of the blade member 330. In addition, since the length w and the thickness b of the blade member 330 are large, the area of the blade member 330 making abutting contact with the inner peripheral face of the paper tube of the roll paper increases and thus increasing the shear force therebetween. Accordingly, it is possible to prevent the roll paper from dropping out from the rolled medium supporting mechanism 300. In addition, the length w and the thickness b of the blade member 330 and the height h from the protruding portions 334 are large, the rigidity of the blade member 330 increases and thus decreasing the component tolerance. Accordingly, it is possible to improve the decentering precision of the blade member 330 with respect to the paper tube of the roll paper.

The spring member 370 is a compression coil spring, and is disposed inside the boss member 310 by being inserted into the member 310 from the right end face (in the drawing) of the flange member 320. The slide member 380 is provided with a main body portion 381 having a substantially cylindrical shape and open to the left side in the drawing, and a guide bar 382 having a substantially rod-like shape and integrally formed with the main body portion 381 so as to extend in an axial direction from an inner end face on the right side (in the drawing) of the main body portion 381 while passing through an open end face thereof on the left side in the drawing. The slide member 380 is disposed inside the main body portion 361 of the wedge-shaped member 360 by being inserted into the portion 361 from the right side thereof in the drawing along a guide groove 363 formed therein. In the outer peripheral face of the main body portion 381, two guide pins 383 are formed at regular angles (180 degrees) to protrude in the diameter direction so that the pins 383 are inserted into pin groove holes 401 of the cam member 400.

The cover member 390 is formed in a circular plate-like shape. A guide wall 391 having a substantially cylindrical shape is erected in the central portion of the member 390 so that the slide member 380 is guided by being inserted into the guide wall 391. On both sides of the guide wall 391, two attachment walls 392 having a substantially rectangular parallelepiped shape are provided opposite to each other so that the set lever member 410 is attached to the walls 392. In the guide wall 391, two guide grooves 393 are formed opposite each other so as to guide the guide pins 383 of the slide member 380 in the axial direction. In the attachment walls 392, two shaft holes 394 are bored opposite to each other so that two swing shafts 411 of the set lever member 410 are inserted into the holes 394.

The cam member 400 is formed in a rod-like shape. In one end of the member 400, a pin groove hole 401 is provided so that the guide pin 383 of the slide member 380 is fitted to the hole 401. In an approximately central portion of the side face thereof, a pin 402 is formed to protrude out so that the pin 402 is fitted to a pin groove hole 412 of the set lever member 410. Two cam members 400 are provided between the slide member 380 and the set lever member 410. The set lever member 410 is formed in an inverted U-shape.

On outer faces of both distal ends of the inverted U-shape, the swing shafts 411 are integrally formed so that the shafts 411 are fitted to the shaft holes 394 of the cover member 390. On inner faces of both distal ends of the inverted U-shape, pin groove holes 412 are bored opposite to each other so that the pins 402 of the two cam members 400 are fitted to the holes 412.

When the members having such a configuration are assembled, the blades of the blade member 330 are first inserted into the boss member 310 through the central hole 321 of the flange member 320. The support pins 331 of the blades of the blade member 330 are pushed into the pin holes 312 of the boss member 310. The pin holes 341 of the blade engagement member 340 are fitted to the support pins 332 of the blades of the blade member 330, wherein the support pins 332 are protruded from the central hole 321 of the flange member 320. The guide holes 342 of the blade engagement member 340 are fitted to the guide pins 333 of the blades of the blade member 330, wherein the guide pins 333 are protruded from the central hole 321 of the flange member 320. Next, the guide holes 351 of the cam lever member 350 are fitted to the guide pins 333 of the blades of the blade member 330, wherein the guide pins 333 are protruded from the guide holes 342 of the blade engagement member 340. The guide holes 353 of the cam lever member 350 are fitted to the guide pins 344 of the blade engagement member 340.

Subsequently, the spring member 370 and the wedge-shaped member 360 are inserted into the boss member 310 while passing through the central hole 352 of the cam lever member 350, the central hole 343 of the blade engagement member 340, and the central hole 321 of the flange member 320. Next, the cover member 390 is fitted to the flange member 320, and the guide bar 382 of the slide member 380 is inserted into the guide wall 391 of the cover member 390. Then, the guide pins 383 of the slide member 380 are fitted to the guide groove 393 of the guide wall 381, and the guide bar 382 of the slide member 380 is inserted inside the wedge-shaped member 360 along the guide groove 363. Next, the pin groove holes 401 of two cam members 400 are fitted to the guide pins 383 of the slide member 380. Meanwhile, the swing shafts 411 of the set lever member 410 are fitted to the shaft holes 394 of the cover member 390. The pin groove holes 412 of the set lever member 410 are fitted to the pins 402 of the two cam members 400. In this manner, an assembled final product shown in FIG. 10 is obtained.

Figure 11:
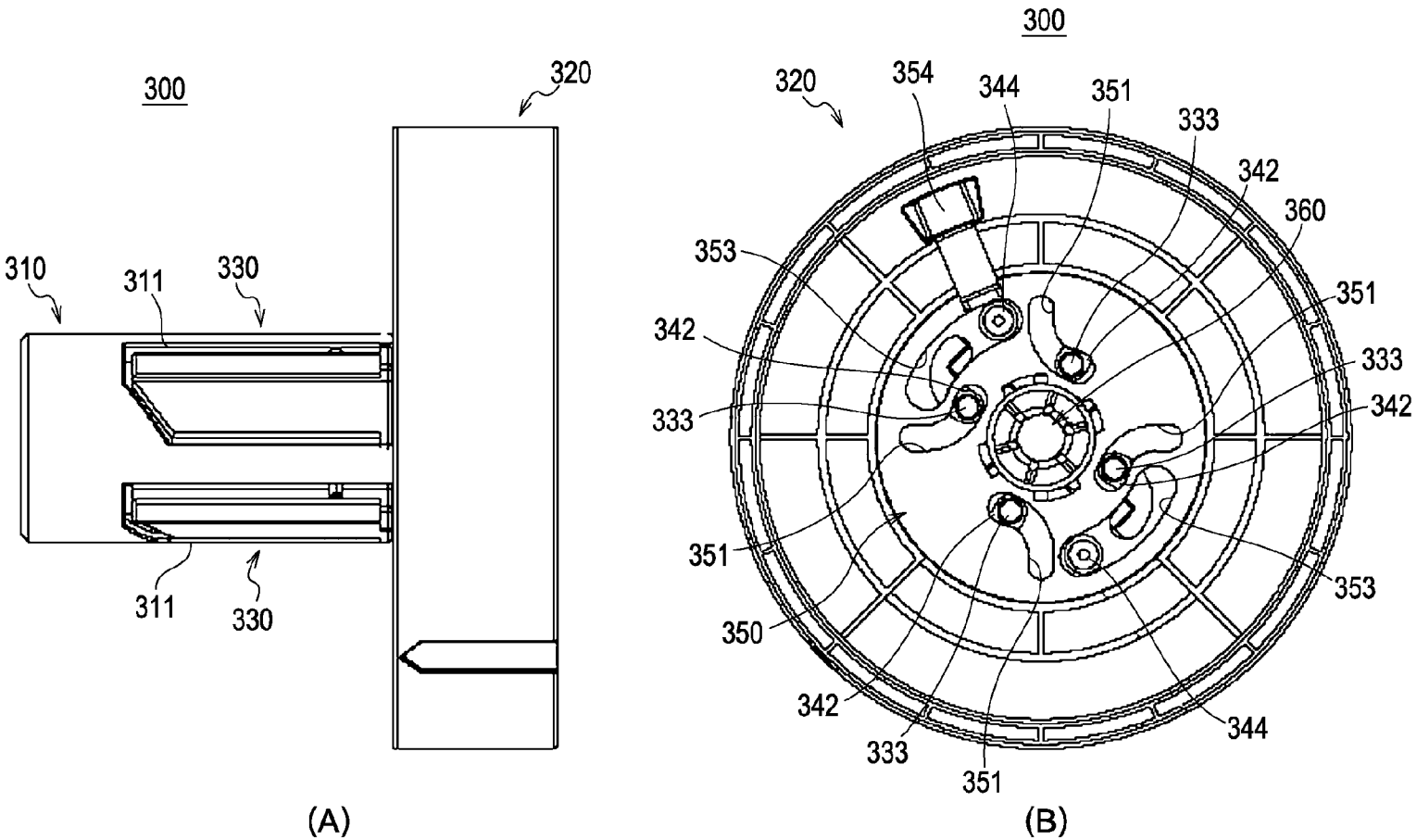
FIGS. 11(A) and 11(B) are first diagrams showing the top and side views for explaining the operation of a cam lever member of the rolled medium supporting mechanism shown in FIG. 8.
Figure 12:
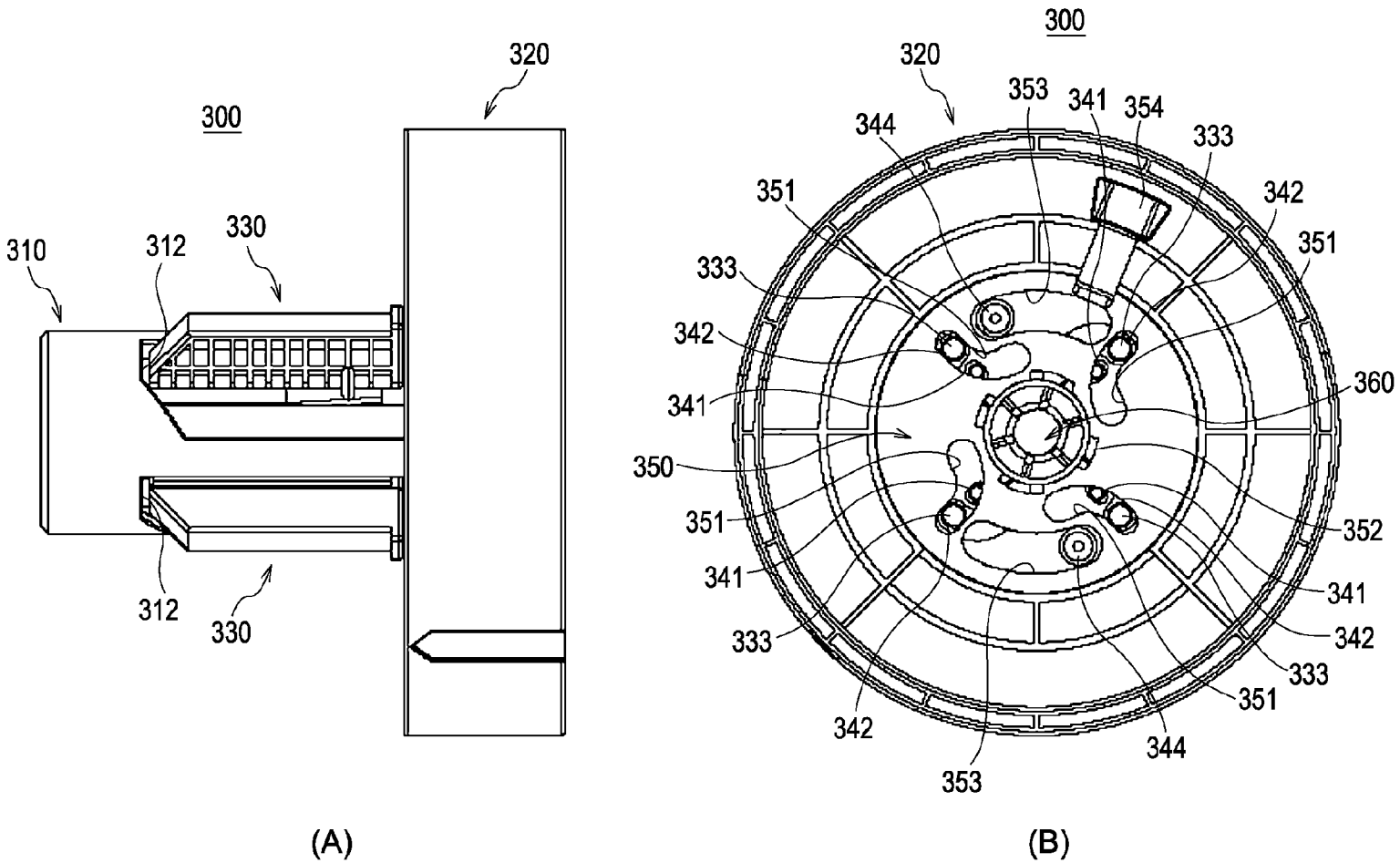
FIGS. 12(A) and 12(B) are second diagrams showing the top and side views for explaining the operation of the cam lever member of the rolled medium supporting mechanism shown in FIG. 8.

FIGS. 11(A) and 11(B) and FIGS. 12(A) and 12(B) are diagrams showing the top and side views for explaining the operation of the cam lever member 350. The guide holes 342 of the blade engagement member 340 and the guide holes 351 of the cam lever member 350 are formed in a bead shape extending from the inner peripheral side to the outer peripheral side, as shown in FIGS. 11(B) and 12(B). Moreover, the inner and outer peripheral ends of each of the holes 342 and 351 are positioned at the same positions. Therefore, the guide pins 333 of the blade member 330 are guided between a position (shown in FIG. 11(B)) corresponding to the inner peripheral ends of the guide holes 342 and a position (shown in FIG. 12(B)) corresponding to the outer peripheral ends of the guide holes 342. Therefore, the blades of the blade member 330 are moved by the left-to-right swing operation of the cam lever member 350 as shown in FIGS. 11(B) and 12(B) so that the blades are freely expandable between a state (shown in FIG. 11(A)) wherein the blades block substantially the whole window portions 311 of the boss member 310 and thus forming the outer peripheral face of the boss member 310; and a state (shown in FIG. 12(A)) wherein the blades are swung about a swing axis by a predetermined angle away from the boss member 310, the swing axis extending from the pin holes 312 of the boss member 310 and the pin holes 341 of the blade engagement member 340.

Figure 13:
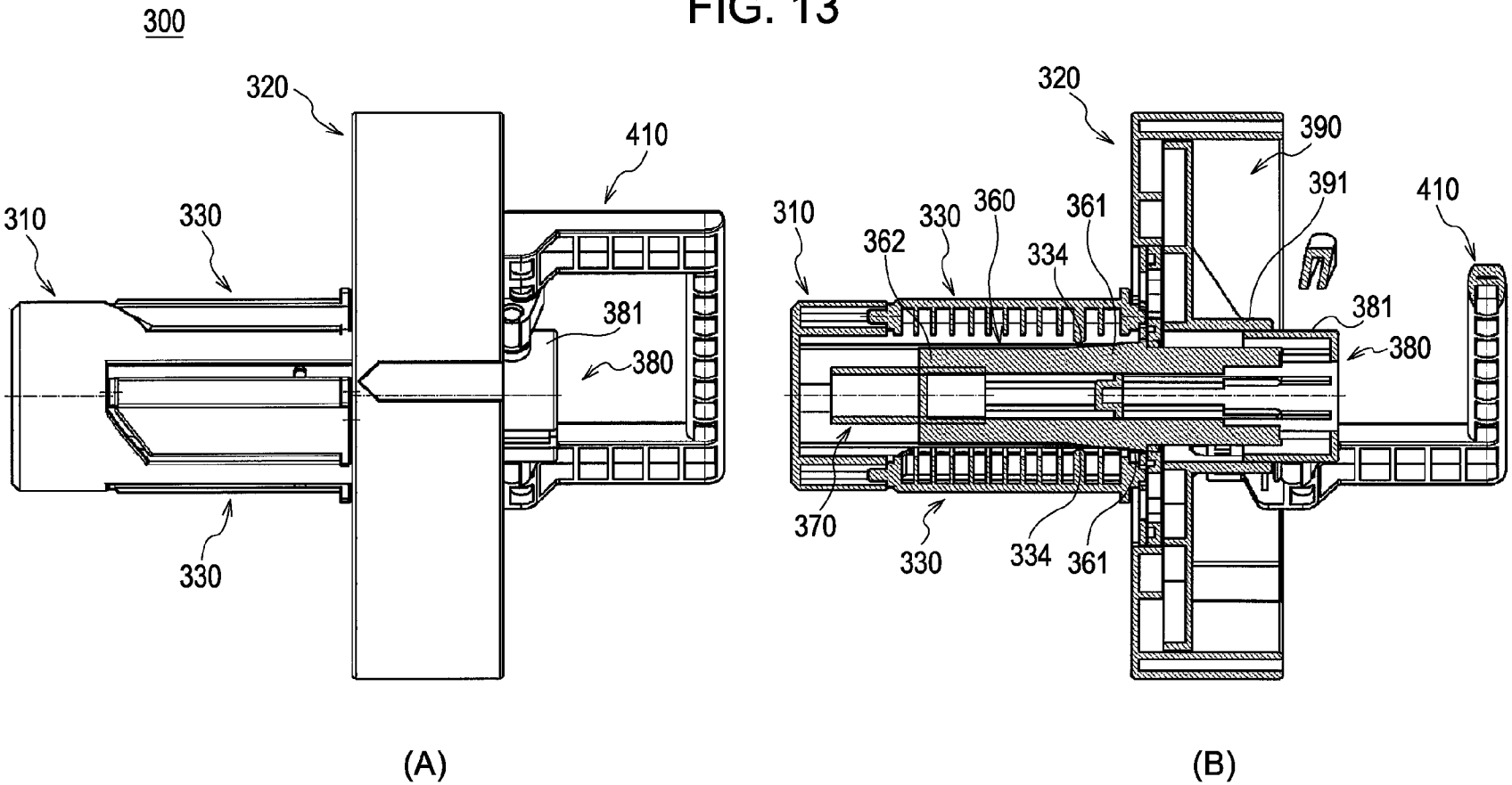
FIGS. 13(A) and 13(B) are first diagrams showing the top and side views for explaining the operation of a set lever member of the rolled medium supporting mechanism shown in FIG. 8.

FIGS. 13(A) and 13(B) and FIGS. 14(A) and 14(B) are diagrams showing the top and side views for explaining the operation of the set lever member 410. In this case, as shown in FIG. 10, the set lever member 410 can freely swing in the "a" direction in the drawing about the shaft holes 394 of the cover member 390 fitted to the flange member 320. For this reason, when the set lever member 410 is moved upward at 90 degrees with respect to the end face of the flange member 320 as shown in FIG. 13(A), the cam member 400 and the slide member 380 are pulled toward the set lever member 410 so that the cam member 400 protrudes away from the guide wall 391 of the cover member 390. At the same time, as shown in FIG. 13(B), the wedge-shaped member 360 is pressed against the spring member 370 so that the wedge-shaped member 360 and the slide member 380 are moved toward the flange member 320. Thus, the wedge portions 361 of the wedge-shaped member 360 are separated away from the protruding portions 334 of the blade member 330.

Figure 14:
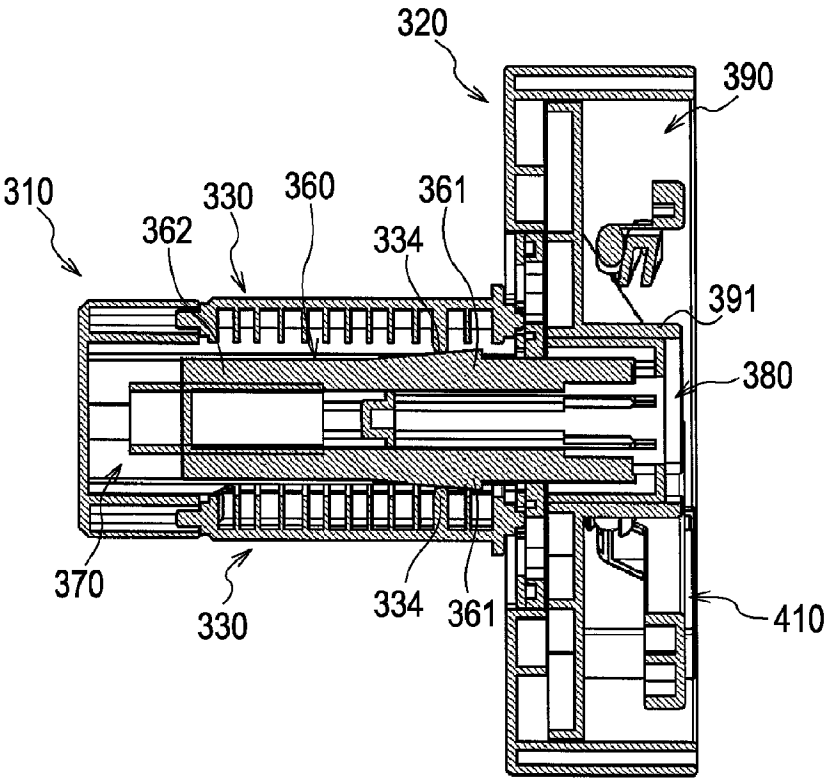
FIGS. 14(A) and 14(B) are second diagrams showing the top and side views for explaining the operation of the set lever member of the rolled medium supporting mechanism shown in FIG. 8.
Figure 14:
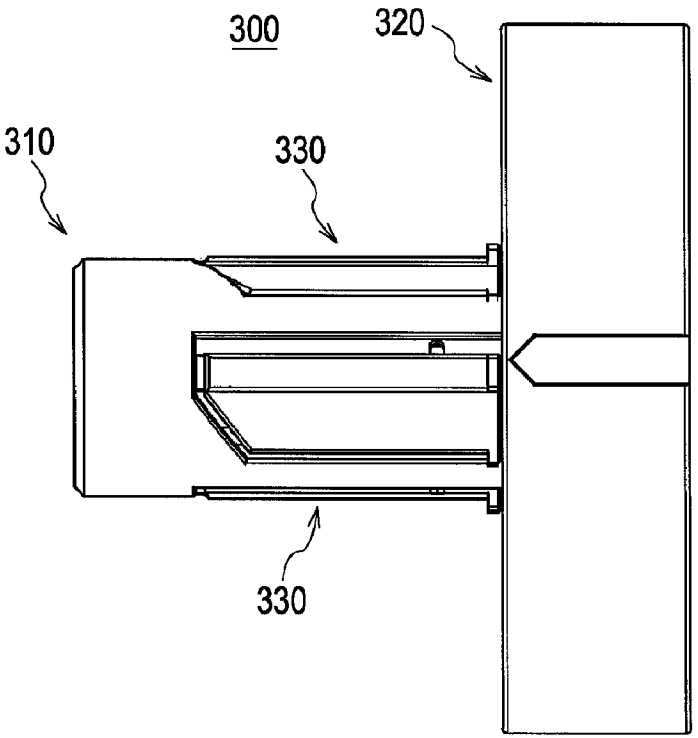

When the set lever member 410 is laid down in parallel with the end face of the flange member 320 as shown in FIG. 14(A), the cam member 400 and the slide member 380 are pressed against the set lever member 410, and the cam member 400 is pushed in the guide wall 391 of the cover member 390. At the same time, as shown in FIG. 14(B), the wedge-shaped member 360 is pressed against the slide member 380 by the restoring force of the spring member 370, and is moved toward the boss member 310. Thus, the wedge portions 361 of the wedge-shaped member 360 are expanded in the diameter direction while making abutting contact with the protruding portions 334 of the blade member 330. The abutting and separating movements of the wedge portions 361 of the wedge-shaped member 360 with respect to the protruding portions 334 of the blade member 330 are allowed regardless of the open or closed states of the blades of the blade member 330.

In this way, when the set lever member 410 is moved upward at about 90 degrees with respect to the end face of the flange member 320, the wedge portions 361 of the wedge-shaped member 360 are moved in the direction for separating the wedge portions 361 from the protruding portions 334 of the blade member 330. Therefore, the user can erect the set lever member 410 with a small operating force. Meanwhile, when the set lever member 410 is laid down in parallel to the end face of the flange member 320, the wedge portions 361 of the wedge-shaped member 360 are moved in the direction for making abutting contact with the protruding portions 334 of the blade member 330. Therefore, the user has to lay down the set lever member 410 with a strong force. For this reason, it is possible to dispose the blades of the blade member 330 in close contact with the inner peripheral face of the paper tube of the roll paper. In addition, since the set lever member 410 is slowly laid down with the force, it is possible to prevent such an accident that obstacles are heedlessly placed between the set lever member 410 and the flange member 320. The operating method of the mechanism having such a configuration will be described with reference to the drawings.

FIGS. 15(A) and 15(B) and FIGS. 16(A) and 16(B) are diagrams showing the side and sectional views for explaining a method of operating the rolled medium supporting mechanism 300. As shown in FIG. 13(A), in a non-operating state of the rolled medium supporting mechanism 300, the set lever member 410 is moved upward at about 90 degrees with respect to the end face of the flange member 320. The cam member 400 and the slide member 380 are pulled toward the set lever member 410 so that the cam member 400 protrudes away from the guide wall 391 of the cover member 390. Accordingly, as shown in FIG. 13(B), the wedge-shaped member 360 is pressed against the spring member 370 so that the wedge-shaped member 360 and the slide member 380 are moved toward the flange member 320. Thus, the wedge portions 361 of the wedge-shaped member 360 are separated away from the protruding portions 334 of the blade member 330. At this moment, since the blades of the blade member 330 can be freely expanded by the cam lever member 350, the mechanism 300 is adaptable to a 2- or 3-inch paper tube.

Figure 15:
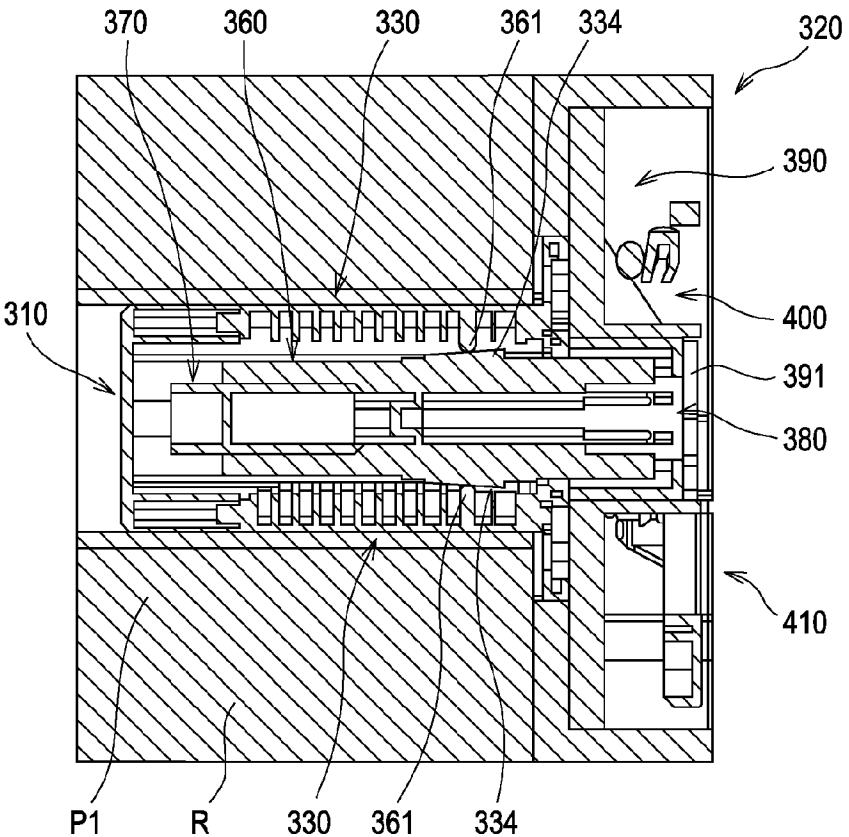
FIGS. 15(A) and 15(B) are first diagrams showing the side and sectional views for explaining a method of operating the rolled medium supporting mechanism shown in FIG. 8.
Figure 15:
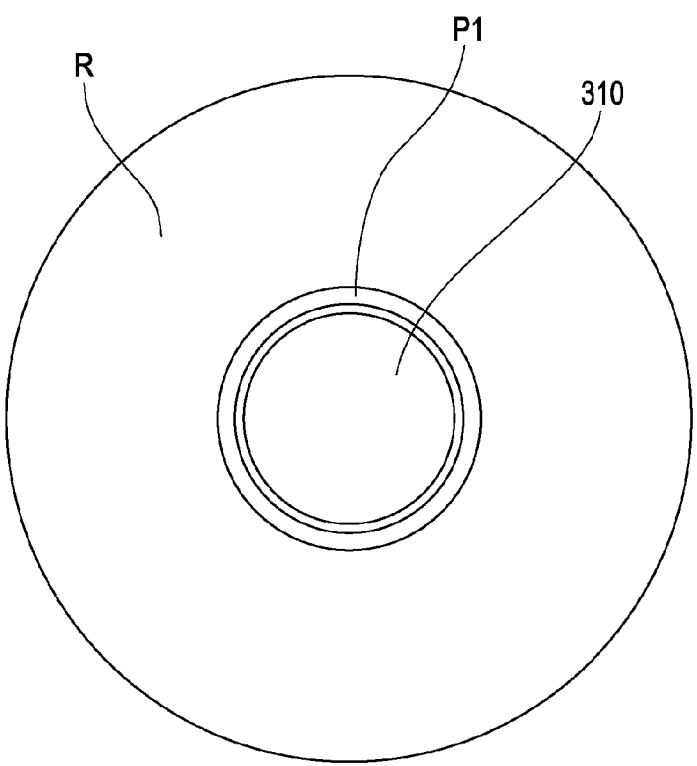

As shown in FIGS. 15(A) and 15(B), when the rolled medium supporting mechanism 300 is fitted to a 2-inch paper tube P1, the blade member 330 is put into a closed state by operating the cam lever 354 of the cam lever member 350, as shown in FIG. 11(B). The boss member 310 is inserted into the paper tube P1 from its end portion. The flange member 320 is brought into abutting contact with the end faces of the paper tube P1 and the roll paper R. In this case, the diameter of the boss member 310 including the blades of the blade member 330 is slightly larger than that of a 2-inch paper tube. However, since the blades of the blade member 330 are fitted to the boss member 310 with a sufficient margin, the boss member 310 can be smoothly inserted into the paper tube P1. The set lever member 410 is laid down in parallel to the end face of the flange member 320. Accordingly, the cam member 400 and the slide member 380 are pressed against the set lever member 410, and the cam member 400 is pushed in the guide wall 391 of the cover member 390.

At the same time, the wedge-shaped member 360 is pressed against the slide member 380 by the restoring force of the spring member 370, and is moved toward the boss member 310. Thus, the wedge portions 361 of the wedge-shaped member 360 make abutting contact with the protruding portions 334 of the blade member 330, thereby allowing the blade member 330 to expand in the diameter direction.

The inner peripheral face of the paper tube P1 is therefore supported by the side faces of the blades of the blade member 330 by the abutting force of the wedge portions 361 of the wedge-shaped member 360. Accordingly, the rolled medium supporting mechanism 300 can support the roll paper R having the 2-inch paper tube P1. In this case, even when the diameter of the 2-inch paper tube P1 is irregular, since the wedge portions 361 of the wedge-shaped member 360 have slope faces and the protruding portions 334 make contact with the slope faces at arbitrary positions, the irregularity is absorbed and it is thus possible to support the roll paper R. The set lever member 410 is then laid down toward the end face of the flange member 320 until locked at the parallel level. Portions of the boss member 310 excluding the window portions 311 are integrally formed with the flange member 320. In particular, since the front end of the boss member 310 is formed in a closed pouch-like shape, it is possible to maintain a high degree of strength. Accordingly, it is possible to support a heavy roll paper R in a satisfactory manner.

Figure 16:
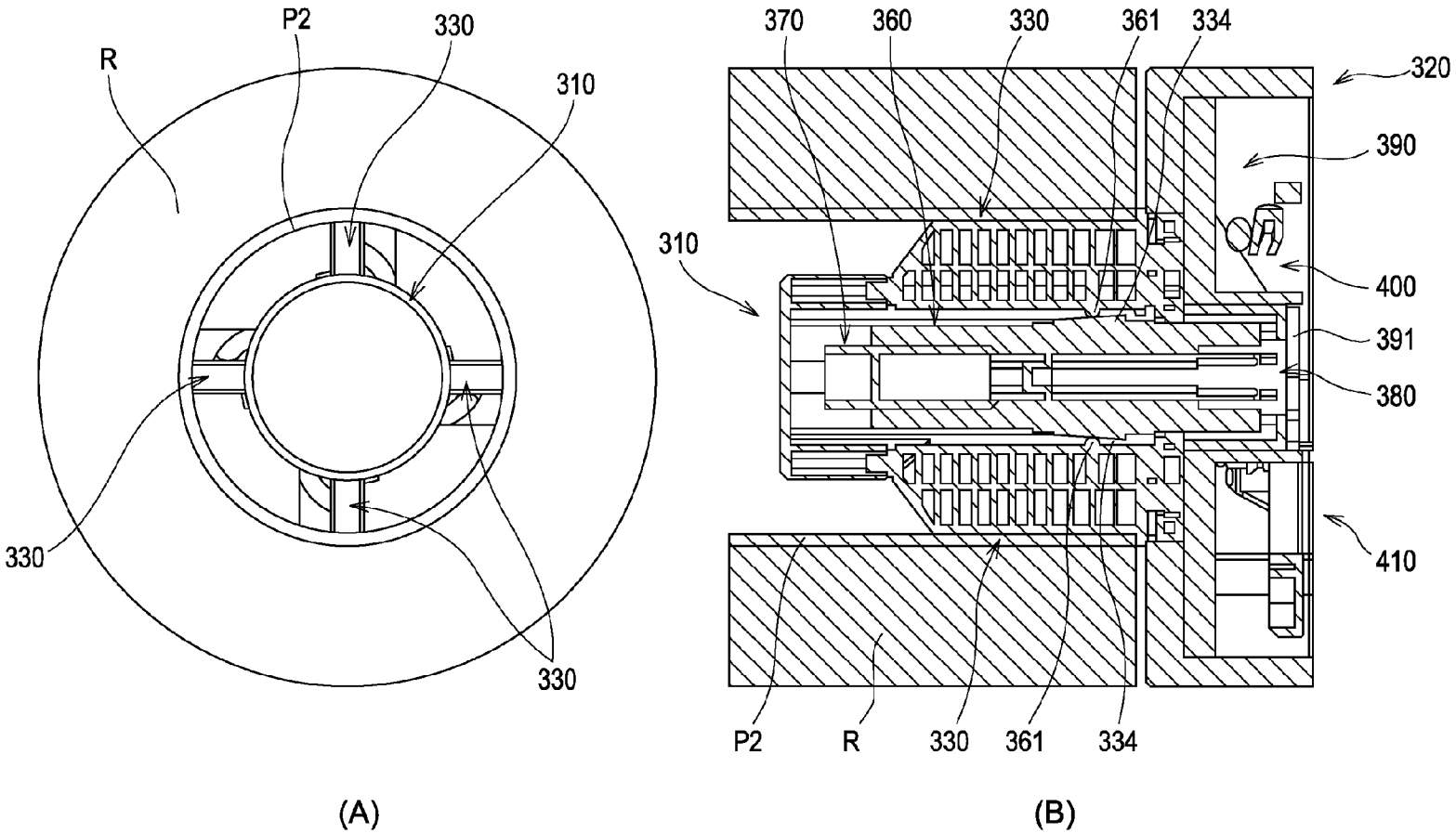
FIGS. 16(A) and 16(B) are second diagrams showing the side and sectional views for explaining the method of operating the rolled medium supporting mechanism shown in FIG. 8.

As shown in FIGS. 16(A) and 16(B), when the rolled medium supporting mechanism 300 is fitted to a 3-inch paper tube P2, the blade member 330 is put into an open state by operating the cam lever 354 of the cam lever member 350, as shown in FIG. 12(B). The boss member 310 is inserted into the paper tube P2 from its end portion. The flange member 320 is brought into abutting contact with the end faces of the paper tube P2 and the roll paper R. In this case, the diameter of the boss member 310 including the blades of the blade member 330 is slightly larger than that of a 3-inch paper tube. However, since the blades of the blade member 330 are fitted to the boss member 310 with a sufficient margin, the boss member 310 can be smoothly inserted into the paper tube P2. The set lever member 410 is laid down in parallel to the end face of the flange member 320. Accordingly, the cam member 400 and the slide member 380 are pressed against the set lever member 410, and the cam member 400 is pushed in the guide wall 391 of the cover member 390. At the same time, the wedge-shaped member 360 is pressed against the slide member 380 by the restoring force of the spring member 370, and is moved toward the boss member 310. Thus, the wedge portions 361 of the wedge-shaped member 360 make abutting contact with the protruding portions 334 of the blade member 330, thereby allowing the blade member 330 to expand in the diameter direction.

The inner peripheral face of the paper tube P2 is therefore supported by the side faces of the blades of the blade member 330 by the abutting force of the wedge portions 361 of the wedge-shaped member 360. Accordingly, the rolled medium supporting mechanism 300 can support the roll paper R having the 3-inch paper tube P2. In this case, even when the diameter of the 3-inch paper tube P2 is irregular, since the wedge portions 361 of the wedge-shaped member 360 have slope faces and the protruding portions 334 make contact with the slope faces at arbitrary positions, the irregularity is absorbed and it is thus possible to support the roll paper R. The set lever member 410 is then laid down toward the end face of the flange member 320 until locked at the parallel level. Portions of the boss member 310 excluding the window portions 311 are integrally formed with the flange member 320. In particular, since the front end of the boss member 310 is formed in a closed pouch-like shape, it is possible to maintain a high degree of strength. Accordingly, it is possible to support a heavy roll paper R in a satisfactory manner.

When the rolled medium supporting mechanism 300 is detached from the 2- or 3-inch paper tube, the set lever member 410 is moved upward with respect to the end face of the flange member 320 so as to unlock the member 410, and the member 410 is further moved upward until oriented at about 90 degrees. Accordingly, the cam member 400 and the slide member 380 are pulled toward the set lever member 410 so that the cam member 400 protrudes away from the guide wall 391 of the cover member 390. Therefore, the wedge-shaped member 360 is pressed against the spring member 370 so that the wedge-shaped member 360 and the slide member 380 are moved toward the flange member 320. The wedge portions 361 of the wedge-shaped member 360 are separated away from the protruding portions 334 of the blade member 330. In this case, since the blades of the blade member 330 are fitted to the boss member 310 with a sufficient margin, the rolled medium supporting mechanism can be pulled out from the 2- or 3-inch paper tube in a simple manner.

The paired flange member 320 can determine the position of the 2- or 3-inch paper tube P1 or P2 by making abutting contact with both end faces of the paper tube P1 or P2. Moreover, the flange member 320 can prevent the oblique transportation of the roll paper R by guiding both edges of the roll paper R when it is unrolled from the 2- or 3-inch paper tube P1 or P2. Since the blades of the blade member 330 are brought into abutting contact with the inner peripheral faces on the end portions of the 2- or 3-inch paper tube P1 or P2, both ends of the 2- or 3-inch paper tube P1 or P2 are held by the blades of the blade member 330. Accordingly, it is possible to eliminate necessity of a conventional lengthy shaft and thus to improve the setting properties.

In the above-described embodiment, the blade member 330 is partitioned into four blades so that the paper tube is supported by the four blades. However, the invention is not limited to this. The invention may be configured in such a manner that the blade member 330 is partitioned into an arbitrary (plural) number of blades so that the paper tube is supported by the arbitrary number of blades. By forming the guide holes 342 of the blade engagement member 340 and the guide holes 351 of the cam lever member 350 to have a plurality of end portions, it is possible to regulate the expansion of the blade member 330 in a stepwise manner and thus to adapt to paper tubes having different diameters.

As described above, according to the rolled medium supporting mechanism 300 of the present embodiment, the blade member 330 configured to be freely displaced in a diameter direction in accordance with the diameter of the paper tube. Accordingly, it is not necessary to have a separate component in order to adapt to paper tubes having different diameters, but only displacement of the blade member 330 is needed. Thus, it is possible to simplify the construction and provide easy handling properties. In addition, the blade member 330 is displaced by the advancing and retracting operation of the wedge-shaped member 360 provided in the boss member 310. Accordingly, it is possible to simplify the displacement mechanism. In addition, the wedge-shaped member 360 advances and retracts in cooperation with the pushing-in and drawing-out operation of the set lever member 410 provided in the flange member 320 that is integrally formed with the boss member 310 so as to make abutting contact with the end face of the roll paper. Accordingly, the user can displace the rib member 330 in a simple manner.

The wedge portions 361 formed in the wedge-shaped member 360 make abutting contact with the blade member 330 so that the blade member 330 is locked in a state in which the member 330 is brought into abutting contact with the inner peripheral face of the paper tube. Accordingly, it is possible to bring the blade member into abutting contact with the inner peripheral face of the paper tube in a secure manner. In addition, the blade member 330 is formed in a substantially rectangular parallelepiped shape and makes contact with a large area of the inner peripheral face of the paper tube, and the wedge portions 361 of the wedge-shaped member 360 making abutting contact with the blade member 330 have slope faces for which a slope angle becomes smaller. Accordingly, it is possible to increase the abutting force of the blade member 330 with respect to the inner peripheral face of the paper tube. Moreover, it is possible to prevent the boss member 310 from dropping out from the paper tube. In addition, the flange member 320 has a polygon-shaped circumference. Accordingly, it is possible to place the roll paper on a horizontal plane in a stable state when the roll paper is fitted to the rolled medium supporting mechanism 300.

The rolled medium supporting mechanism is provided with the blade member 330 having a plurality of blades and configured to be freely expandable about the support pins 331 and 332 axially supported by the boss member 310 and the blade engagement member 340 in accordance with the diameter of the paper tube. Accordingly, it is not necessary to have a separate component in order to adapt to core members having different diameters, but only displacement of the blade member 330 is needed. Thus, it is possible to simplify the construction and provide easy handling properties. In addition, the blade member 330 is expanded by the rotating operation of the cam lever member 350 provided in the boss member 310. Accordingly, it is possible to simplify the expansion mechanism.

The blade member 330 is expanded within a predetermined angle by means of the guide pins 333 provided in the blade member 330, the guide holes 342 provided in the blade engagement member 340, and the guide holes 351 provided in the cam lever member 350. Accordingly, it is possible to prevent the blades of the blade member 330 from interfering with each other. In addition, the blade member 330 is expanded in a stepwise manner by means of the guide pins 333 provided in the blade member 330, the guide holes 342 provided in the blade engagement member 340, and the guide holes 351 provided in the cam lever member 350. Accordingly, it is possible to support core members having different diameters in a suitable manner.

The wedge-shaped member 360 cooperating with the set lever member 410 provided in the boss member 310 locks the blade member 330 in a state in which the member 330 is brought into abutting contact with the inner peripheral face of the core member. That is, the blade member 330 is locked when the wedge portions 361 provided in the wedge-shaped member 360 make abutting contact with the protruding portions 334 provided in the blade member 330. Accordingly, it is possible to bring the blade member 330 into abutting contact with the inner peripheral face of the core member in a secure manner.

Figure 17:
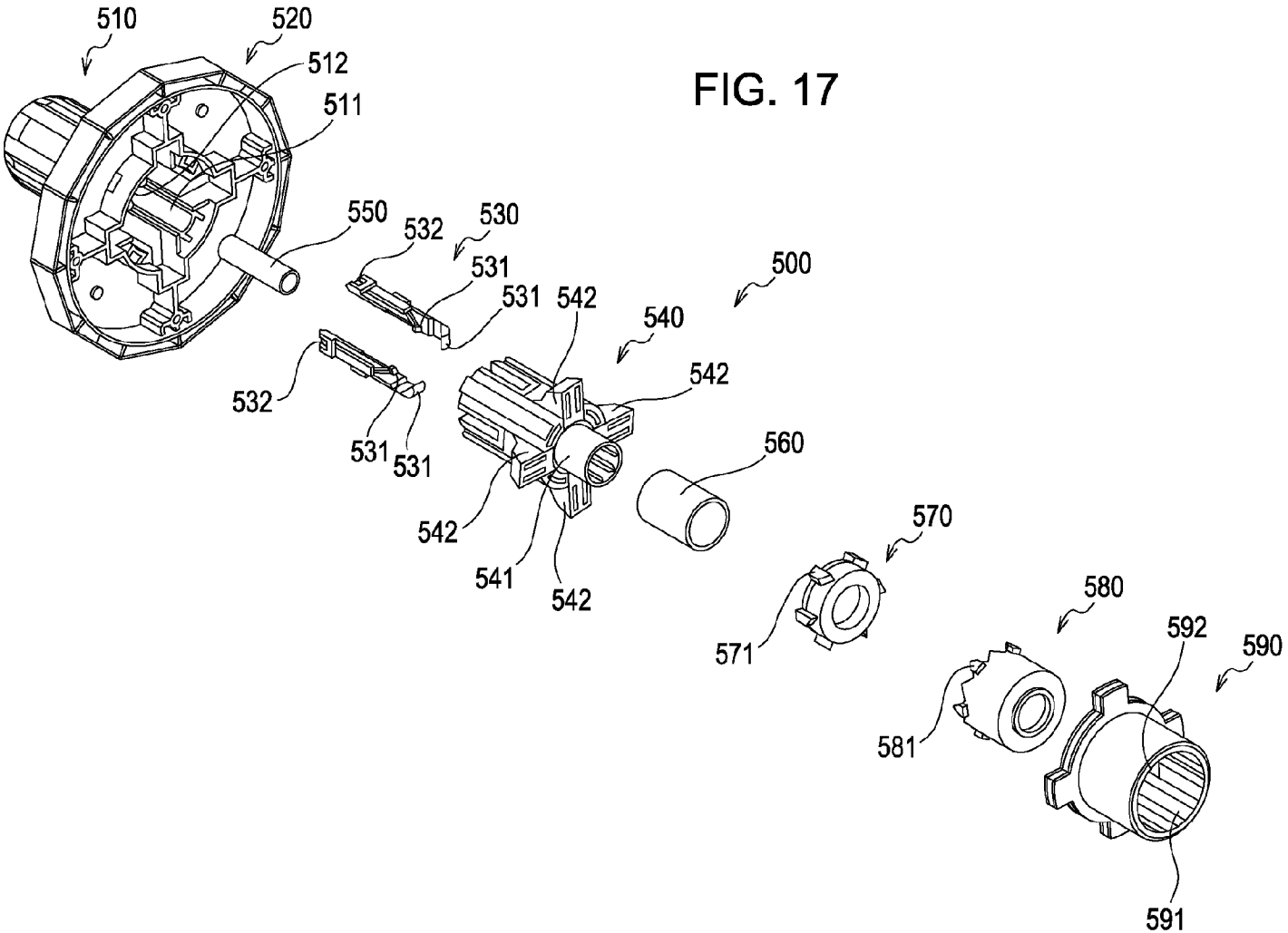
FIG. 17 is an exploded perspective view of a rolled medium supporting mechanism according to a third embodiment of the invention.
Figure 18:
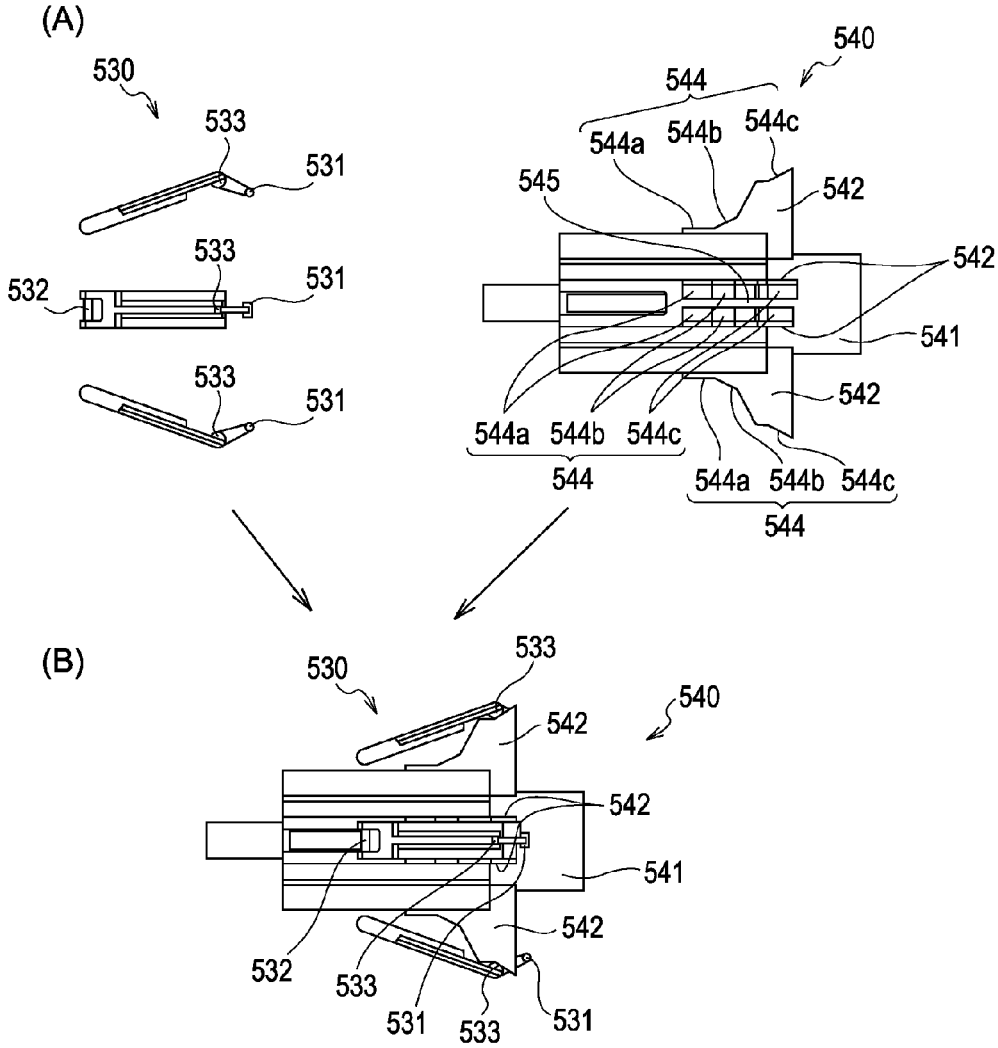
FIGS. 18(A) and 18(B) are top views of the rolled medium supporting mechanism shown in FIG. 17, showing a first main part of the mechanism in the exploded and assembled views.
Figure 19:
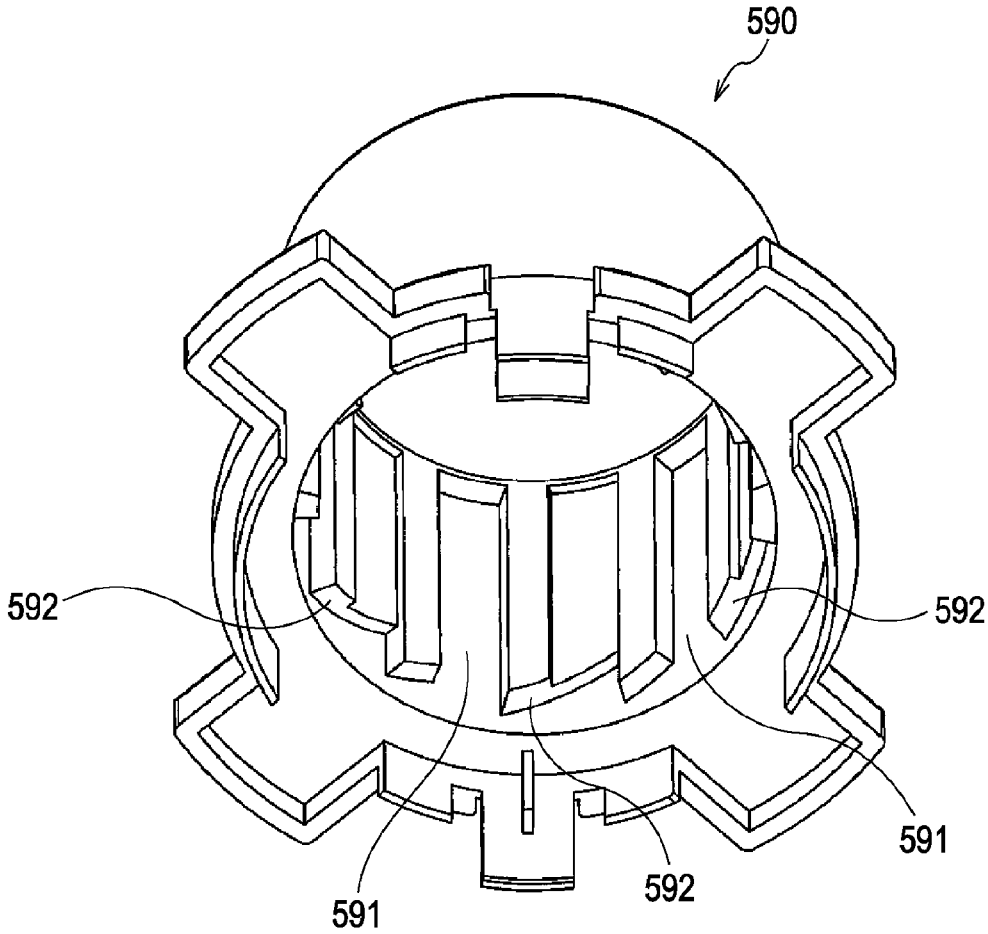
FIG. 19 is a perspective view of the rolled medium supporting mechanism shown in FIG. 17, showing a second main part of the mechanism.
Figure 20:
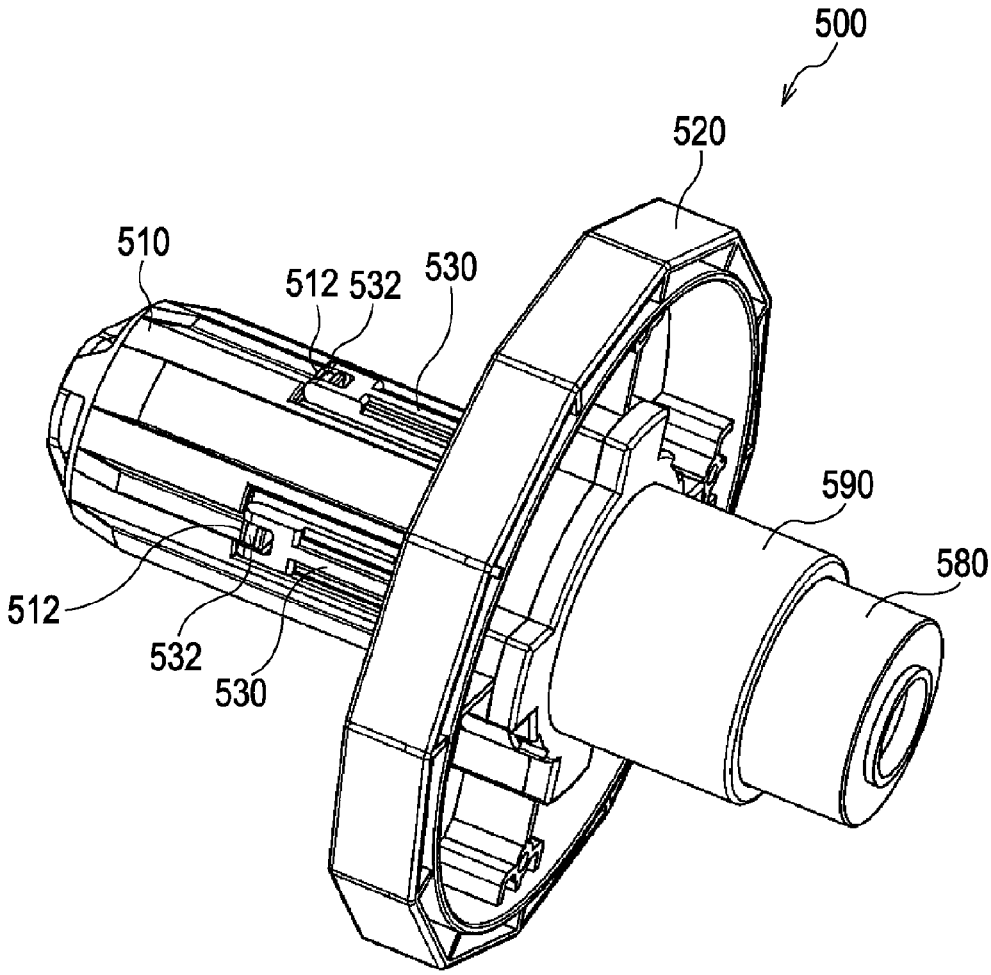
FIG. 20 is a first perspective view of the assembled state of the rolled medium supporting mechanism shown in FIG. 17.
Figure 21:
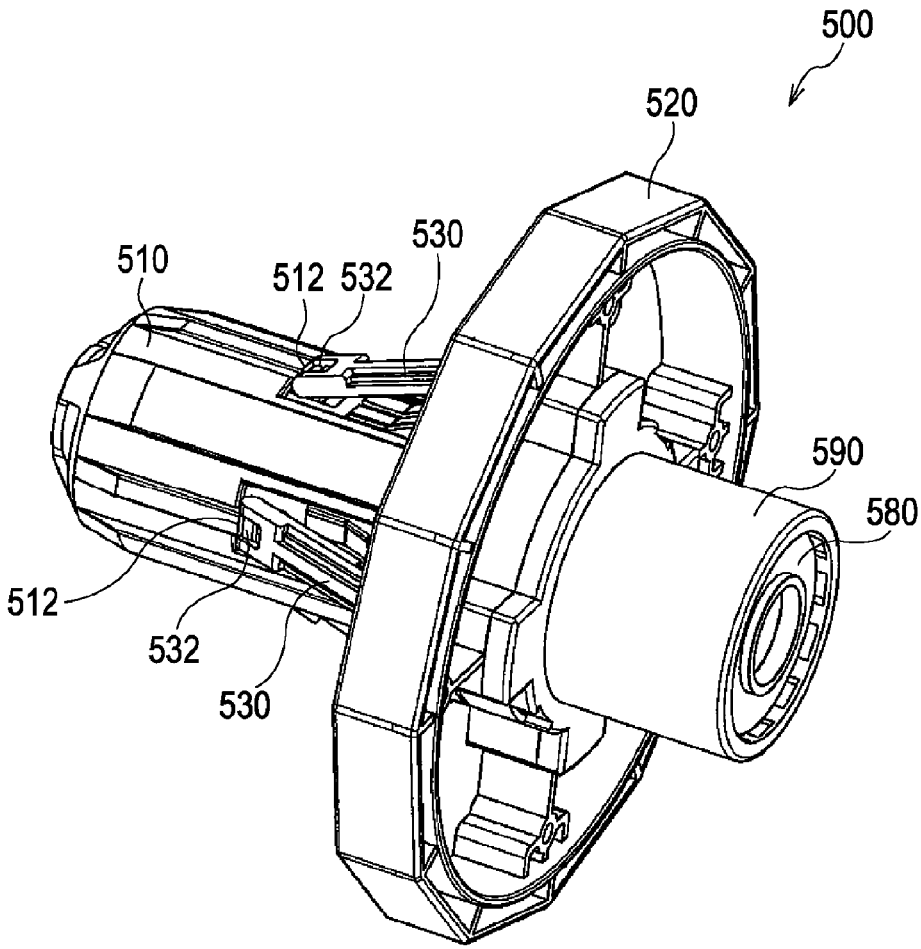
FIG. 21 is a second perspective view of the assembled state of the rolled medium supporting mechanism shown in FIG. 17.

In the drawings, FIG. 17 is an exploded perspective view of a rolled medium supporting mechanism according to a third embodiment of the invention; FIGS. 18(A) and 18(B) are top views of the rolled medium supporting mechanism shown in FIG. 17, showing a first main part of the mechanism in the exploded and assembled views; FIG. 19 is a perspective view of the rolled medium supporting mechanism shown in FIG. 17, showing a second main part of the mechanism; and FIGS. 20 and 21 are perspective views of the assembled state of the rolled medium supporting mechanism shown in FIG. 17. The rolled medium supporting mechanism 500 is configured as a paired set having two identically shaped components. The mechanism 200 is configured to support a roll paper (rolled medium) by being inserted into both ends of a hollow, 2- or 3-inch paper tube. As shown in FIG. 17, the rolled medium supporting mechanism 500 is provided with a boss member (supporting member) 510 made of plastic materials, a flange member (abutting member) 520, a rib member 530, a wedge-shaped member 540, a first spring member 550, a second spring member 560, a rotating ratchet member (button member) 570, a push-in ratchet member (button member) 580, and a guide member (button member) 590.

The boss member 510 is formed in a substantially hollow cylindrical shape having a diameter slightly smaller than that of a 2-inch paper tube. The boss member 210 supports an inner peripheral face of the paper tube by being inserted into the paper tube from its end portion. The flange member 520 is formed integrally and concentrically with the boss member 510 in a substantially circular dish-like shape. The flange member 520 makes abutting contact with end faces of the paper tube and the roll paper. The rib member 530 is formed in a substantially rod-like shape, and is provided with four ribs arranged at regular angles (90 degrees) around circumferential faces of the boss member 510 and the wedge-shaped member 540. The flange member 520 has a polygon-shaped circumference (which is dodecagonal-shaped in this embodiment). Thus, it is possible to prevent the roll paper from rolling on a floor or the like when the flange member 520 having the roll paper mounted thereon is placed on the floor.

The wedge-shaped member 540 is provided with a main body portion 541 having a substantially cylindrical shape; and wedge portions (wedges) 542 having a substantially tapered shape and integrally formed at regular angles (90 degrees) on a circumferential face on one side of the main body portion 541 so as to extend in an axial direction. The wedge-shaped member 540 is disposed inside the boss member 510 by being inserted into the member 510 from the end face of the flange member 520. The wedge portions 542 of the wedge-shaped member 540 are formed in such a shape that the height of each portion 542 becomes greater as it goes from the other side to the one side of the main body portion 541.

The rib member 530 and the wedge-shaped member 540 will be described more in detail. As shown in FIGS. 17 and 18, the rib member 530 is bent at a portion on one end side thereof. Dropout-preventing protruding portions 531 are integrally formed on a front end of the member 530, and pivot shaft portions 532 are integrally formed on the other end of the member 530. A top slope face 544 of each wedge portion 542 of the wedge-shaped member 540 is formed in such a shape that a portion thereof disposed on the other end side of the main body 541 is formed as a release area 544*a*, i.e., the lowest area; a slope face occurring first after the area 544*a* in the direction toward the one end side of the main body portion 541 is formed as a 2-inch-diameter area 544*b* configured to be adaptable to a 2-inch paper tube; and a slope face occurring second after the area 544*b* in that direction is formed as a 3-inch-diameter area 544*c* configured to be adaptable to a 3-inch paper tube.

In the top slope face 544 of each wedge portion 542, a guide slit 545 is formed through which portions of the rib member 530 disposed close to the Dropout-preventing protruding portions 531 are inserted, and which guides bent portions 533 of the rib member 530. On the circumferential face of the boss member 510, rectangular-shaped window portions 511 are formed through which portions of the rib member 530 disposed close to the Dropout-preventing protruding portions 531 and inserted into the guide slits 545 are exposed to the outside when the wedge-shaped member 540 is inserted into the window portions 511. In end portions of the window portions 511 disposed close to the boss member 510, bearing portions 512 (refer to FIG. 21, for example) are integrally formed, which pivotably support the pivot shaft portions 532 of the rib member 530.

The first spring member 550 is a compression coil spring, and is disposed inside the boss member 510 by being inserted into the member 510 from the end face of the flange member 520. The second spring member 560 is a compression coil spring, and is inserted into the outer peripheral portion on the one end side of the main body portion 541 of the wedge-shaped member 540. The rotating ratchet member 570 is formed in a substantially cylindrical shape. On the outer periphery, eight convex portions 571 having a herringbone shape are integrally formed at regular angles. The member 570 is inserted into the outer peripheral portion on the one end side of the main body portion 541 of the wedge-shaped member 540. The push-in ratchet member 580 is formed in a substantially cylindrical shape. On the outer periphery, sixteen convex portions 581 having a herringbone shape are integrally formed at regular angles. The member 580 is inserted into the outer peripheral portion on the one end side of the main body portion 541 of the wedge-shaped member 540. Eight portions 581 out of the total (16) herringbone-shaped convex portions 581 positioned at the same phase as the eight herringbone-shaped convex portions 571 are protruded outward. The guide member 590 is formed in a substantially cylindrical shape, as shown in FIGS. 17 and 19. Groove portions 591 extending in the axial direction and slope portions 592 sloped in the circumferential direction are formed in the inner periphery thereof. The member 590 is inserted into the outer peripheral portion of the push-in ratchet member 580.

When the members having such a configuration are assembled, the first spring member 550 and the wedge-shaped member 540 are first inserted into the boss member 510 from an end face side of the flange member 520. Next, the portions of the rib member 530 disposed close to the Dropout-preventing protruding portions 531 are inserted into the guide slits 545 of the wedge portions 542 of the wedge-shaped member 540 in a state in which the wedge portions 542 are exposed from the window portions 511 of the boss member 510. Accordingly, the pivot shaft portions 532 of the rib member 530 are fitted to the bearing portions 512 of the boss member 510. Next, the second spring member 560, the rotating ratchet member 570, and the push-in ratchet member 580 are inserted into the outer peripheral portion on the one end side of the main body portion 541 of the wedge-shaped member 540. Then, the guide member 590 is inserted into the peripheral portion of the push-in ratchet member 580 so that the guide member 590 is fixed to the flange member 520. In this manner, an assembled final product shown in FIGS. 20 and 21 is obtained.

FIGS. 22(A) and 22(B) and FIGS. 23(A) and 23(B) are diagrams showing the side and perspective views for explaining the operations of the rotating ratchet member 570 and the push-in ratchet member 580. The push-in ratchet member 580 and the rotating ratchet member 570 are freely movable in the guide member 590 in the axial direction. As shown in FIGS. 20 and 21, the push-in ratchet member 580 can be posed between a state that the member 580 protrudes away from the guide member 590 and a state that the member 580 is pushed into the flange member 520.

Figure 22:
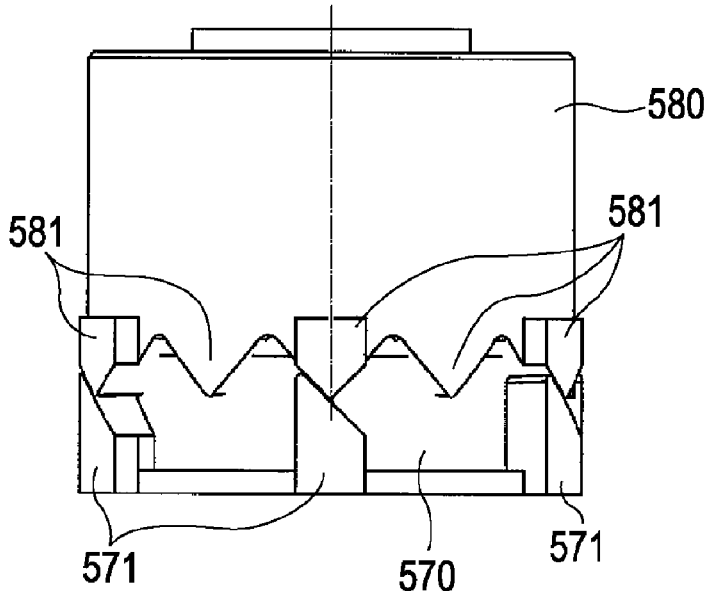
FIGS. 22(A) and 22(B) are first diagrams showing the side and perspective views for explaining the operations of a rotating ratchet member and a push-in ratchet member of the rolled medium supporting mechanism shown in FIG. 17.
Figure 22:
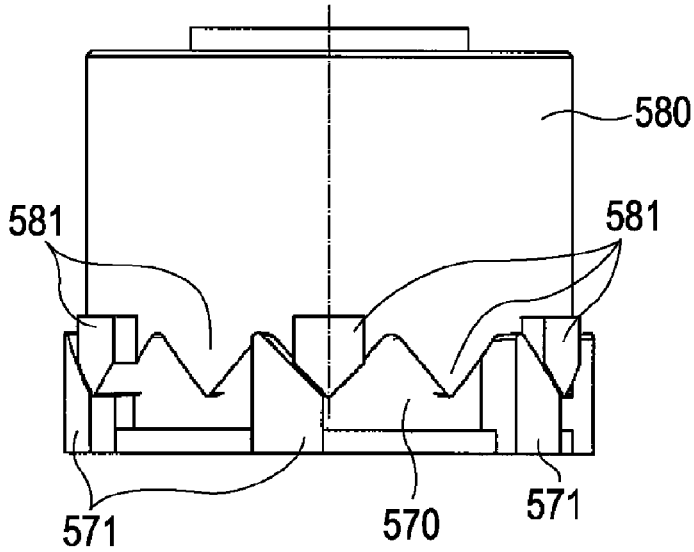
Figure 23:
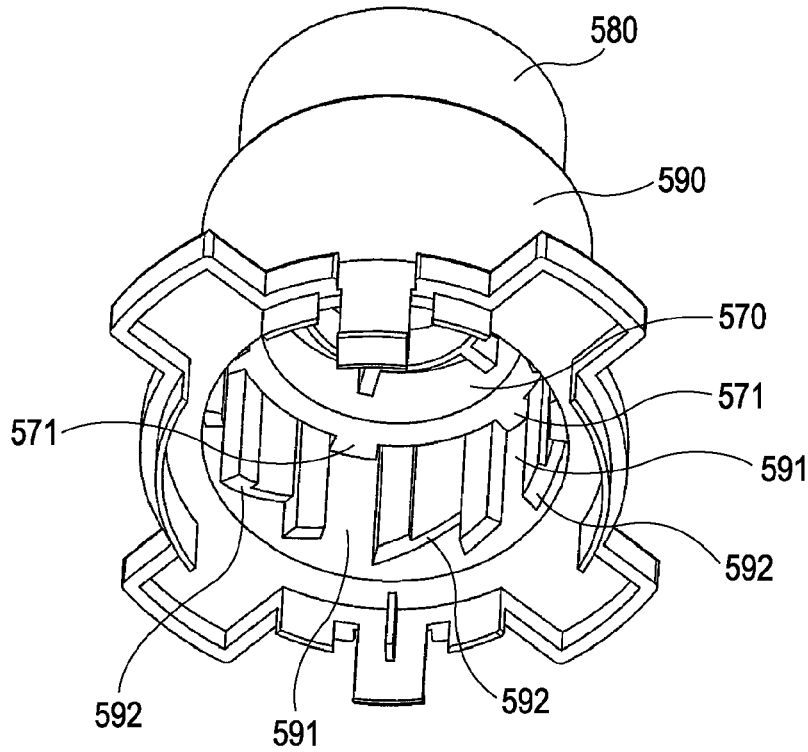
FIGS. 23(A) and 23(B) are second diagrams showing the side and perspective views for explaining the operations of the rotating ratchet member and the push-in ratchet member of the rolled medium supporting mechanism shown in FIG. 17.
Figure 23:
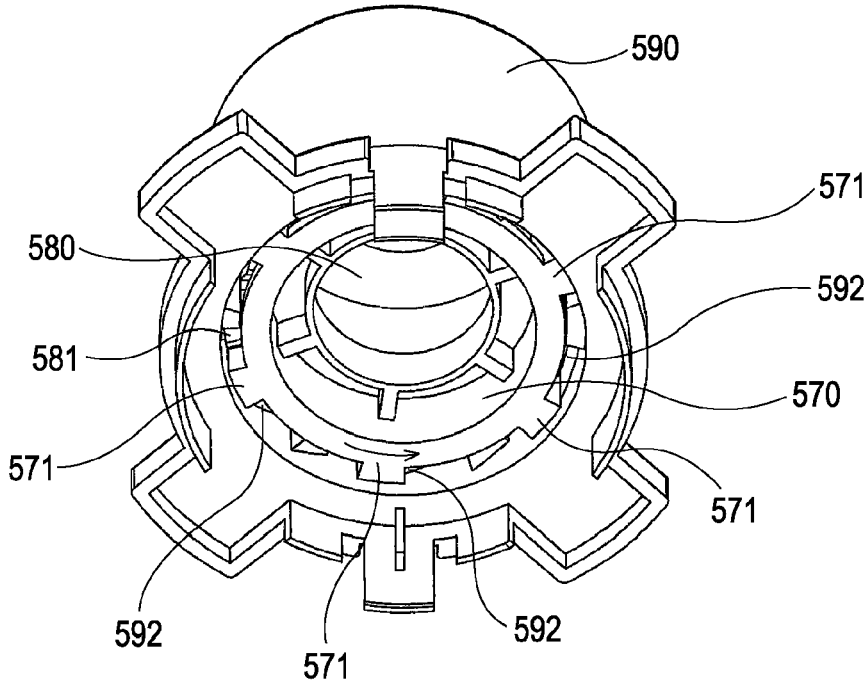

When the push-in ratchet member 580 is protruded away from the guide member 590, the convex portions 581 of the push-in ratchet member 580 interlock with the front ends of the convex portions 571 of the rotating ratchet member 570, as shown in FIG. 22(A). That is, each convex portion 581 of the push-in ratchet member 580 forms a straight line shape with each convex portion 571 of the rotating ratchet member 570. As shown in FIG. 23(A), the convex portions 581 and 571 of the push-in ratchet member 580 and the rotating ratchet member 570 are freely movable in the axial direction along the groove portions 591 of the guide member 590.

When the push-in ratchet member 580 is pushed into the guide member 590, the convex portions 581 of the push-in ratchet member 580 interlock with the rear ends of the convex portions 571 of the rotating ratchet member 570, as shown in FIG. 22(B). That is, each convex portion 581 of the push-in ratchet member 580 forms a substantially L shape with each convex portion 571 of the rotating ratchet member 570. As shown in FIG. 23(B), the convex portions 581 of the push-in ratchet member 580 are still disposed in the groove portions 591 of the guide member 590. However, the convex portions 571 of the rotating ratchet member 570 escape from the groove portions 591 of the guide member 590 and move into a latch state after rotating by a half-phase in the circumferential direction as indicated by the arrow in the drawing along the slope face portions 592 of the guide member 590. The latch state is released when the push-in ratchet member 580 is pushed again into the guide member 590, and the convex portions 571 of the rotating ratchet member 570 escape from the slope face portions 592 of the slope member 590 and return back to the groove portions 591 of the guide member 590 after rotating by a half-phase in the circumferential direction as indicated by the arrow in the drawing.

When the push-in ratchet member 580 is pushed in, the wedge-shaped member 540 is pressed against the second spring member 560 and is moved toward the boss member 510 while compressing the first spring member 550. When the push-in ratchet member 580 is protruded, the wedge-shaped member is pressed against the first spring member 550 and is moved toward the flange member 520 while compressing the second spring member 560. In this case, the ribs of the rib member 530 can freely swing about the pivot shaft portions 532 fitted to the bearing portions 512 of the boss member 510. When the wedge-shaped member 540 moves toward the flange member 520 or the boss member 510, the bent portions 533 are slid upward or downward along the top slope face 544 while being guided by the guide slits 545 of the wedge portions 542. That is, the ribs of the rib member 530 can be freely operable between a state that they are closed in parallel to the axis of the boss member 510 and a state that they are unfolded at a predetermined angle in the radial direction. The operating method of the mechanism having such a configuration will be described with reference to the drawings.

Figure 24:
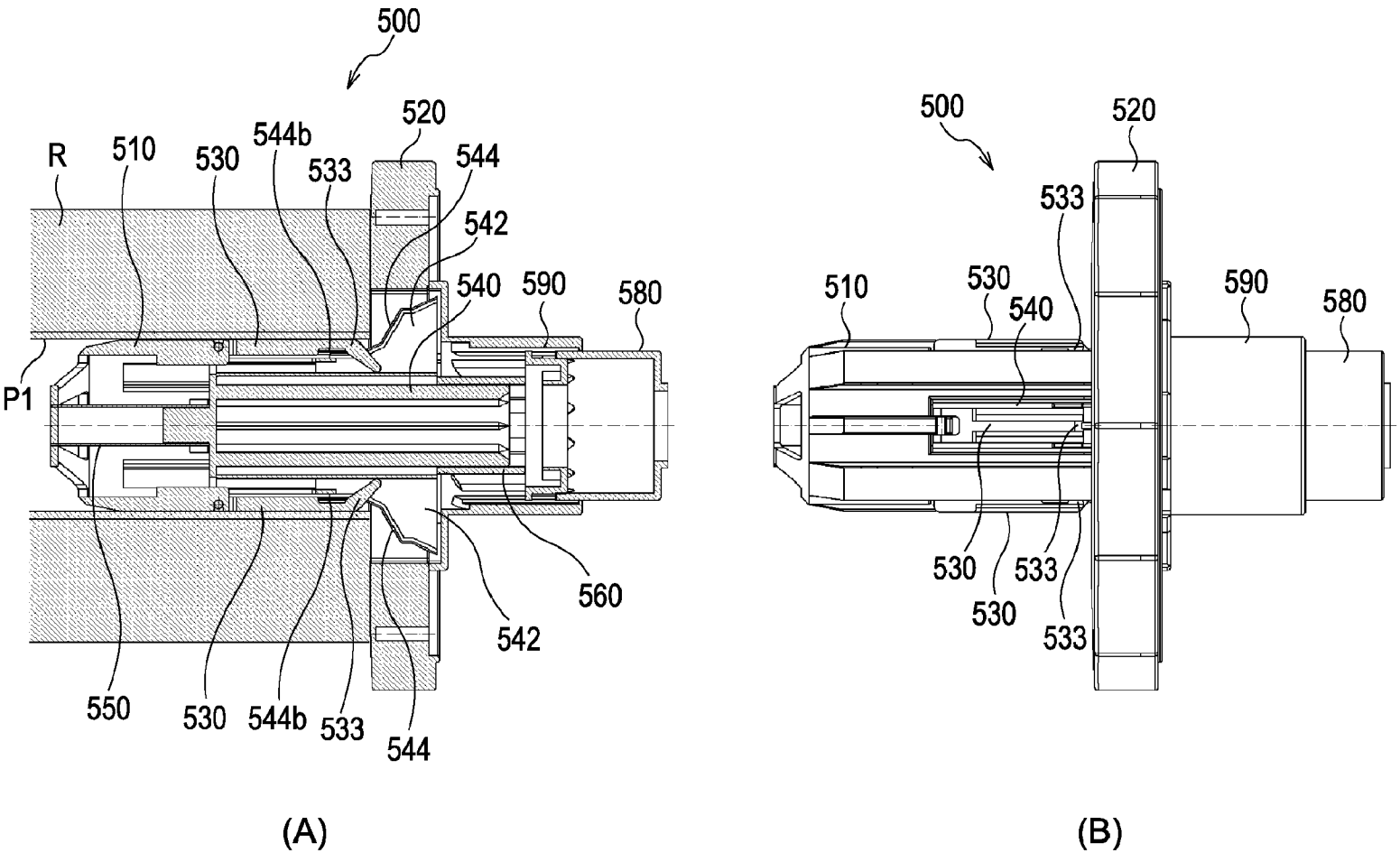
FIGS. 24(A) and 24(B) are first diagrams showing the sectional and side views for explaining a method of operating the rolled medium supporting mechanism shown in FIG. 17.
Figure 25:
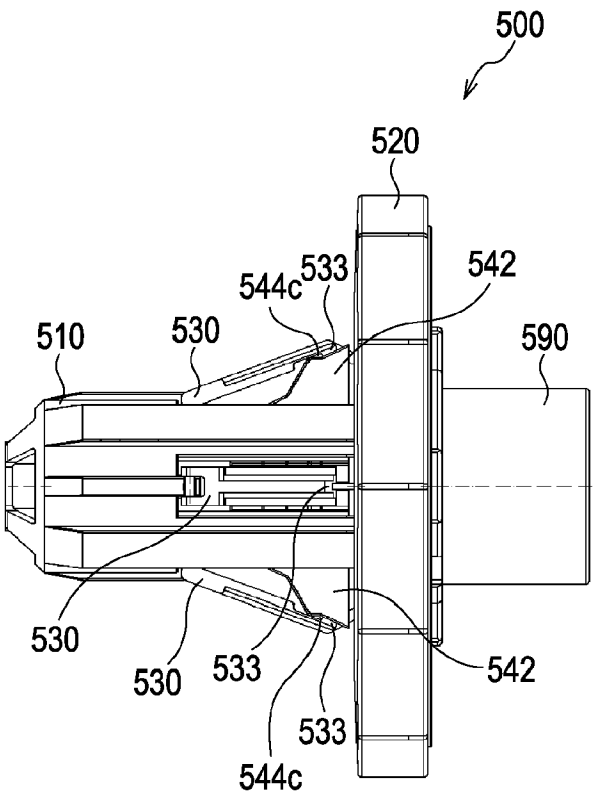
FIGS. 25(A) and 25(B) are second diagrams showing the sectional and side views for explaining the method of operating the rolled medium supporting mechanism shown in FIG. 1.
Figure 25:
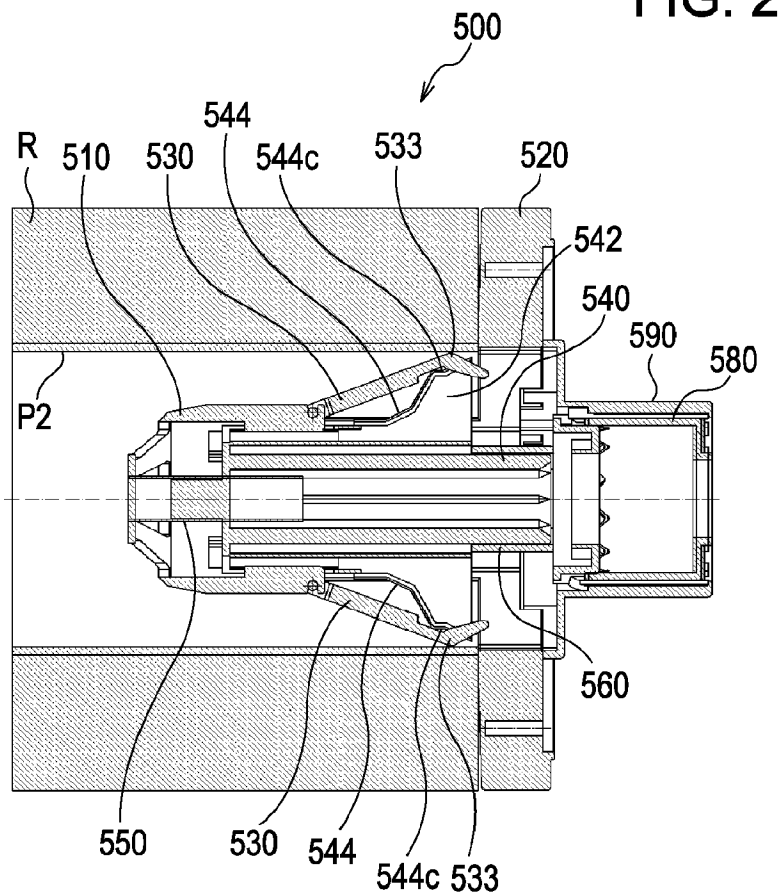

FIGS. 24 and 25 are diagrams showing the sectional and side views for explaining the method of operating the rolled medium supporting mechanism 500. In a non-operating state, the push-in ratchet member 580 is protruded away from the guide member 590. The wedge-shaped member 540 is pressed against the first spring member 550 and is moved toward the flange member 520 while compressing the second spring member 560. The bent portions 533 of the rib member 530 are therefore placed in the release areas 544*a* of the top slope faces 544 of the wedge portions 542. The ribs of the rib member 530 are in a state in which they are parallel to the axis of the boss member 510. The upper face of each rib of the rib member 530 is placed on the same face as the circumferential face of the boss member 510 when the ribs of the rib member 530 are exposed from the window portions 511. In this case, since the diameter of the boss member 510 including the ribs of the rib member 530 is slightly smaller than that of a 2-inch paper tube, the mechanism 500 can be inserted into a 2- or 3-inch paper tube in a simple manner.

As shown in FIG. 24, when the rolled medium supporting mechanism 500 is fitted to a 2-inch paper tube P1, the boss member 510 in the above-described non-operating state is inserted into the paper tube P1 from its end portion. The flange member 520 is brought into abutting contact with the end faces of the paper tube P1 and the roll paper R so that the push-in ratchet member 580 is pushed into the guide member 590. Accordingly, the wedge-shaped member 540 is pressed against the second spring member 560 and is moved toward the boss member 510 while compressing the first spring member 550. Then, the bent portions 533 of the rib member 530 are slid upward along the top slope faces 544 while being guided by the guide slits 545 of the wedge portions 542. At this moment, the ribs of the rib member 530 are likely to be unfolded to the axis of the boss member 510. However, the unfolding can be prevented by the bent portions 533 of the rib member 530 making abutting contact with the inner peripheral face of the paper tube P1 before the bent portions 533 are slid further until reaching the 2-inch-diameter areas 544*b*.

The inner peripheral face of the paper tube P1 is therefore supported by the bent portions 533 of the rib member 530 by the compression force of the first spring member 550. Accordingly, the rolled medium supporting mechanism 500 can support the roll paper R having the 2-inch paper tube P1. In this case, even when the diameter of the 2-inch paper tube P1 is irregular, the irregularity is absorbed by the first and second spring members 550 and 560, and it is thus possible to support the roll paper R. When the push-in ratchet member 580 is pushed into the guide member 590 until the stopping point, the convex portions 581 of the push-in ratchet member 580 are still disposed in the groove portions 591 of the guide member 590. However, the convex portions 571 of the rotating ratchet member 570 escape from the groove portions 591 of the guide member 590 and move into a latch state after rotating by a half-phase in the circumferential direction along the slope face portions 592 of the guide member 590. Portions of the boss member 510 excluding the window portions 511 are integrally formed with the flange member 520. In particular, since the front end of the boss member 510 is formed in a closed pouch-like shape, it is possible to maintain a high degree of strength. Accordingly, it is possible to support a heavy roll paper R in a satisfactory manner.

As shown in FIG. 25, when the rolled medium supporting mechanism 500 is fitted to a 3-inch paper tube P2, the boss member 510 in the above-described non-operating state is inserted into the paper tube P2 from its end portion. The flange member 520 is brought into abutting contact with the end faces of the paper tube P2 and the roll paper R so that the push-in ratchet member 580 is pushed into the guide member 590. Accordingly, the wedge-shaped member 540 is pressed against the second spring member 560 and is moved toward the boss member 510 while compressing the first spring member 550. Then, the bent portions 533 of the rib member 530 are slid upward along the top slope faces 544 while being guided by the guide slits 545 of the wedge portions 542. At this moment, the ribs of the rib member 530 are likely to be unfolded to the axis of the boss member 510. However, the unfolding can be prevented by the bent portions 533 of the rib member 530 making abutting contact with the inner peripheral face of the paper tube P2 before the bent portions 533 are slid further until the 3-inch-diameter areas 544*c*.

The inner peripheral face of the paper tube P2 is therefore supported by the bent portions 533 of the rib member 530 by the compression force of the first spring member 550. Accordingly, the rolled medium supporting mechanism 500 can support the roll paper R having the 3-inch paper tube P2. In this case, even when the diameter of the 3-inch paper tube P2 is irregular, the irregularity is absorbed by the first and second spring members 550 and 560, and it is thus possible to support the roll paper R. When the push-in ratchet member 580 is pushed into the guide member 590 until the stopping point, the convex portions 581 of the push-in ratchet member 580 are still disposed in the groove portions 591 of the guide member 590. However, the convex portions 571 of the rotating ratchet member 570 escape from the groove portions 591 of the guide member 590 and move into a latch state after rotating by a half-phase in the circumferential direction along the slope face portions 592 of the guide member 590. Portions of the boss member 510 excluding the window portions 511 are integrally formed with the flange member 520. In particular, since the front end of the boss member 510 is formed in a closed pouch-like shape, it is possible to maintain a high degree of strength. Accordingly, it is possible to support a heavy roll paper R in a satisfactory manner.

When the rolled medium supporting mechanism 500 is detached from the 2- or 3-inch paper tube, the push-in ratchet member 580 is pushed again into the guide member 590 until the stopping point. Then, the latch state is released when the convex portions 571 of the rotating ratchet member 570 escape from the slope face portions 592 of the slope member 590 and return back to the groove portions 591 of the guide member 590 after rotating by a half-phase in the circumferential direction. Then, the convex portions 581 of the push-in ratchet member 580 and the convex portions 571 of the rotating ratchet member 570 are freely movable in the axial direction along the groove portions 591 of the guide member 590. Accordingly, the wedge-shaped member is pressed against the first spring member 550 and is moved toward the flange member 520 while compressing the second spring member 560.

The bent portions 533 of the rib member 530 are slid downward to the release areas 544*a* along the top slope faces 544 while being guided by the guide slits 545 of the wedge portions 542. The ribs of the rib member 530 become parallel to the axis of the boss member 510. At this moment, the upper face of each rib of the rib member 530 is placed on the same face as the circumferential face of the boss member 510 when the ribs of the rib member 530 are exposed from the window portions 511. In this case, since the diameter of the boss member 510 including the ribs of the rib member 530 is slightly smaller than that of a 2-inch paper tube, the mechanism 500 can be pulled out from a 2- or 3-inch paper tube in a simple manner.

The paired flange member 520 can determine the position of the 2- or 3-inch paper tube P1 or P2 by making abutting contact with both end faces of the paper tube P1 or P2. Moreover, the flange member 220 can prevent the oblique transportation of the roll paper R by guiding both edges of the roll paper R when it is unrolled from the 2- or 3-inch paper tube P1 or P2. Since the ribs of the rib member 530 are brought into abutting contact with the inner peripheral faces on the end portions of the 2- or 3-inch paper tube P1 or P2, both ends of the 2- or 3-inch paper tube P1 or P2 are held by the ribs of the rib member 530. Accordingly, it is possible to eliminate necessity of a conventional lengthy shaft and thus to improve the setting properties. In the above-described embodiment, the rib member 530 is partitioned into four ribs so that the paper tube is supported by the four ribs. However, the invention is not limited to this. The invention may be configured in such a manner that the rib member 530 is partitioned into an arbitrary (plural) number of ribs so that the paper tube is supported by the arbitrary number of ribs.

As described above, according to the rolled medium supporting mechanism 500 of the present embodiment, the boss member 510 is provided with the rib member 530 configured to be freely displaced in cooperation with the advancing and retracting operation of the wedge-shaped member 540 provided in the boss member 510, wherein the rib member 530 is displaced in a diameter direction in accordance with the diameter of the paper tube. Accordingly, it is not necessary to have a separate component in order to adapt to paper tubes having different diameters, but only displacement of the rib member 530 is needed. Thus, it is possible to simplify the construction and provide easy handling properties. In addition, the wedge-shaped member 540 advances and retracts in cooperation with the push-in operation of the push-in ratchet member 580 provided in the flange member 520 that is integrally formed with the boss member 510 so as to make abutting contact with the end face of the roll paper. Accordingly, the user can displace the rib member 530 in a simple manner. In addition, the flange member 520 has a polygon-shaped circumference. Accordingly, it is possible to place the roll paper on a horizontal plane in a stable state when the roll paper is fitted to the rolled medium supporting mechanism 500.

Figure 26:
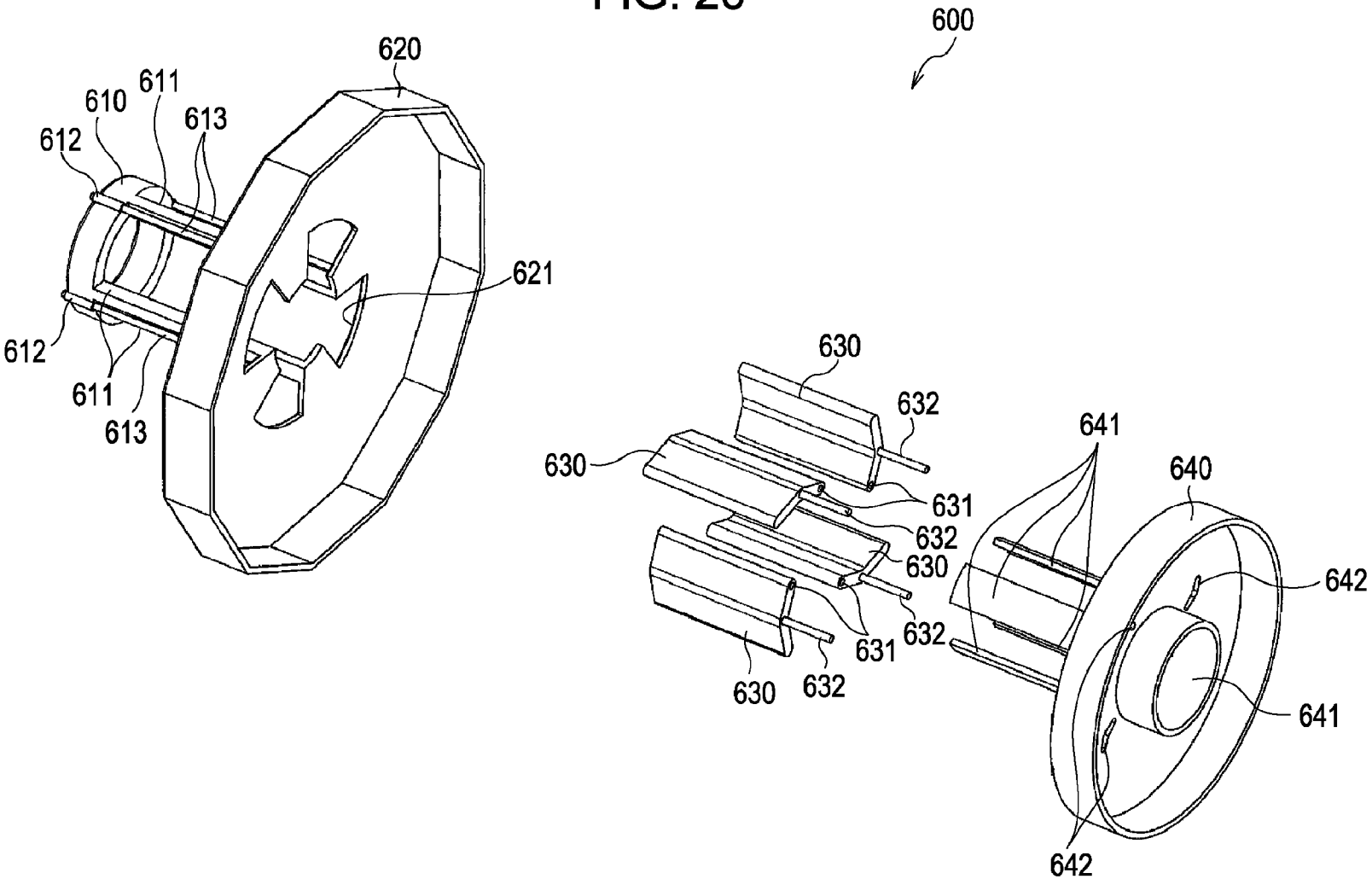
FIG. 26 is an exploded perspective view of a rolled medium supporting mechanism according to a fourth embodiment of the invention.

In the drawings, FIG. 26 is an exploded perspective view of a rolled medium supporting mechanism according to a fourth embodiment of the invention; FIGS. 27(A) and 27(B) and FIGS. 28(A) and 28(B) are first diagrams showing the perspective and top views of the assembled state of the rolled medium supporting mechanism shown in FIG. 26; and FIGS. 29(A) and 29(B) and FIGS. 30(A) and 30(B) are second diagrams showing the perspective and top views of the assembled state of the rolled medium supporting mechanism shown in FIG. 26. The rolled medium supporting mechanism 600 is also configured as a paired set having two identically shaped components.

The mechanism 600 is configured to support a roller (rolled medium) by being inserted into both ends of a hollow, 2- or 3-inch paper tube. As shown in FIG. 26, the rolled medium supporting mechanism 600 is provided with a boss member (supporting member) 610 made of plastic materials, a flange member (abutting member) 620, a blade member (expandable abutting member) 630, and a knob member (opening/closing member) 640.

The boss member 610 is formed in a substantially hollow cylindrical shape having a diameter slightly smaller than that of a 2-inch paper tube. The boss member 610 supports an inner peripheral face of the paper tube by being inserted into the paper tube from its end portion. On the circumferential face of the boss member 610, four rectangular-shaped window portions 611 are provided at regular angles (90 degrees) so that four blades of the blade member 630 are arranged at regular angles (90 degrees).

In edges of the window portions 611 extending in the axial direction of the boss member 610, there are provided pin attachment portions 612 to which is attached pins 613 extending in the axial direction of the boss member 610 so as to axially support one end of each blade of the blade member 630.

The flange member 620 is formed integrally and concentrically with the boss member 610 in a substantially circular dish-like shape, and makes abutting contact with end faces of the paper tube and the roll paper. In the center of the end face of the flange member 620, there are provided a circular hole for allowing the insertion of shaft portions 641 of the knob member 640; and a cutout portion 621 bored in a bead-like shape in order to prevent the four blades of the blade member 630 from interfering with each other when the blades are expanded in the diameter direction. The flange member 620 has a polygon-shaped circumference (which is dodecagonal-shaped in this embodiment).

Thus, it is possible to prevent the roll paper from rolling on a floor or the like when the flange member 620 having the roll paper mounted thereon is placed on the floor.

The blades of blade member 630 are formed in a substantially rectangular plate-like shape, in which the plate is bent at the central portion so as to provide elasticity. In one end face of the each blade, a pin hole 631 is bored so that the pin 613 of the boss member 610 is inserted into the hole 631. In the central portion of the one end face, a cam pin (cam mechanism) 632 is integrally formed so as to extend in parallel to the pin hole 631. The four blades of the blade member 630 are arranged in such a manner that they are freely expandable within the window portions 611 while being axially supported by the pins 613 of the boss member 610.

The knob member 640 is formed in a substantially circular dish-like shape.

In an end face on the right side (in the drawing) of the member 640, substantially cylindrical shaped shaft portion 641 is integrally formed and serves as a grip portion when the user rotates the knob member 640. On the end face of the knob member 640, cam holes (cam mechanism) 642 are bored at regular angles around the shaft portion 641 so as to allow the insertion of front ends of the cam pins 632 of the blades of the blade member 630 and thus to guide the expansion of each blade of the blade member 630. On the other end face of the knob member 640, shaft portion 641 is integrally formed between the cam holes 642. The shaft portion 641 serves as a rotating shaft when the portion 641 is pushed into the boss member 610 from the cutout portion 621 of the flange member 620.

Figure 27:
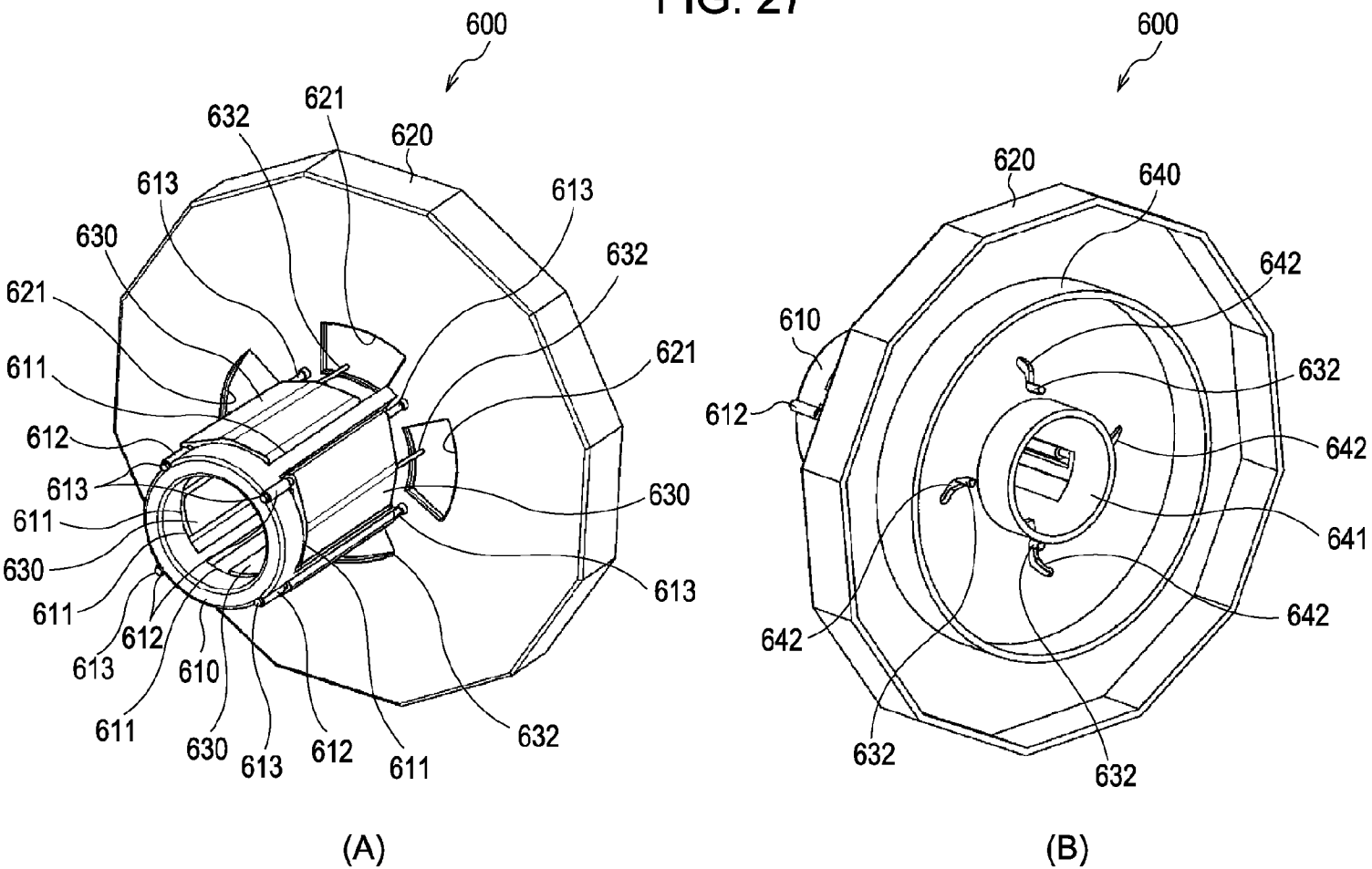
FIGS. 27(A) and 27(B) are first perspective views of the assembled state of the rolled medium supporting mechanism shown in FIG. 26.
Figure 28:
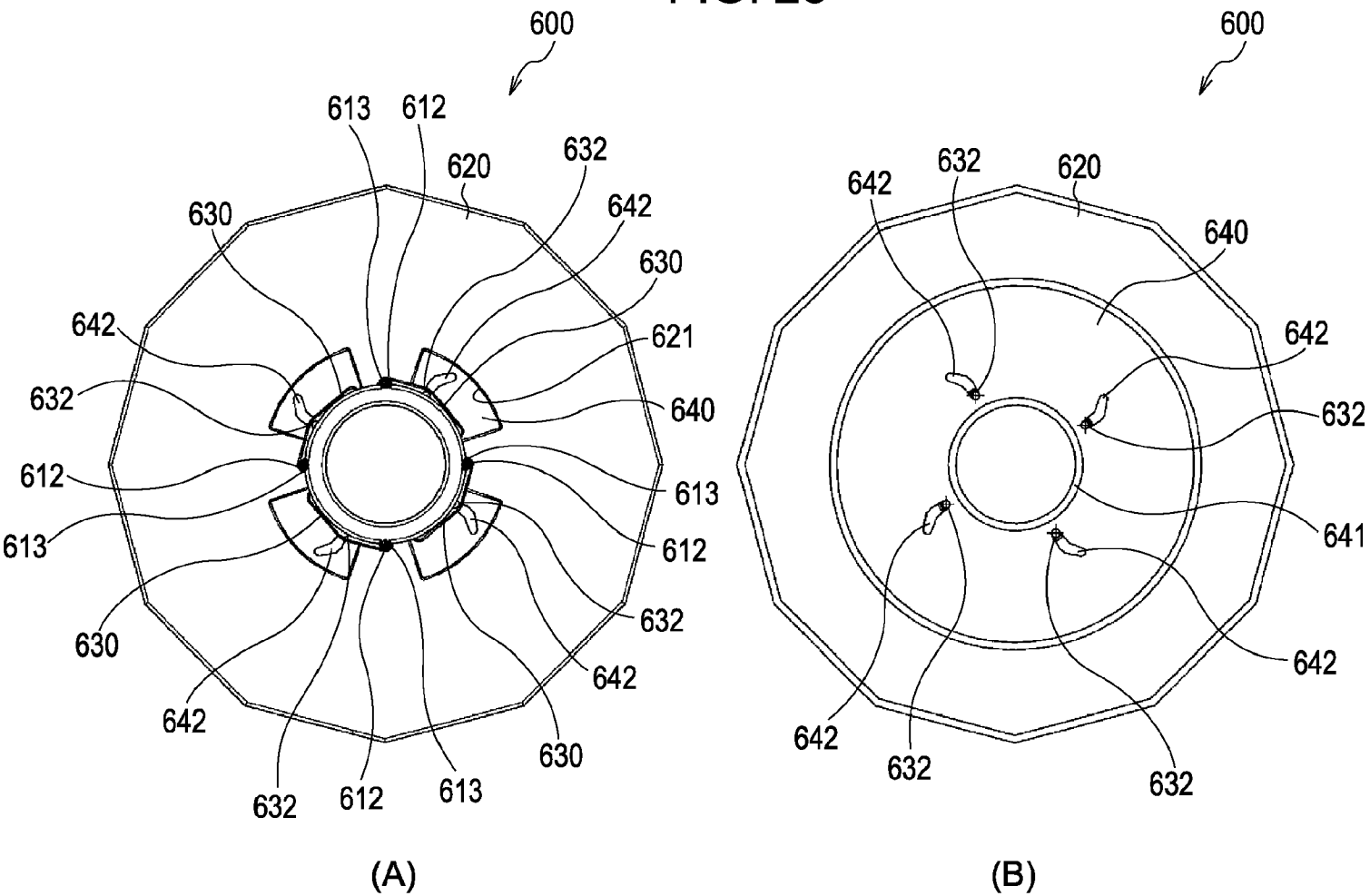
FIGS. 28(A) and 28(B) are first top views of the assembled state of the rolled medium supporting mechanism shown in FIG. 26.

When the members having such a configuration are assembled, the pins 613 of the boss member 610 are first detached from the pin attachment portions 612 of the boss member. Then, the blades of the blade member 630 are placed in the window portions 611 of the boss member 610. The pins 613 of the boss member 610 are inserted into the pin holes 631 of the blades of the blade member 630 in the direction from the pin attachment portions 612 of the boss member 610 so that the boss member 610 is fixed to the blade member 630. The shaft portion 641 of the knob member 640 is pushed into the boss member 610 in the direction from the cutout portion 621 of the flange member 620. The front ends of the cam pins 632 of the blades of the blade member 630 are protruded out from the cam holes 642 of the knob member 640. In this manner, an assembled final product shown in FIGS. 27 and 28 is obtained.

In this embodiment, the cam holes 642 of the knob member are formed in a slot-like shape extending from the inner peripheral side to the outer peripheral side, as shown in FIG. 28(B), for example. Therefore, the cam pins 632 of the blades of the blade member 630 are guided between a position (shown in FIG. 28(B)) corresponding to the inner peripheral ends of the cam holes 642 and a position (shown in FIG. 29(B)) corresponding to the outer peripheral ends of the cam holes 642.

Figure 29:
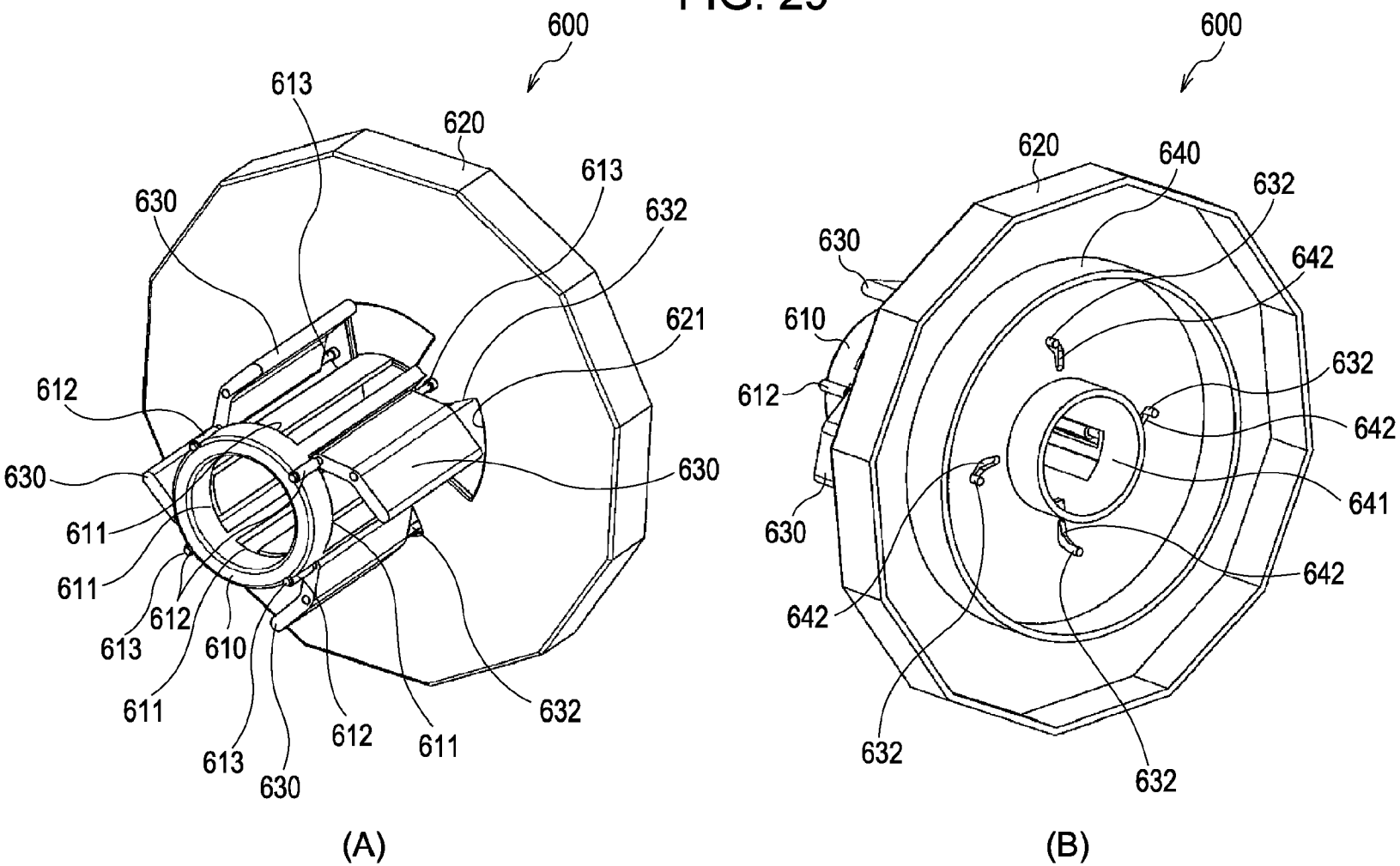
FIGS. 29(A) and 29(B) are second perspective views of the assembled state of the rolled medium supporting mechanism shown in FIG. 26.
Figure 30:
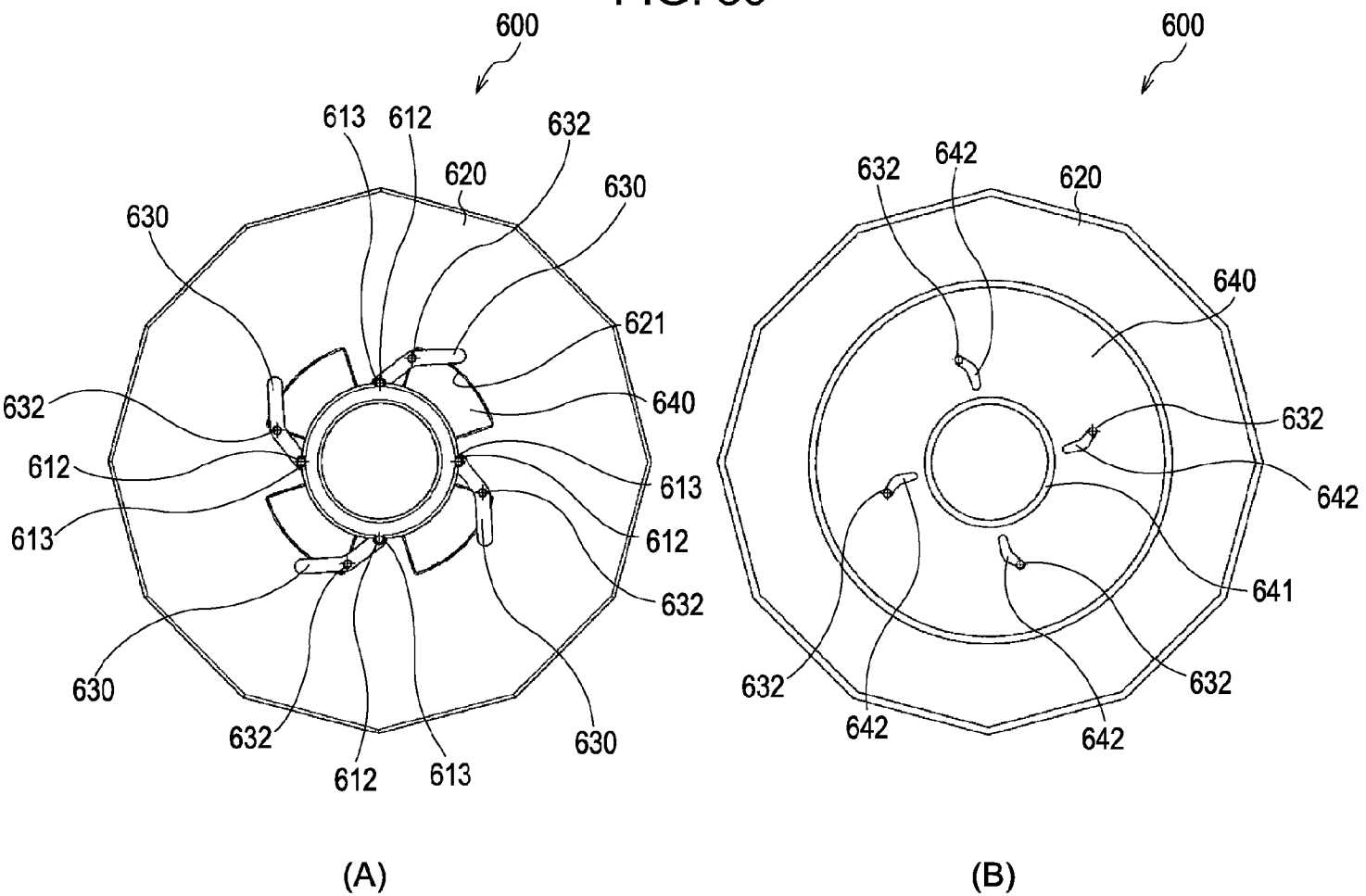
FIGS. 30(A) and 30(B) are second top views of the assembled state of the rolled medium supporting mechanism shown in FIG. 26.

Therefore, the blades of the blade member 630 are moved by the left-to-right rotating operation of the knob member 640 so that the blades are freely expandable between a state (shown in FIGS. 27(A) and 28(A)) wherein the blades block substantially the whole window portions 611 of the boss member 610 and thus forming the outer peripheral face of the boss member 610; and a state (shown in FIGS. 29(A) and 30(A)) wherein the blades are swung about the pins 613 of the boss member 610 a swing axis by a predetermined angle away from the boss member 610, the swing axis extending from the pin holes 612 of the boss member 610 and the pin holes 641 of the blade engagement member 640. The operating method of the mechanism having such a configuration will be described with reference to the drawings.

Figure 31:
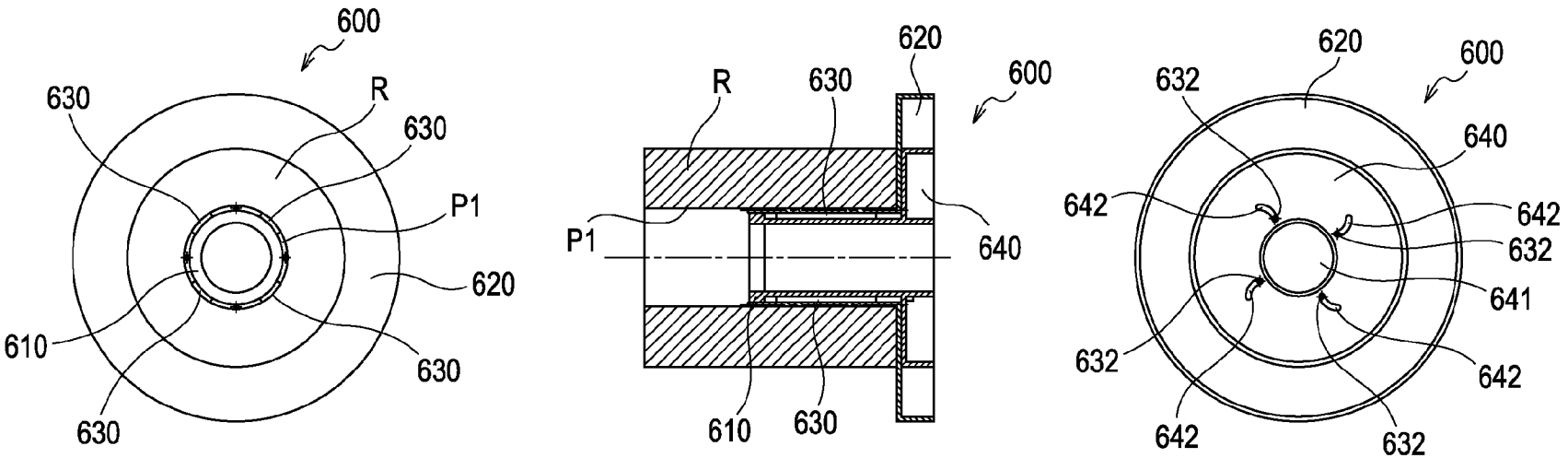
FIGS. 31(A) to 31(C) are first diagrams showing the left-side view, A-A sectional view, and right-side view, for explaining a method of operating the rolled medium supporting mechanism shown in FIG. 26.
Figure 32:
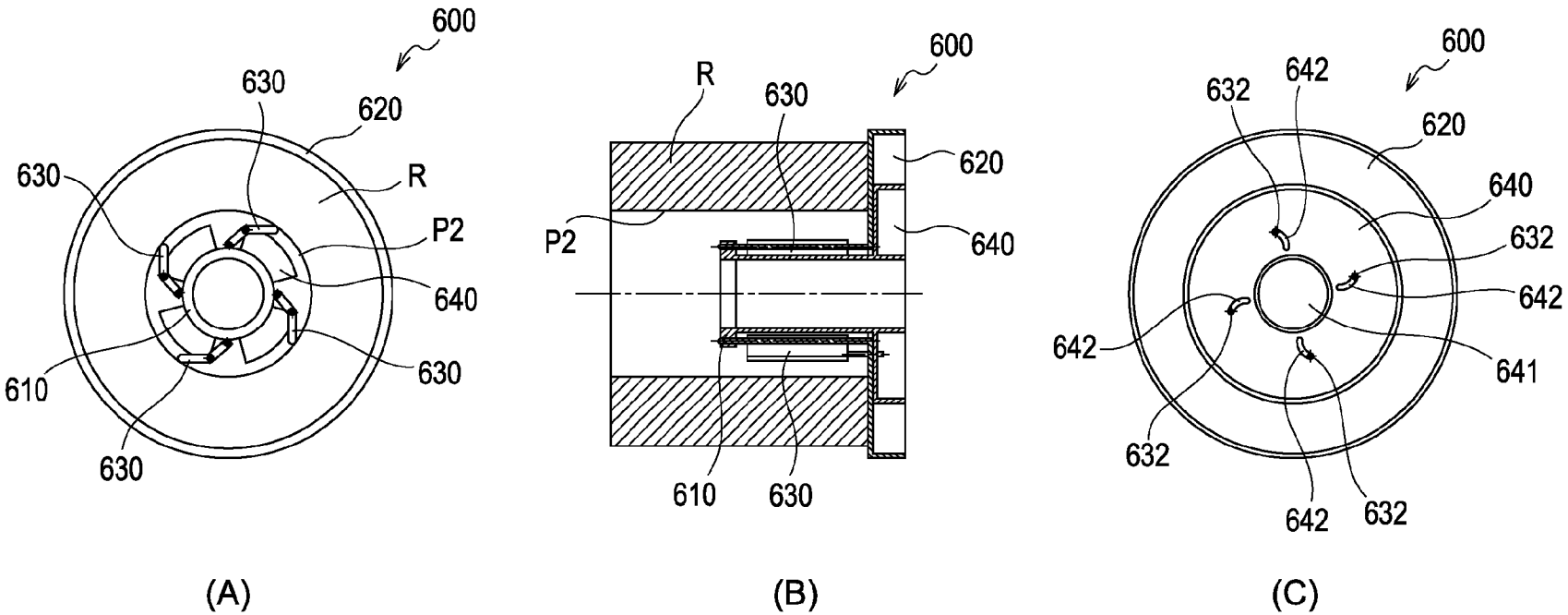
FIGS. 32(A) to 32(C) are second diagrams showing the left-side view, A-A sectional view, and right-side view, for explaining the method of operating the rolled medium supporting mechanism shown in FIG. 26.

FIGS. 31 and 32 are diagrams showing the left-side view, A-A sectional view, and right-side view, for explaining a method of operating the rolled medium supporting mechanism 600. As shown in FIGS. 27 and 28, in a non-operating state, the blades of the blade member 630 is a state that the blades block substantially the whole window portions 611 of the boss member, but the bent portions are slightly protruded out from the window portions 611. In this case, the diameter of the boss member 610 including the blades of the blade member 630 is slightly larger than that of a 2-inch paper tube. However, since the blades of the blade member 630 are formed in a cantilevered beam shape, the blades are likely to bend toward the inside of the window portions 611. Accordingly, the mechanism 600 can be inserted into a 2- or 3-inch paper tube in a simple manner.

As shown in FIG. 31, when the rolled medium supporting mechanism 600 is fitted to a 2-inch paper tube P1, the boss member 610 in the non-operating state is inserted into the paper tube P1 from its end portion. The flange member 620 is brought into abutting contact with the end faces of the paper tube P1. As described above, since the blades of the blade member 630 are inserted into the 2-inch paper tube P1 in a state in which they are bent toward the inside of the window portions 611, the inner peripheral face of the paper tube P1 is supported by the bending elastic force of the blade member 630. Accordingly, the rolled medium supporting mechanism 600 can support the roll paper R having the 2-inch paper tube P1. At this moment, the cam pins 632 of the blades of the blade member 630 are fixedly interposed between the inner peripheral ends of the cam holes 642 of the knob member 640 and the inner peripheral corners of the fan-shaped holes of the cutout portions 621 of the flange member 620. Therefore, the expansion of the blades of the blade member 630 can be restricted. Even when the diameter of the 2-inch paper tube P1 is irregular, the irregularity is absorbed by the bending of the blades of the blade member 630, and it is thus possible to support the roll paper R.

As shown in FIG. 32, when the rolled medium supporting mechanism 600 is fitted to a 3-inch paper tube P2, the boss member 610 in the non-operating state is inserted into the paper tube P2 from its end portion. The flange member 620 is brought into abutting contact with the end faces of the paper tube P2, and the knob member 640 is rotated in the right-hand direction. Accordingly, the blades of the blade member 630 are expanded toward the outside of the boss member 610. The knob member 640 is further rotated in the right-hand direction until the stopping point even after the blades of the blade member 630 are brought into abutting contact with the inner peripheral face of the 3-inch paper tube P2. Accordingly, the blades of the blade member 630 are bent. However, at this moment, the cam pins 632 of the blades of the blade member 630 are fixedly interposed between the outer peripheral ends of the cam holes 642 of the knob member 640 and the outer peripheral corners of the fan-shaped holes of the cutout portions 621 of the flange member 620. Therefore, the expanded states of the blades of the blade member 630 can be maintained. Accordingly, the inner peripheral face of the paper tube P2 is supported by the bending elastic force of the blade member 630. Accordingly, the rolled medium supporting mechanism 600 can support the roll paper R having the 3-inch paper tube P2.

Even when the diameter of the 3-inch paper tube P2 is irregular, the irregularity is absorbed by the blade member 630, and it is thus possible to support the roll paper R.

When the rolled medium supporting mechanism 600 is detached from the 2- or 3-inch paper tube, the knob member 640 is rotated in the right-hand direction so as to close the blades of the blade member 630. In addition, since the blades of the blade member 630 are formed in a cantilevered beam shape, the blades are likely to bend toward the inside of the window portions 611. Accordingly, the mechanism 600 can be pulled out from a 2- or 3-inch paper tube in a simple manner.

The paired flange member 620 can determine the position of the 2- or 3-inch paper tube P1 or P2 by making abutting contact with both end faces of the paper tube P1 or P2. Moreover, the flange member 620 can prevent the oblique transportation of the roll paper R by guiding both edges of the roll paper R when it is unrolled from the 2- or 3-inch paper tube P1 or P2. Since the blades of the blade member 630 are brought into abutting contact with the inner peripheral faces on the end portions of the 2- or 3-inch paper tube P1 or P2, both ends of the 2- or 3-inch paper tube P1 or P2 are held by the blades of the blade member 630. Accordingly, it is possible to eliminate necessity of a conventional lengthy shaft and thus to improve the setting properties.

In the above-described embodiment, the blade member 630 is partitioned into four blades so that the paper tube is supported by the four blades. However, the invention is not limited to this. The invention may be configured in such a manner that the blade member 630 is partitioned into an arbitrary (plural) number of blades so that the paper tube is supported by the arbitrary number of blades. By forming the cam holes 642 of the knob member 640 and the cutout portions 621 of the flange member 620 to have a plurality of end portions, it is possible to regulate the expansion of the blade member 630 in a stepwise manner and thus to adapt to paper tubes having different diameters.

As described above, according to the rolled medium supporting mechanism 600 of the present embodiment, the plural blades of the blade member 630 configured to be freely expandable about the pins 613 disposed on one end side thereof and axially supported by the boss member 610 in accordance with the diameter of the paper tube. Accordingly, it is not necessary to have a separate component in order to adapt to core members having different diameters, but only displacement of the blade member 630 is needed. Thus, it is possible to simplify the construction and provide easy handling properties. In addition, the blade member 630 is expanded by the rotating operation of the knob member 640 provided in the boss member 610. Accordingly, it is possible to simplify the expansion mechanism.

The blade member 630 is expanded within a predetermined angle by means of the cam pins 632 provided in the blade member 630 and the cam holes 642 provided in the knob member 640. Accordingly, it is possible to prevent the blades of the blade member 630 from interfering with each other. In addition, the blade member 630 is expanded in a stepwise manner by means of the cam pins 632 provided in the blade member 630 and the cam holes 642 provided in the knob member 640. Accordingly, it is possible to support core members having different diameters in a suitable manner. In addition, the flange member 620 has a polygon-shaped circumference. Accordingly, it is possible to place the roll paper on a horizontal plane in a stable state when the roll paper is fitted to the rolled medium supporting mechanism 600.

Figure 33:
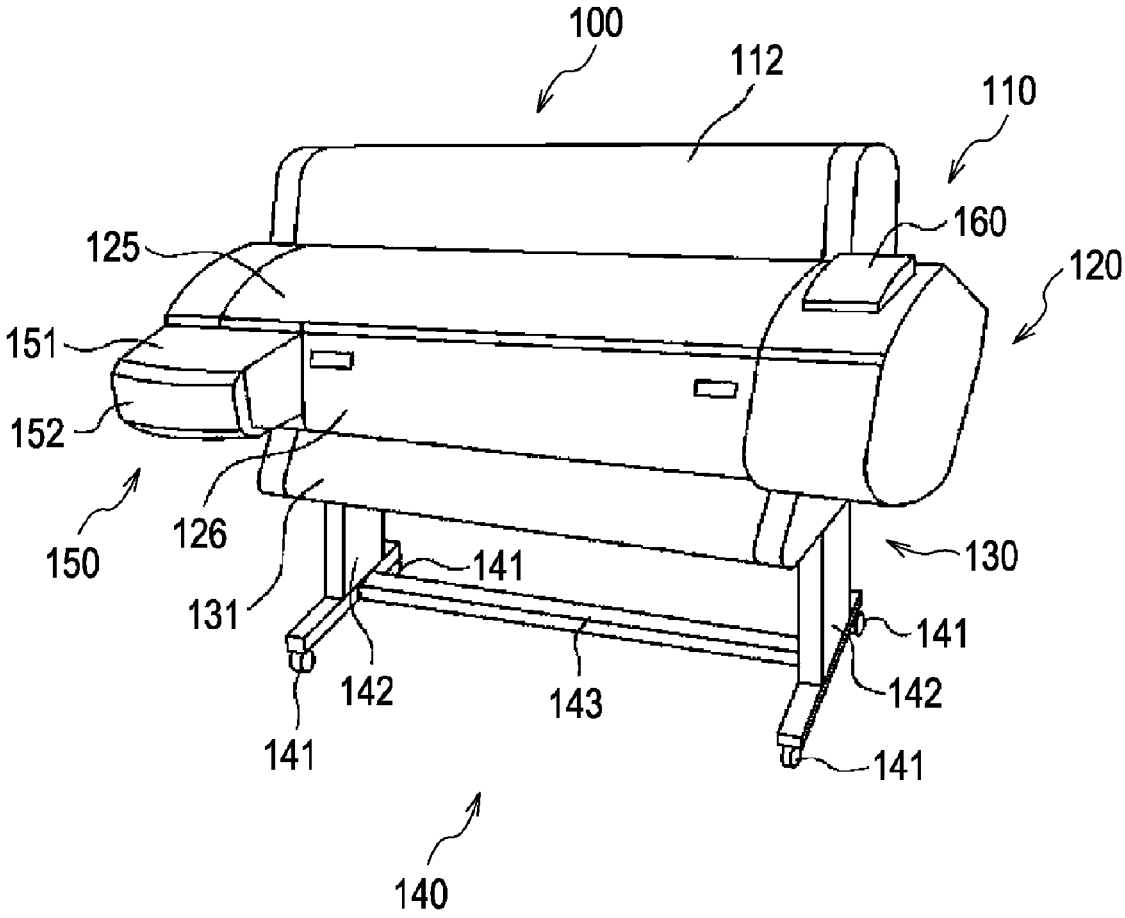
FIG. 33 is a perspective view of an ink-jet printer as an example of a recording apparatus, to which the rolled medium supporting mechanism according to the embodiments of the invention is applicable, showing an exemplary construction of the printer.
Figure 34:
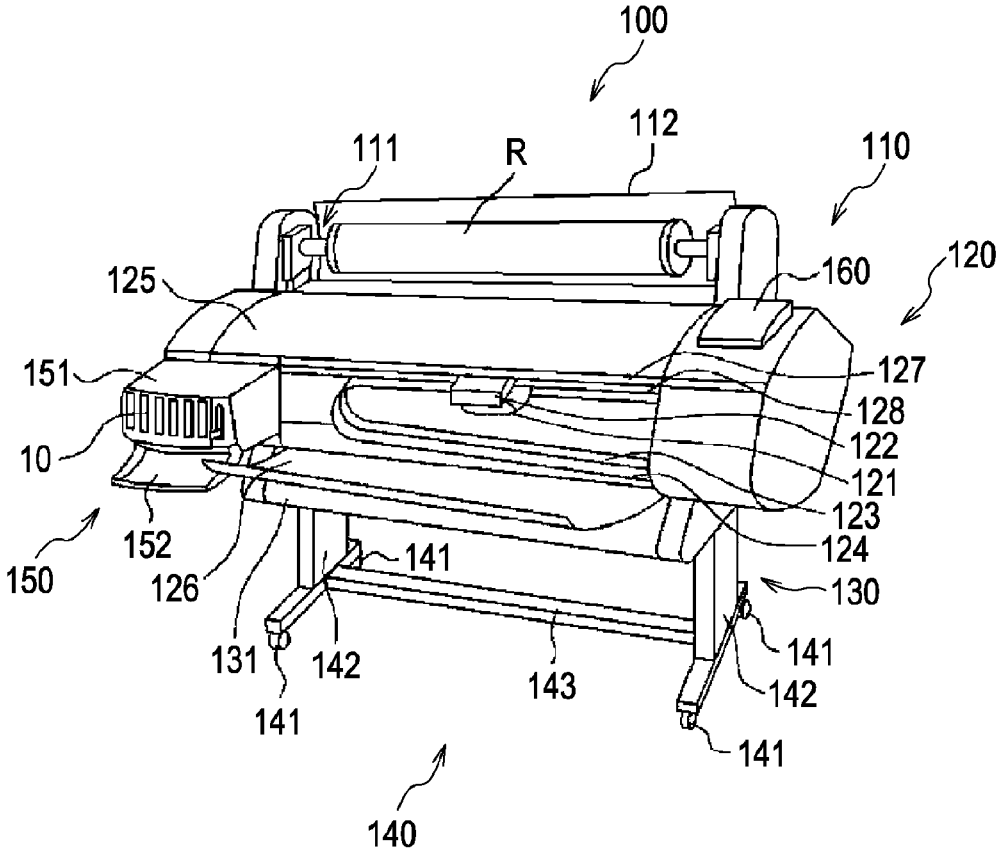
FIG. 34 is a perspective view of the ink-jet printer, showing the internal construction of a main part of the printer shown in FIG. 33.
Figure 35:
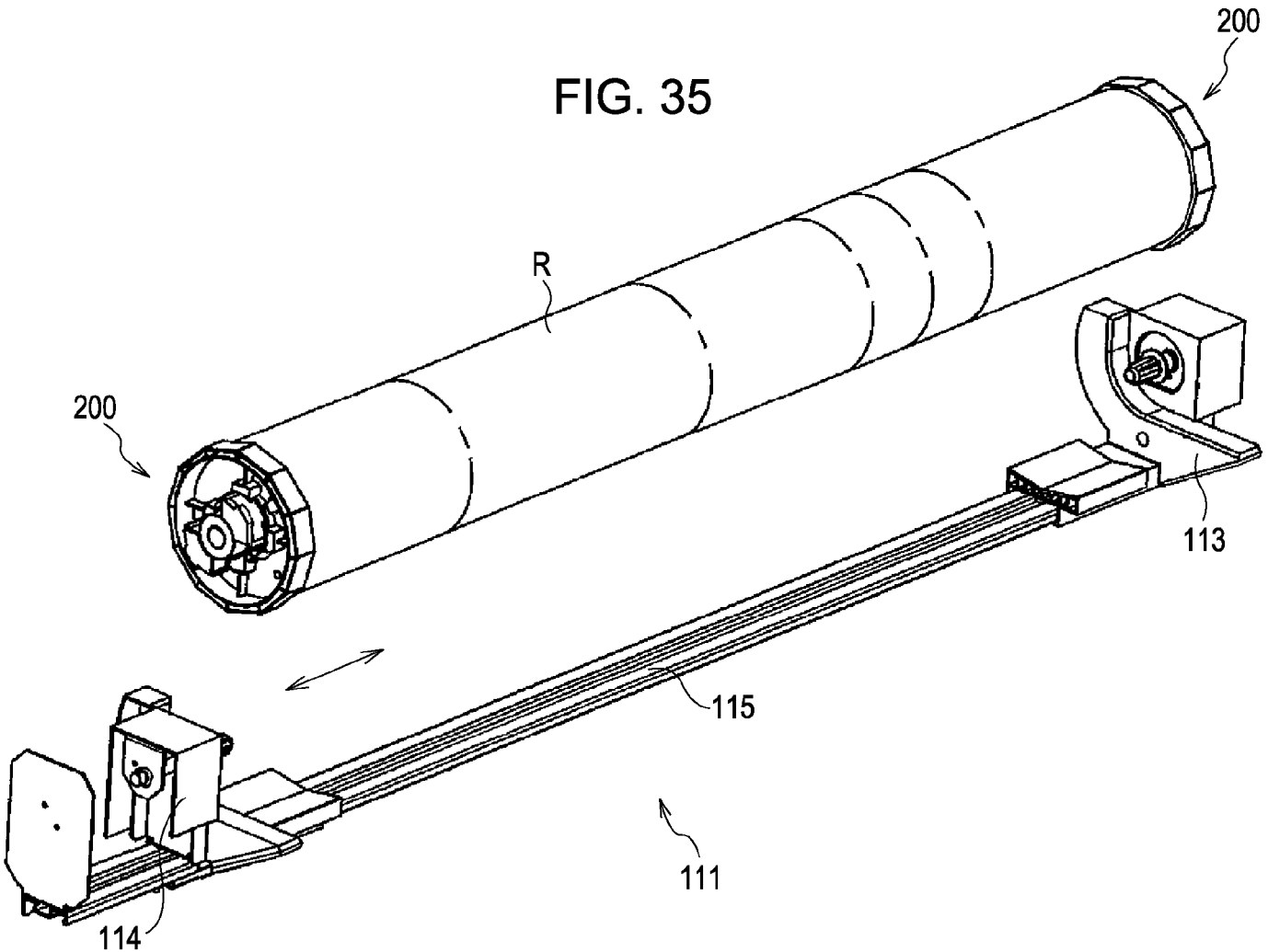
FIG. 35 is a perspective view of a roll paper holder to which a roll paper supported by the rolled medium supporting mechanism according to the embodiments of the invention is set.

In the drawings, FIG. 33 is a perspective view of an ink-jet printer as an example of a recording apparatus, to which the rolled medium supporting mechanism 200 (300, 500, 600) is applicable, showing an exemplary construction of the printer; FIG. 34 is a perspective view of the ink-jet printer, showing the internal construction of a main part of the printer; and FIG. 35 is a perspective view of a roll paper holder to which a roll paper supported by the rolled medium supporting mechanism 200 (300, 500, 600) is set. The ink-jet printer 100 is a large-sized printer capable of recording data on a relatively large-sized roll paper (rolled medium), for example, a paper of A1 size or B1 size in the JIS standard.

As shown in FIG. 33, in the ink-jet printer 100, a feeding unit 110 to which the roll paper supported by the rolled medium supporting mechanism 200 is set, a recording/transporting unit 120, a paper discharging unit 130 and a leg portion 140 are arranged in this order from the upper portion thereof. Specifically, the roll paper supplied from the feeding unit 110 disposed in the uppermost portion is transported obliquely downward between the recording/transporting unit 120 and the discharging unit 130 which are obliquely disposed relative to each other in the lower portion of the feeding unit 110. The roll paper is then discharged to a paper discharging tray (not shown) disposed in the leg portion 140 that is disposed in the lowermost portion. The recording/transporting unit 120 and the paper discharging unit 130 are integrated as a main body, and the paper feeding unit 110 and the leg portion 140 are configured to be separable from the main body.

As shown in FIG. 33, the paper feeding unit 110 is disposed to protrude from the upper rear portion of the main body 120 and 130. Inside the paper feeding unit 110, as shown in FIG. 34, there is provided a roll paper holder 111 capable of setting one roll paper R thereto. Further, as shown in FIGS. 33 and 34, a flip-up type roll paper cover 112 that can be open and closed is fitted to the front of the paper feeding unit 110. Thanks to the roll paper cover 112, it is possible to prevent contamination of the roll paper R held in the roll paper holder 111 and to ensure the user's security.

As shown in FIG. 35, the roll paper holder 111 is provided with a fixed supporting mechanism receiver 113, a movable supporting mechanism receiver 114, and a guide rail 115. The fixed supporting mechanism receiver 113 is fixed to one of side walls of the paper feeding unit 110 so as to axially support the rolled medium supporting mechanism 200 fitted to one end of the roll paper R in a rotatable manner. The movable supporting mechanism receiver 114 is movably disposed in the other side wall of the paper feeding unit 110 so as to axially support the rolled medium supporting mechanism 200 fitted to the other end of the roll paper R in a rotatable manner. The guide rail 115 is disposed between the fixed supporting mechanism receiver 113 and the movable supporting mechanism receiver 114 so as to guide the sliding of the movable supporting mechanism receiver 114.

The rolled medium supporting mechanism 200 fitted to the roll paper R is supported by the fixed supporting mechanism receiver 113 and the movable supporting mechanism receiver 114 in a state in which both ends of the mechanism are inserted into the receivers. The movable supporting mechanism receiver 114 can slide along the guide rail 115, and it is therefore possible to support different-sized roll papers R, as indicated by the dashed-dotted lines in the drawing. As shown in FIGS. 33 and 34, the entire portion of the roll paper cover 112 is pivotably supported and is configured to be open or closed by the user raising or pressing down the lower portion of the roll paper cover 112. Accordingly, the user can open or close the roll paper cover 112 in a simple manner and it is therefore possible to reduce the replacing time of the roll paper R.

As shown in FIG. 35, the recording/transporting unit 120 is provided with a carriage 122 having a recording head 121 mounted thereon, a flexible flat cable (hereinafter referred to as FFC) 123 for electrically connecting the recording head 121 to a control unit (not shown) for causing a recording operation to be performed, and an ink tube 124 for connecting the recording head 121 to an ink cartridge 10 filled with ink. The recording/transporting unit 120 is further provided with a paper feeding roller (not shown) and a driven roller (not shown) which are opposed to move toward and away from each other, a platen (not shown) disposed opposite the recording head 121 mounted on the carriage 122, and so forth. As shown in FIGS. 33 and 34, an upper cover 125 and a front cover 126 are fitted to the top and front faces of the recording/transporting unit 120 so as to cover the recording head 121, the carriage 122, and the like.

The recording head 121 is provided with a black ink recording head that ejects black ink and a plurality of color ink recording heads that eject each color of light yellow, yellow, light cyan, cyan, light magenta, and magenta. Further, the recording head 121 has a pressure generating chamber and nozzle openings communicating with the pressure generating chamber. The pressure generating chamber storing the ink therein is pressurized at a predetermined pressure, whereby size-controlled ink droplets are ejected from the nozzle openings to the roll paper. As shown in FIG. 34, the carriage 122 is suspended via a roller from a rail 127 provided in the main scanning direction and is coupled to a carriage belt 128. When the carriage belt 128 is operated by a carriage driving device (not shown), the carriage 122 cooperates with the movement of the carriage belt 128 and reciprocates while being guided by the rail 127.

As shown in FIG. 34, one end of the FFC 123 is connected to a connector of the control unit and the other end is connected to a connector of the recording head 121, so that recording signals are sent from the control unit to the recording head 121. The ink tube 124 is provided for each ink of different colors. One end of each ink tube 124 is connected to the ink cartridge 10 for corresponding color via an ink pressurizing/supplying device (not shown), and the other end of each ink tube 124 is connected to the recording head 121 for corresponding color. As shown in FIGS. 33 and 34, the lower portion of the front cover 126 is pivotably supported and is configured to be open or closed by the user pressing down or raising the upper portion of the front cover 126.

The paper feeding roller is formed as one lengthy roller, and both ends are axially supported by a side frame via a bearing. The paper feeding roller is driven with the driving force transmitted from a paper feeding motor via a pulley and a belt so as to rotate in a positive or negative direction. The driven roller is formed as a plurality of short rollers, and is axially supported by a plurality of driven-roller supporting members which are arranged above the paper feeding roller in parallel to the axial direction. The platen is formed in a rectangular flat plate-like shape slightly longer than the maximum recordable paper width, and is disposed close to the downstream side of the transportation path of the paper feeding roller.

As shown in FIGS. 33 and 34, the paper discharging unit 130 is provided with a paper discharging guide 131 forming a part of the path through which the roll paper is transported in the sub-scanning direction and a paper discharging roller (not shown) for transporting the roll paper in the sub-scanning direction. As shown in FIGS. 33 and 34, the leg portion 140 is provided with two support pillars 142 having moving casters 141 and a reinforcing bar 143 stretched between the support pillars 142. The paper feeding unit 110 and the body 120 and 130 are placed on the support pillars 142 and fixed with screws.

As shown in FIGS. 33 and 34, a holder body 151 for receiving and holding the ink cartridge 10 for each color and an ink cartridge holder 150 having a cover 152 for covering the front of the holder body 151 are disposed on the left side of the body 120 and 130 as seen from the front side thereof. As shown in FIGS. 33 and 34, an operation panel 160 for allowing the user to perform a recording control and the like is disposed in the upper portion on the right side of the body 120 and 130 as seen from the front side thereof. A liquid crystal screen and various buttons, which are electrically connected to a control unit (not shown), are disposed on the operation panel 160 and the user is allowed to push the buttons while looking at the screen for confirmation.

The rolled medium supporting mechanism 200 (300, 500, 600) described above can be applied to a recording apparatus such as facsimiles or copying machines as long as a rolled medium is usable in the recording apparatus.

The invention claimed is:

1. A rolled medium supporting mechanism for supporting a rolled medium to be rotatable around a roll shaft, the rolled medium supporting mechanism comprising:

a supporting member having a substantially cylindrical shape with a plurality of rectangular-shaped window portions provided therein and having pin attachment portions;

a plurality of pins disposed in the pin attachment portions and extending in an axial direction from the supporting member;

a flange member formed integrally and concentrically with the supporting member and having a circular dish-like shape and which makes abutting contact with an edge of the rolled medium, the flange member having a circular hole and a cutout portion formed in an end face center of the circular dish-like shape;

an opening/closing member having a substantially circular dish-like shape having a first end face having a plurality of cam holes and a handle portion which enables a user to rotate the opening/closing member, a second end face of the opening/closing member having a shaft portion which extends through the circular hole of the flange member and which is disposed inside the supporting member; and a plurality of blade members arranged in the circumferential direction of the supporting member, each member of the plurality of blade members having a substantially rectangular shape in which a first edge thereof is supported by the plurality of pins extending from the pin attachment portions of the supporting member in the axial direction, an end facing the opening/closing member, the end having a plurality of cam pins formed therein which extend through the cam holes of the opening/closing member, while a second edge of the plurality of blade members is capable of moving in the circumferential direction from the supporting member from the rectangular-shaped window portions towards the outer circumference of an inner peripheral face of the flange member in order to make abutting contact with a inner peripheral face of the hollow shaft portion of the rolled medium as the handle portion of the opening/closing member is rotated by the user, causing the cam pins of the blade members to be guided from a first position in the cam holes to a second position;

wherein the opening/closing member causes the blade members to move from a position where the expandable abutting members block the rectangular-shaped window portions of the supporting member are concentric with an outer surface of the supporting member by causing the second edge to move away from the supporting member a predetermined angle in accordance with an inner diameter of the hollow shaft portion of the rolled medium, wherein the cutout portion of the flange member prevents the blade members from interfering with each other as they are moved.

* * * * *